US008910326B2

(12) United States Patent
Wilson

(10) Patent No.: US 8,910,326 B2
(45) Date of Patent: Dec. 16, 2014

(54) WHEELCHAIR LIFT TRANSFER DEVICE

(71) Applicant: Harold Robert Wilson, Holland, MI (US)

(72) Inventor: Harold Robert Wilson, Holland, MI (US)

( * ) Notice: Subject to any disclaimer, the term of this patent is extended or adjusted under 35 U.S.C. 154(b) by 0 days.

(21) Appl. No.: 13/723,715

(22) Filed: Dec. 21, 2012

(65) Prior Publication Data

US 2013/0111660 A1 May 9, 2013

Related U.S. Application Data

(63) Continuation-in-part of application No. PCT/US2011/041320, filed on Jun. 22, 2011.

(60) Provisional application No. 61/398,174, filed on Jun. 22, 2010, provisional application No. 61/462,042, filed on Jan. 27, 2011.

(51) Int. Cl.
*A61G 5/04* (2013.01)

(52) U.S. Cl.
USPC ..... 5/86.1; 5/81.1

(58) Field of Classification Search
USPC ..... 5/81.1 R, 86.1, 87.1, 83.1
See application file for complete search history.

(56) References Cited

U.S. PATENT DOCUMENTS

| | | | | |
|---|---|---|---|---|
| 2,096,050 | A | | 10/1937 | Lucker |
| 2,539,346 | A | | 1/1951 | Feist |
| 3,205,512 | A | | 9/1965 | Camper |
| 3,596,298 | A | | 8/1971 | Durst, Jr. |
| 3,940,808 | A | | 3/1976 | Petrini |
| 4,193,147 | A | * | 3/1980 | Fischer ..... 5/87.1 |
| 4,704,749 | A | | 11/1987 | Aubert |
| 5,201,377 | A | * | 4/1993 | Wilson ..... 180/6.5 |
| 5,255,934 | A | | 10/1993 | Wilson |
| 5,388,289 | A | | 2/1995 | Casperson |
| 5,538,268 | A | * | 7/1996 | Miller ..... 280/87.05 |
| 5,853,015 | A | | 12/1998 | Evans |
| 6,161,232 | A | | 12/2000 | von Schroeter et al. |
| 6,430,761 | B1 | | 8/2002 | Brandorff et al. |
| 6,643,869 | B1 | | 11/2003 | Sloan, Jr. |
| 7,434,278 | B2 | | 10/2008 | White et al. |
| 7,827,630 | B2 | | 11/2010 | Bostelman et al. |
| D673,082 | S | * | 12/2012 | AlGhazi ..... D12/130 |
| 2006/0011228 | A1 | | 1/2006 | Craig |
| 2007/0028381 | A1 | | 2/2007 | Palay |

FOREIGN PATENT DOCUMENTS

| | | |
|---|---|---|
| EP | 0 424 344 | 4/1991 |
| FR | 2 625 488 | 7/1989 |
| WO | WO 2007/013827 | 2/2007 |

OTHER PUBLICATIONS

PCT International Preliminary Report on Patentability PCT/US2011/041320, issued Dec. 28, 2012.

* cited by examiner

*Primary Examiner* — Fredrick Conley
(74) *Attorney, Agent, or Firm* — Miller, Canfield, Paddock and Stone; Mark L Maki

(57) ABSTRACT

An improved wheelchair lift-transfer device provides capabilities for a patient or caregiver to independently control the wheelchair and lift functions to elevate and move about safely. The patient can use a handheld wireless remote control and summon their wheelchair lift-transfer device from across the room, to their bedside, then independently transfer into the device and then drive it about in their home, raising and lowering their body as needed.

14 Claims, 53 Drawing Sheets

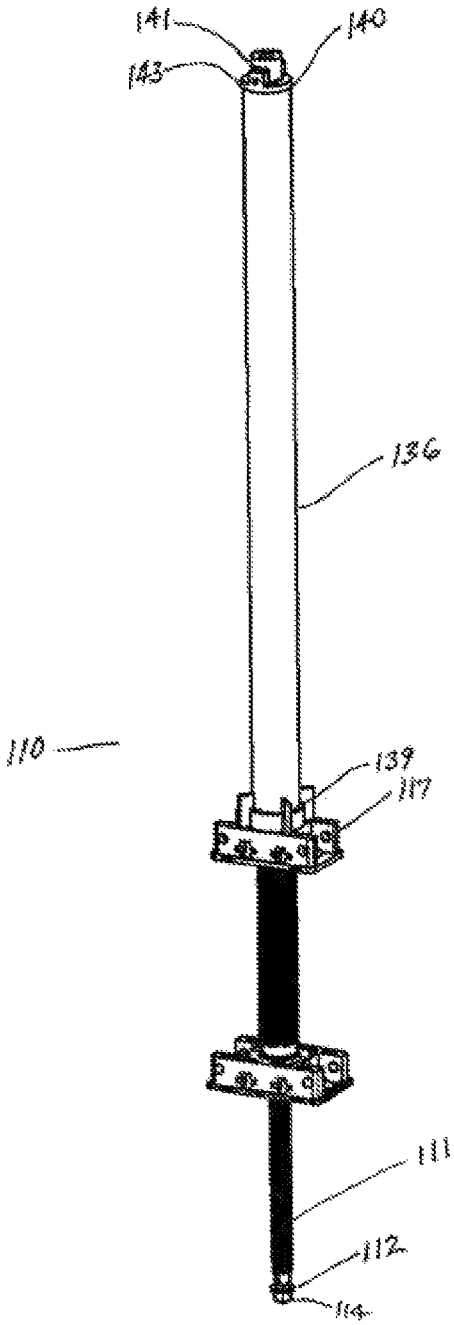
Fig. 8
Fig. 9
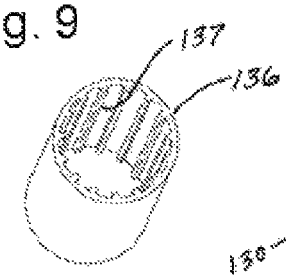
Fig. 10
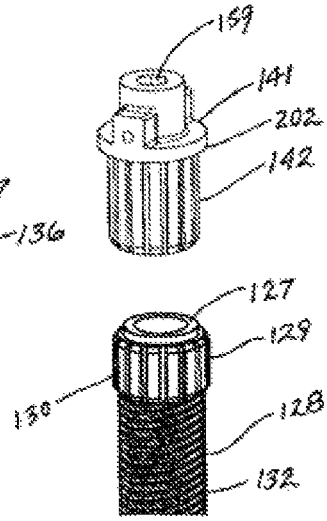
Fig. 11
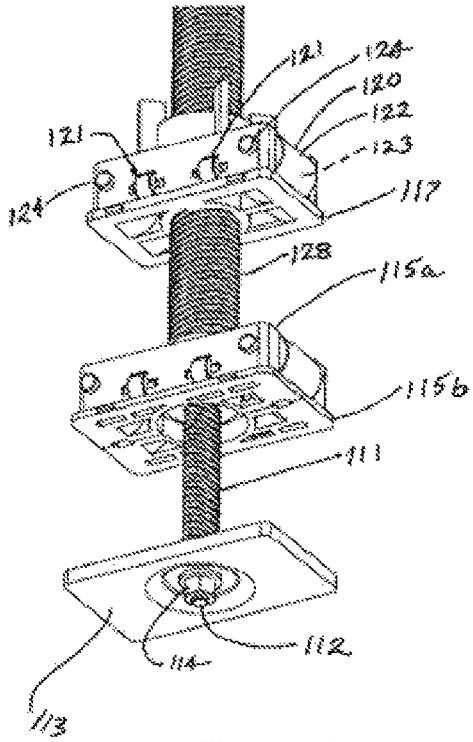
Fig. 12

Fig. 19
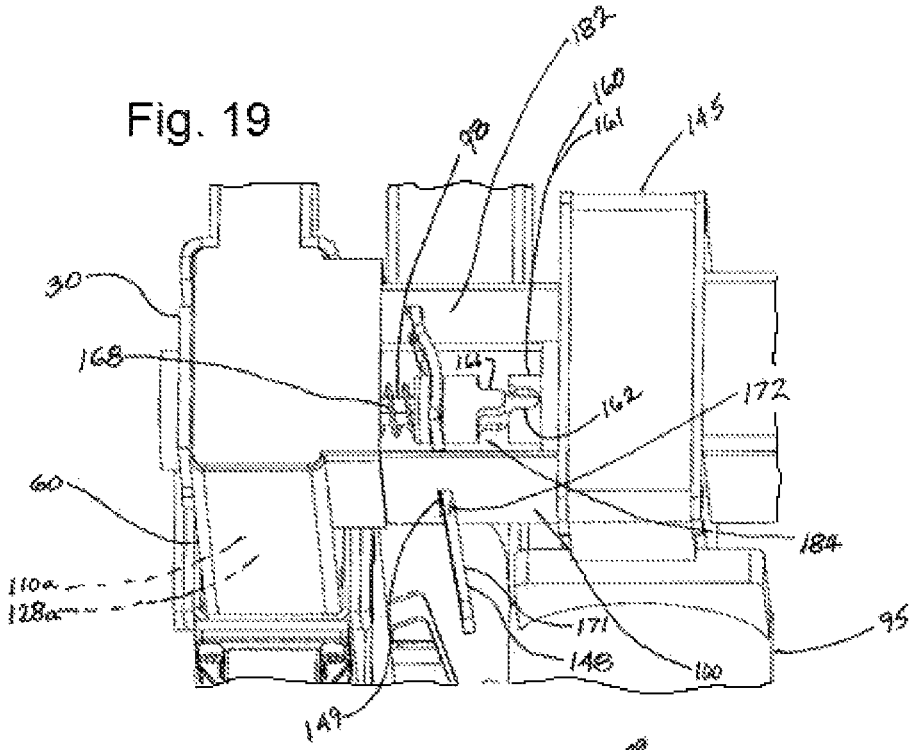
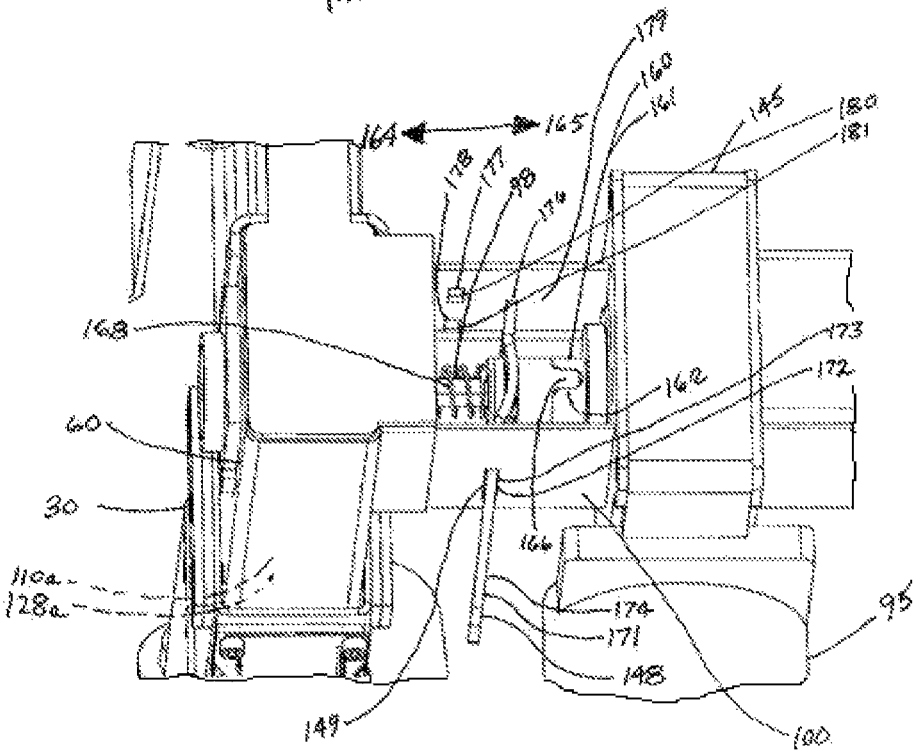
Fig. 20

Fig. 23
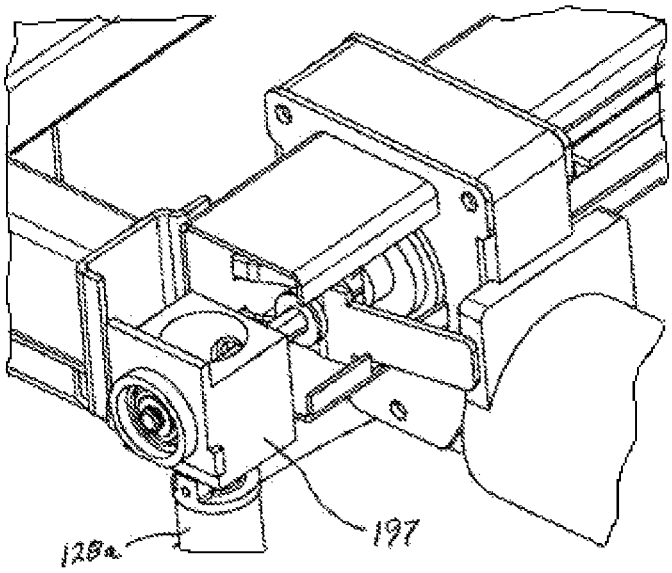
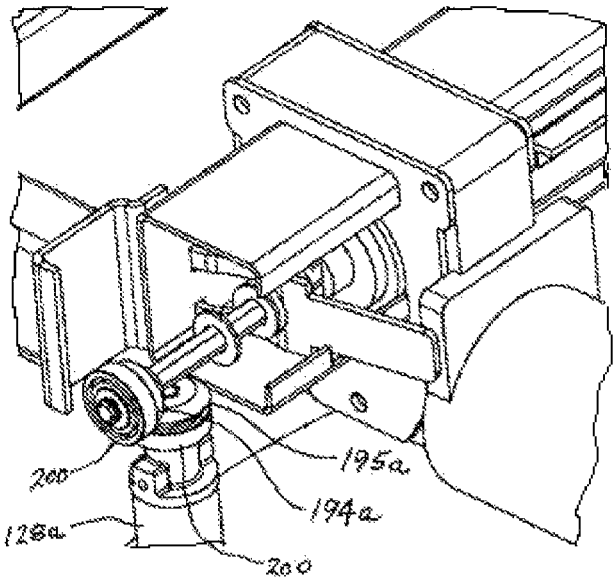
Fig. 24

Fig. 28
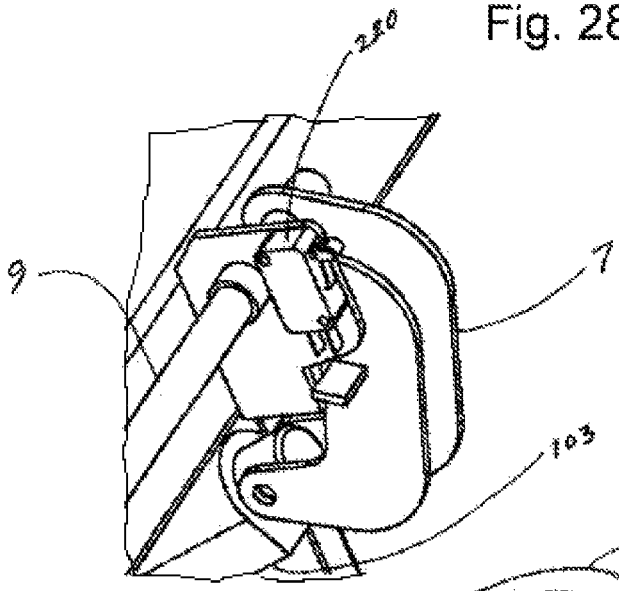
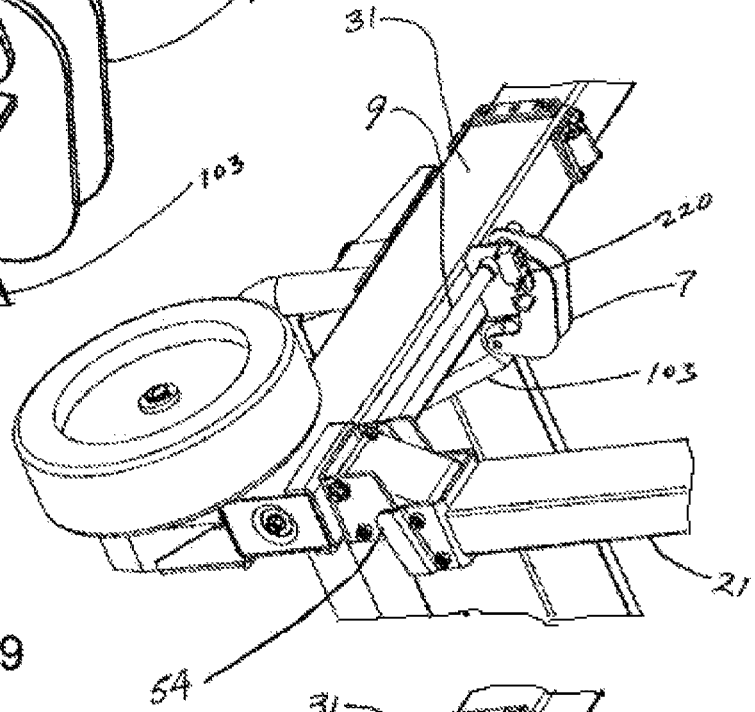
Fig. 29
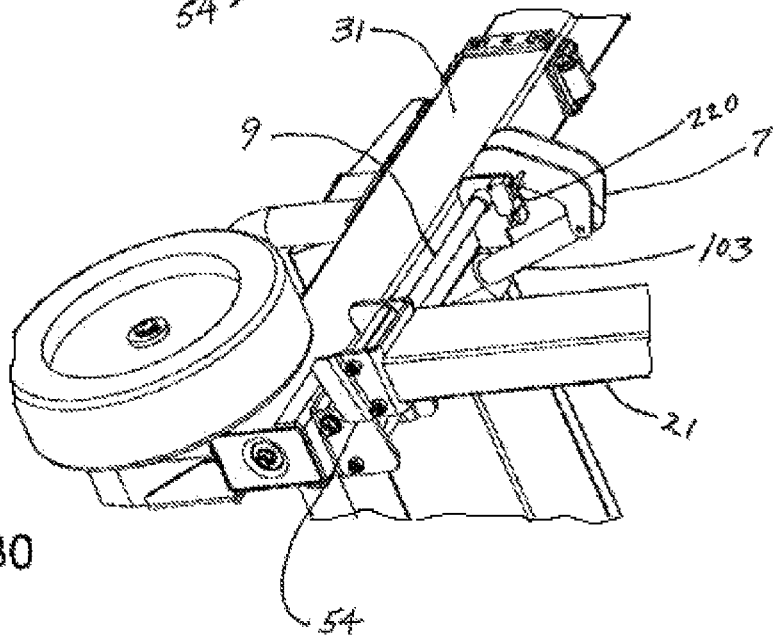
Fig. 30

Fig. 34
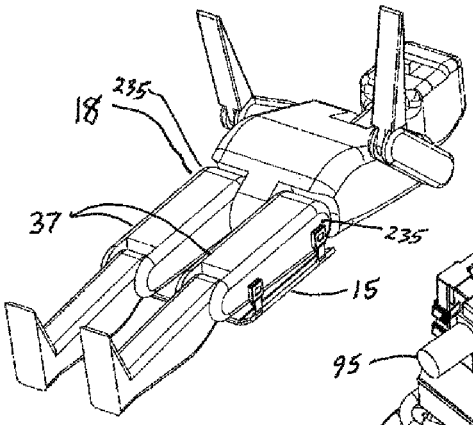
Fig. 35
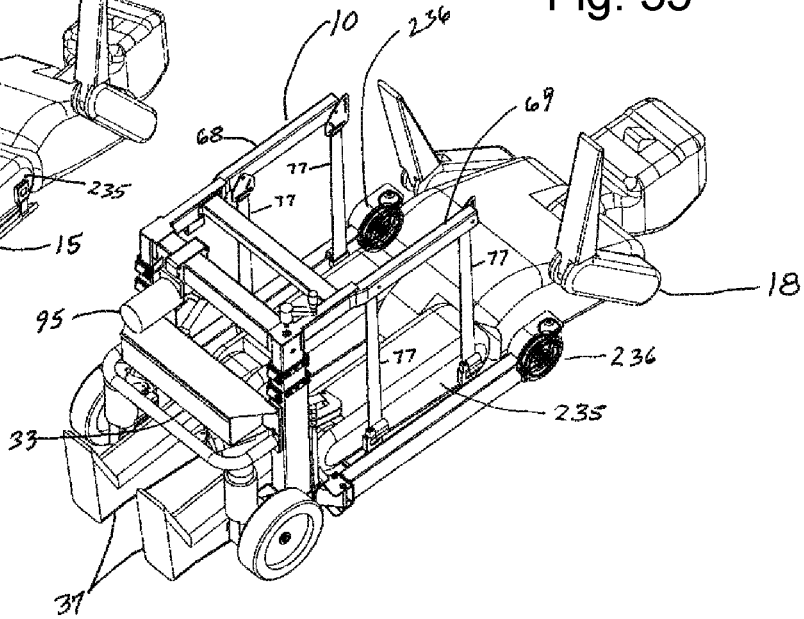
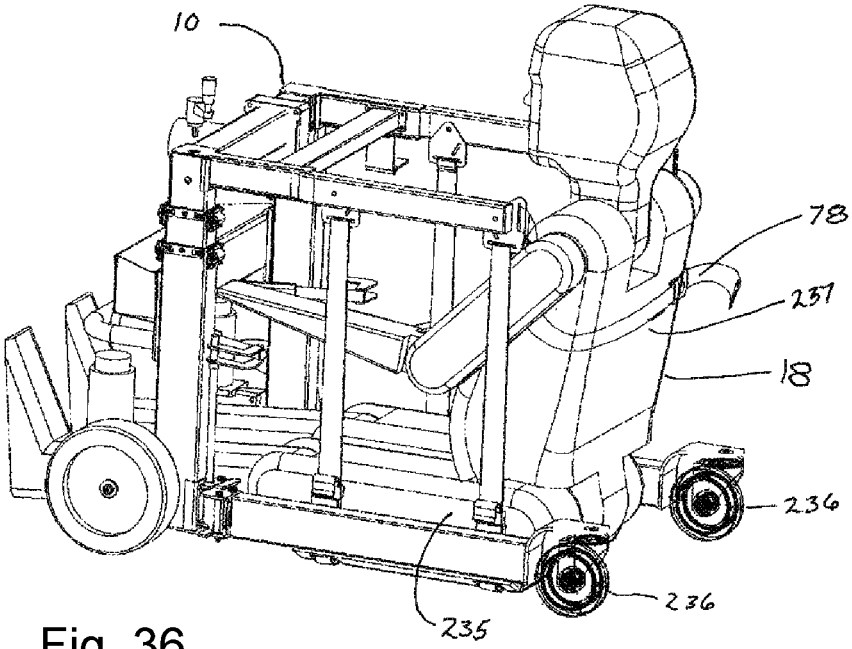
Fig. 36

Fig. 41
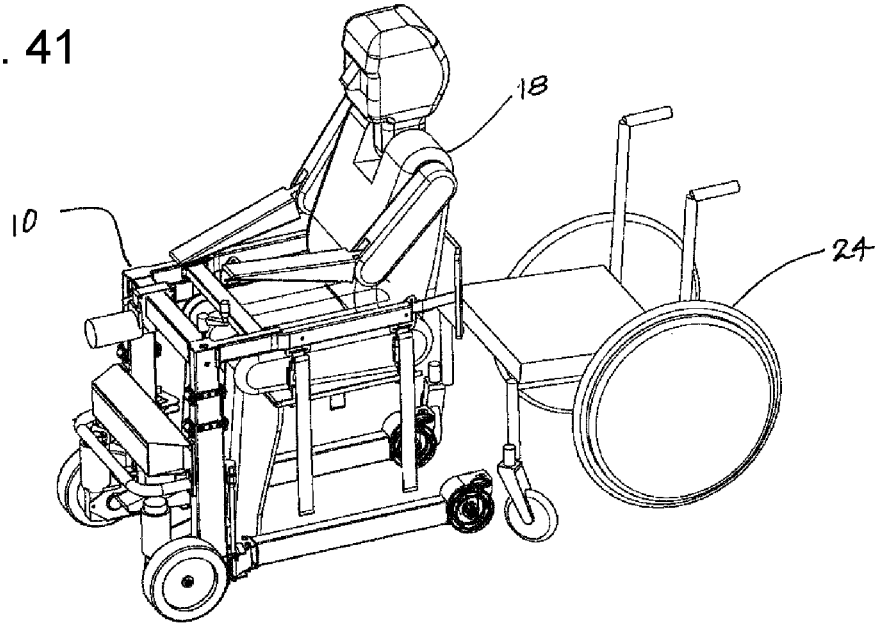
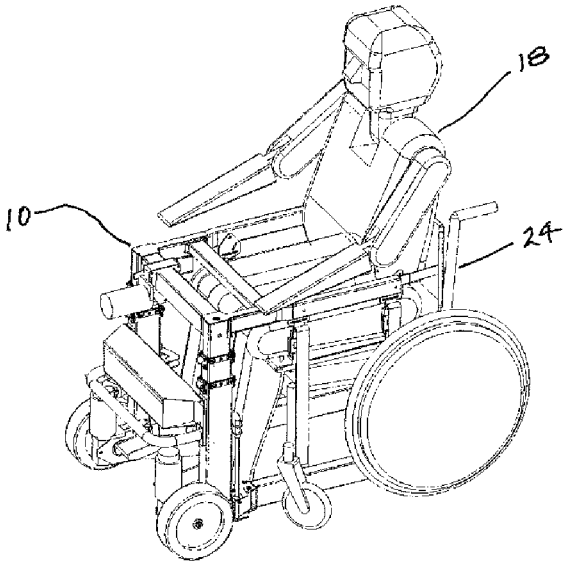
Fig. 42
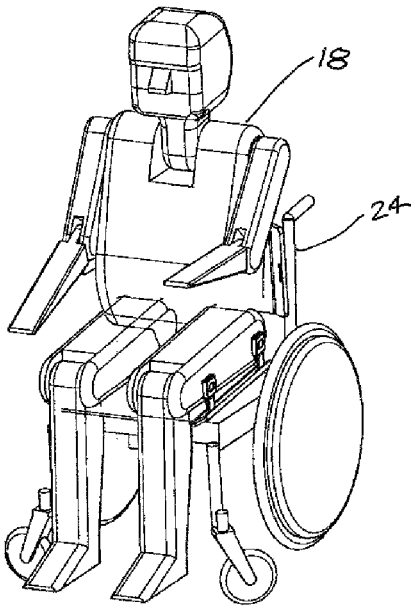
Fig. 43

Fig. 46
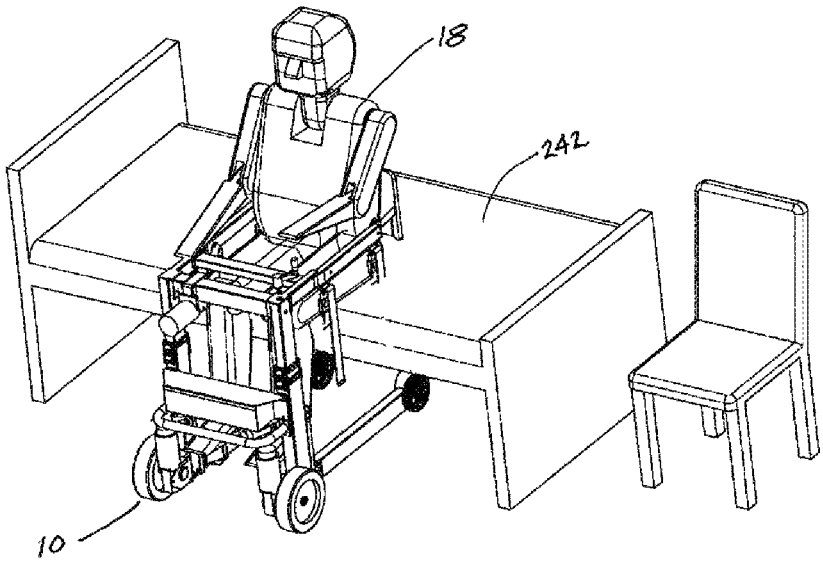
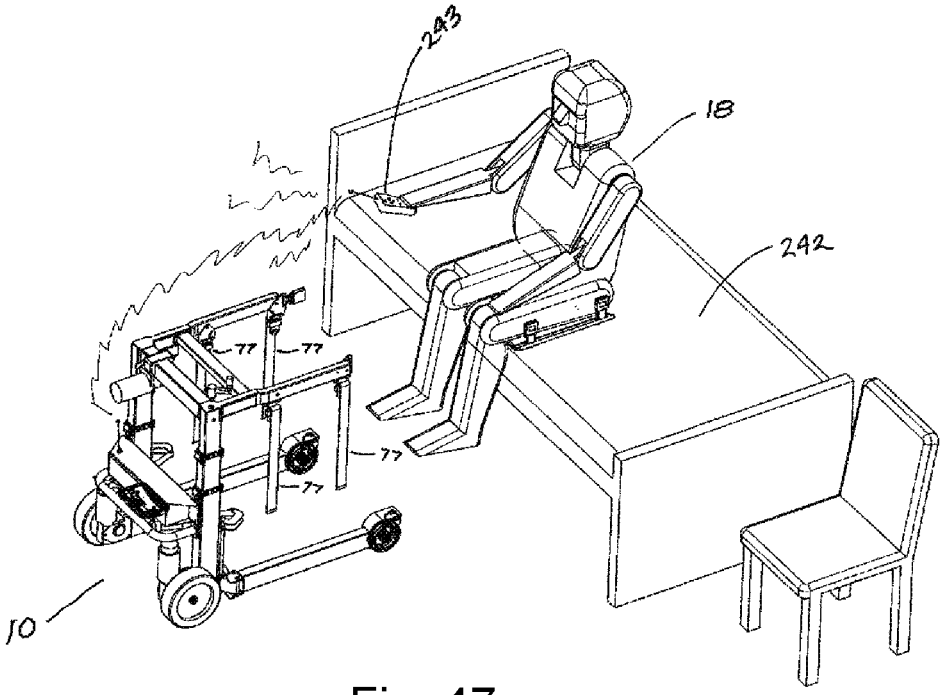
Fig. 47

Fig. 57
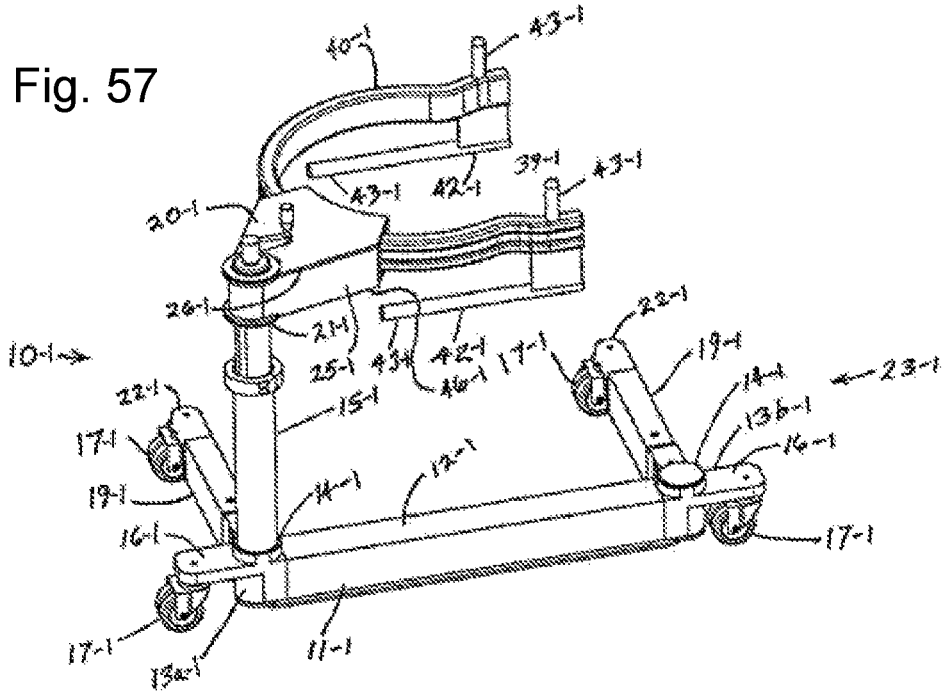
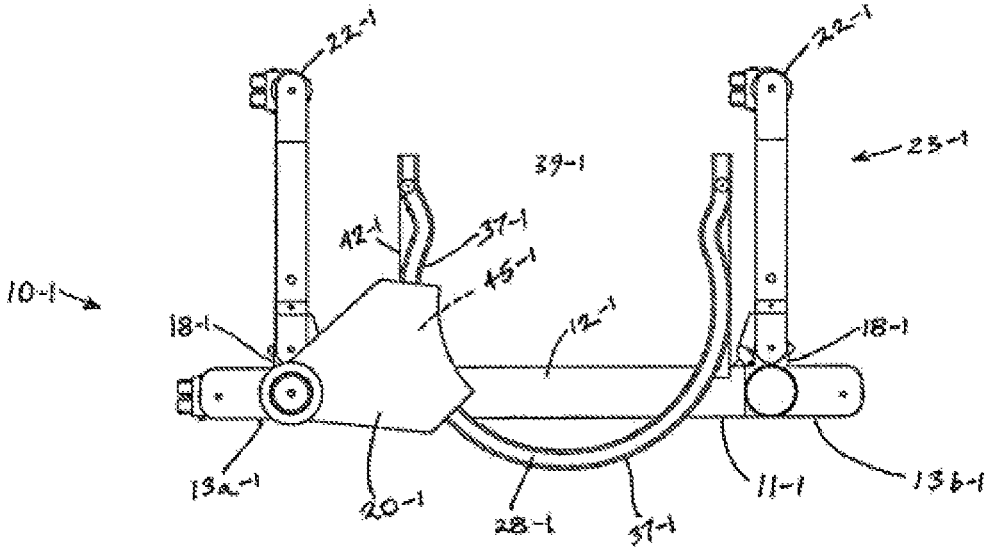
Fig. 58

Fig. 59
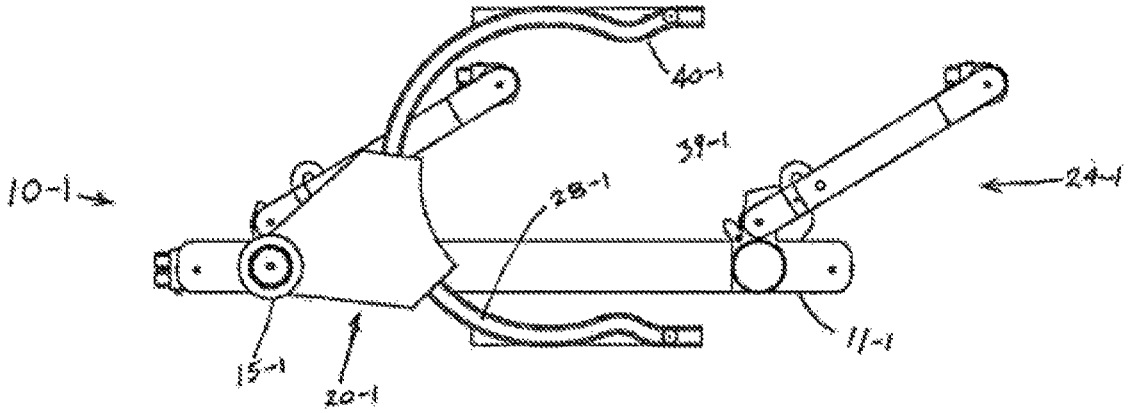
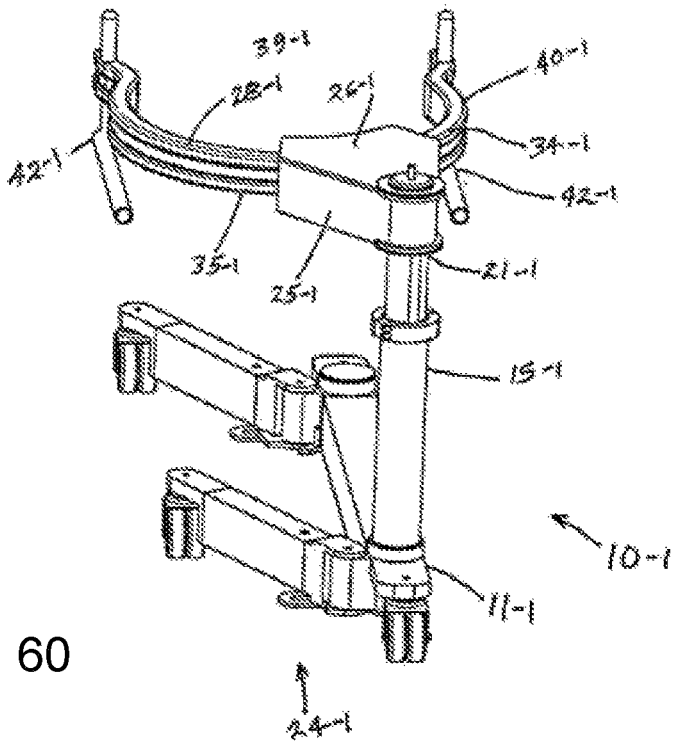
Fig. 60

Fig. 61
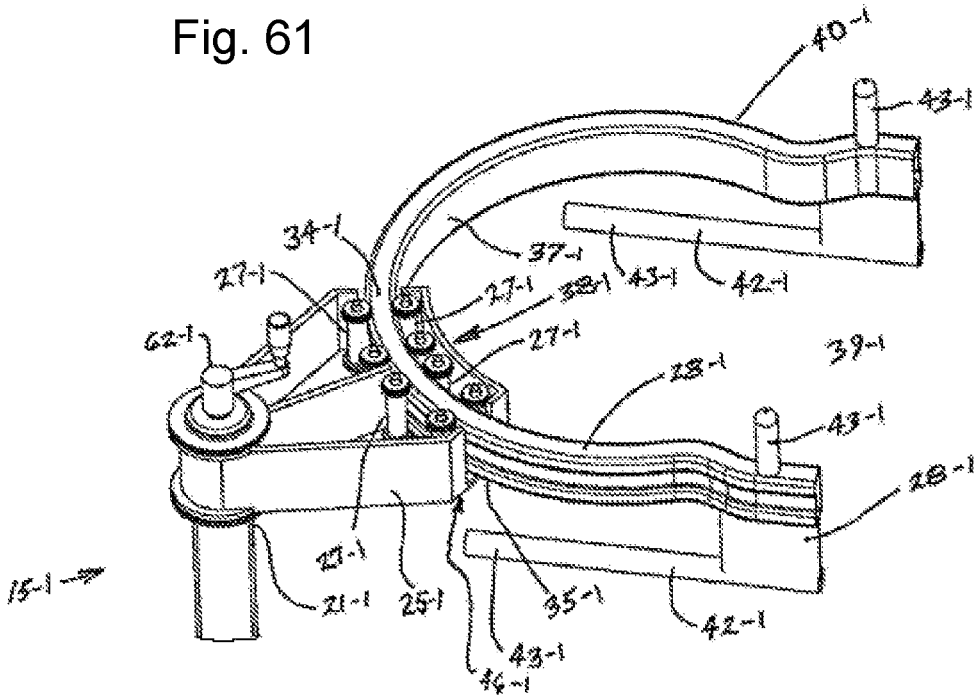
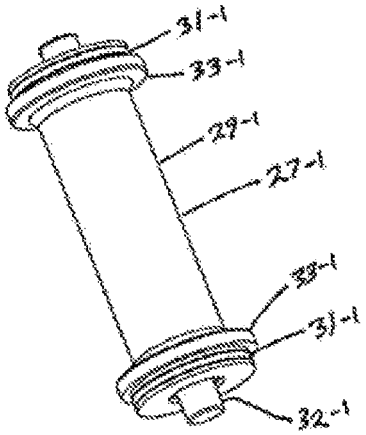
Fig. 62
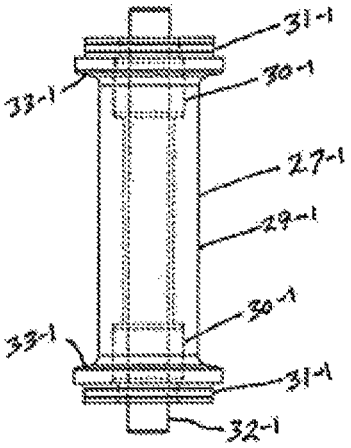
Fig. 63

Fig. 64
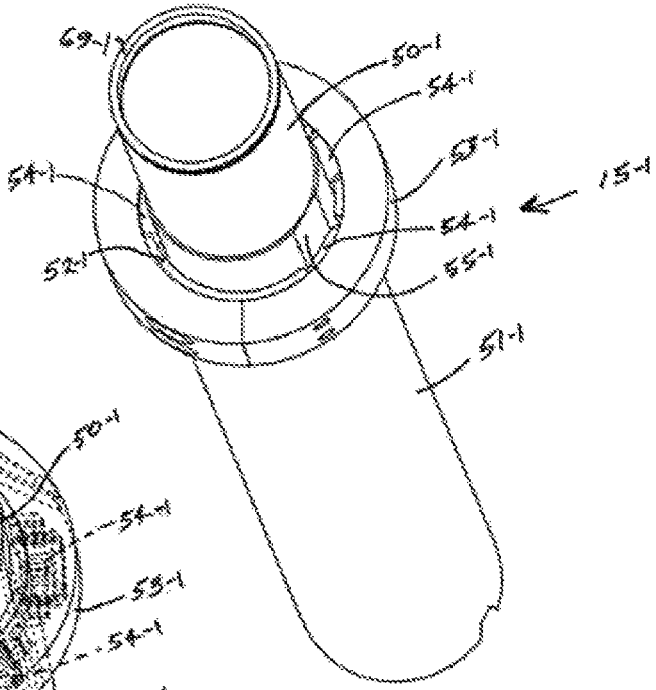
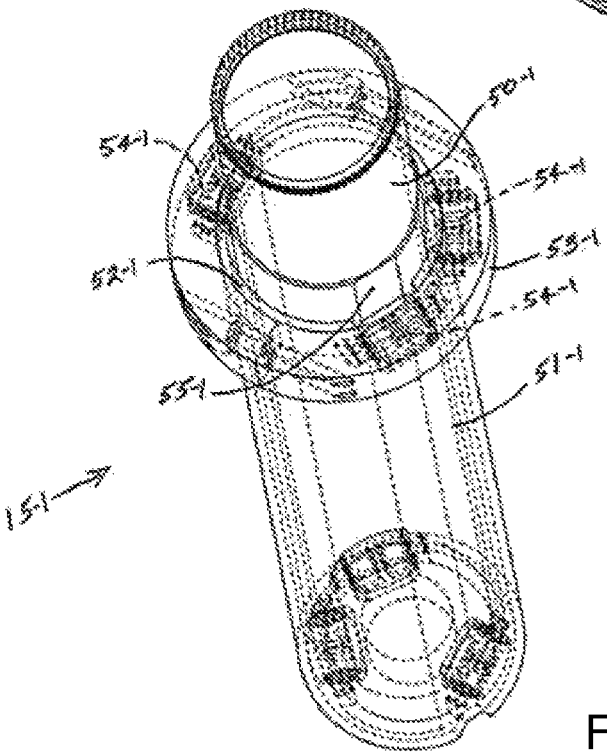
Fig. 65

Fig. 66
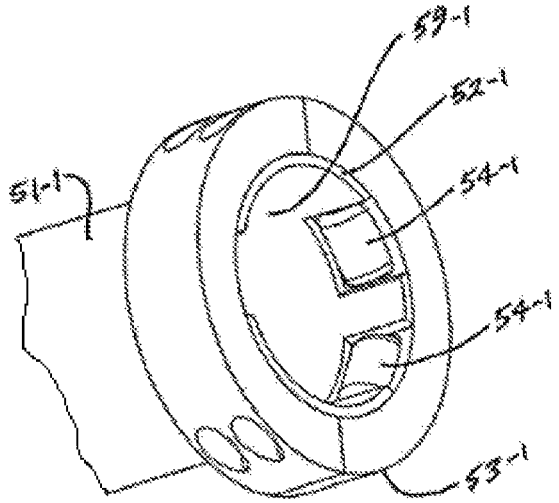
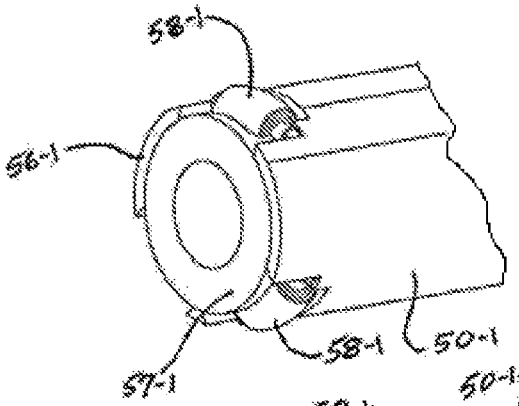
Fig. 67
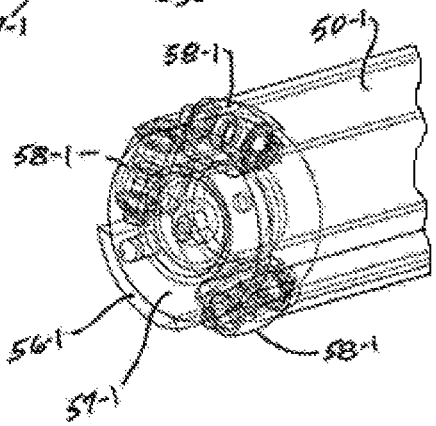
Fig. 68

Fig. 81
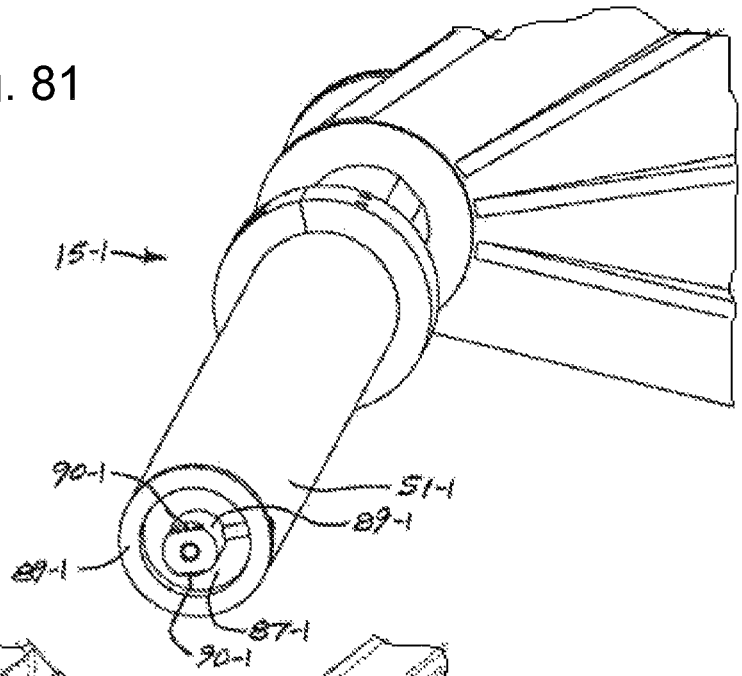
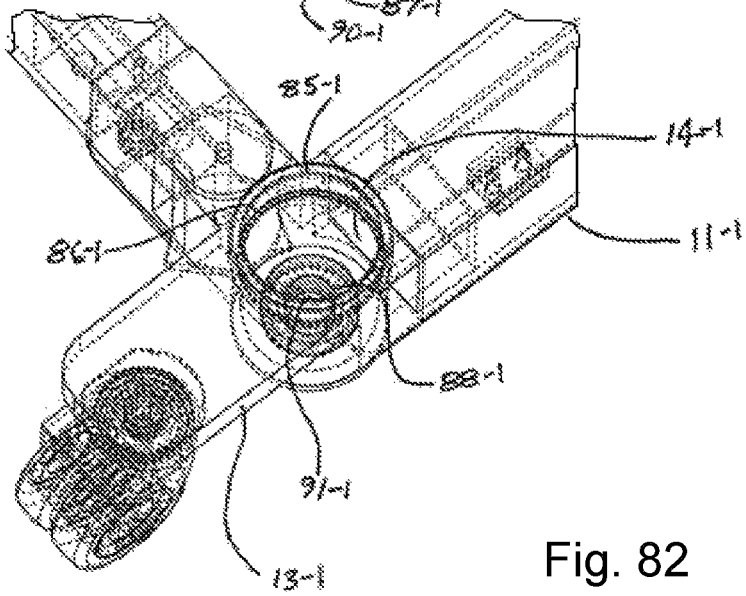
Fig. 82

Fig. 84
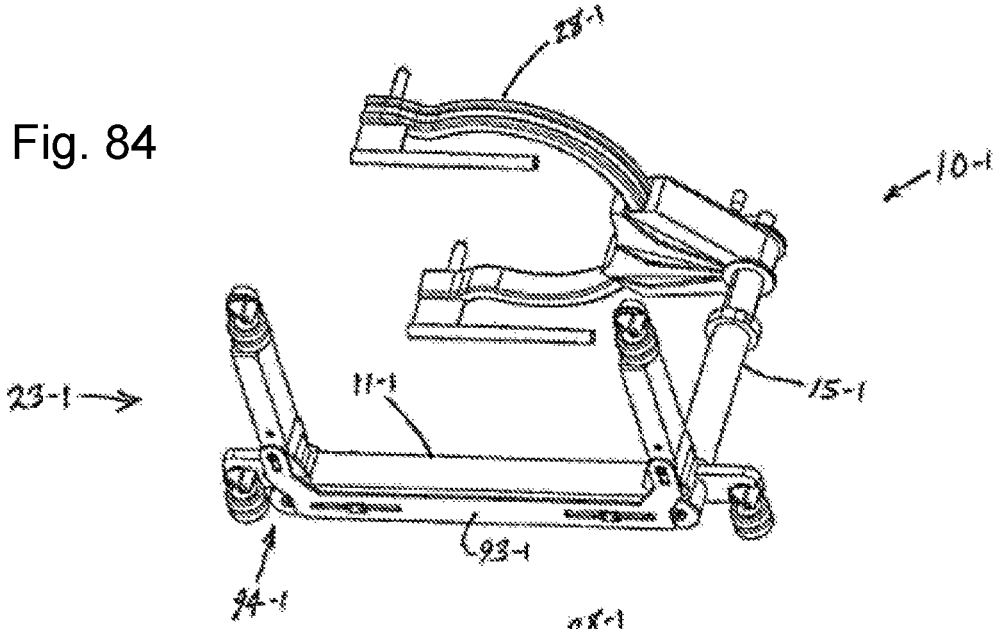
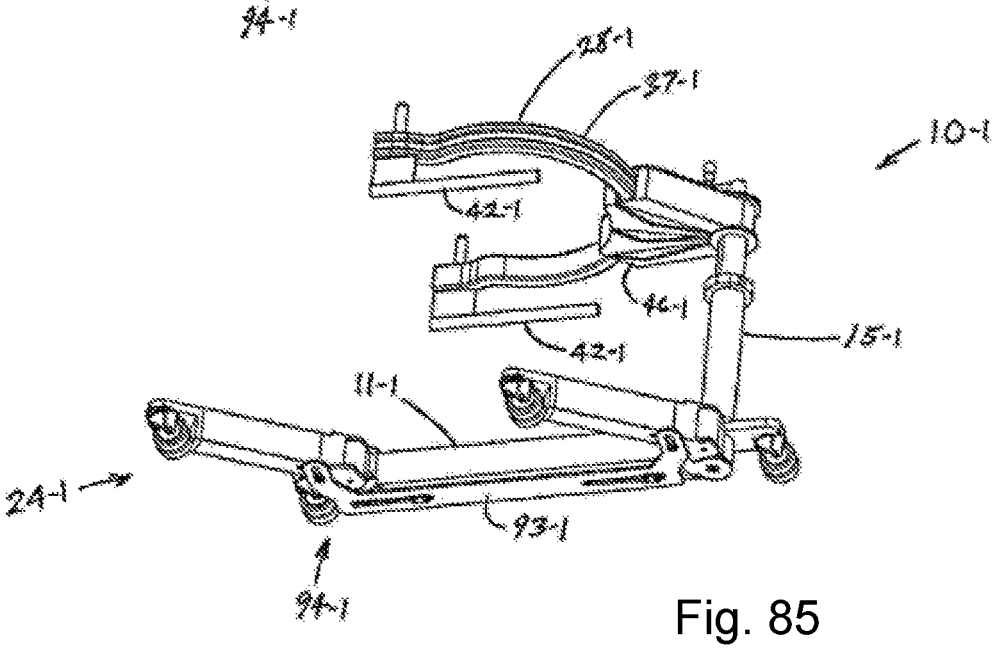
Fig. 85

Fig. 93
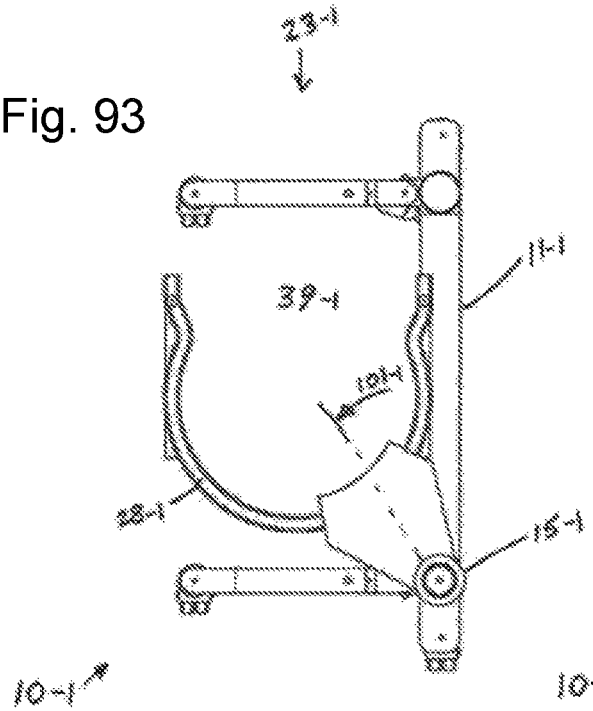
Fig. 94
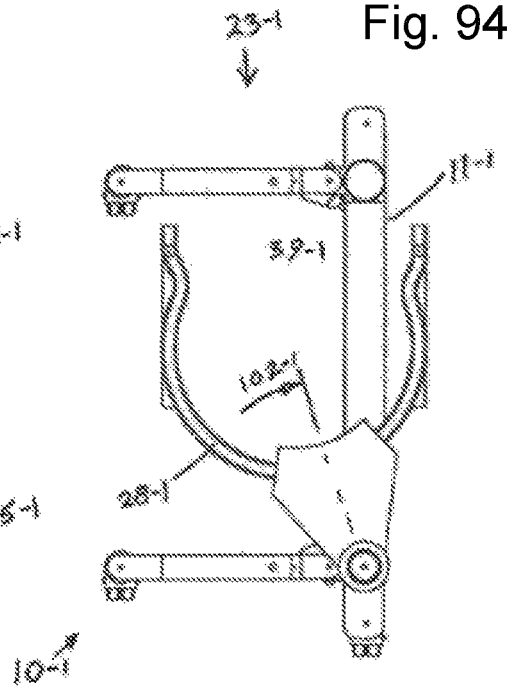
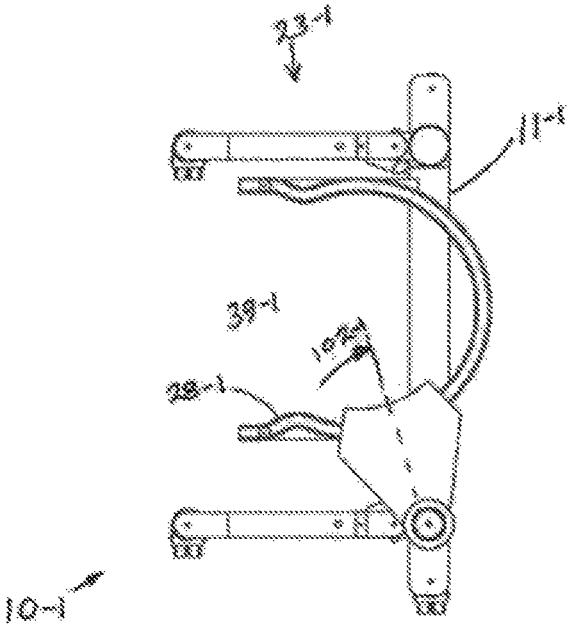
Fig. 95
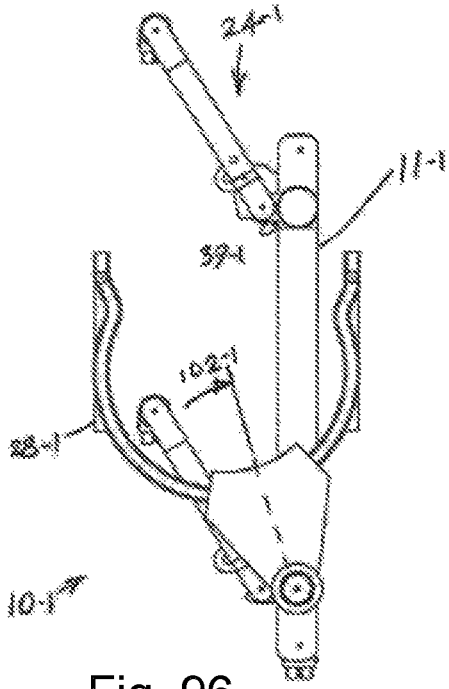
Fig. 96

Fig. 102
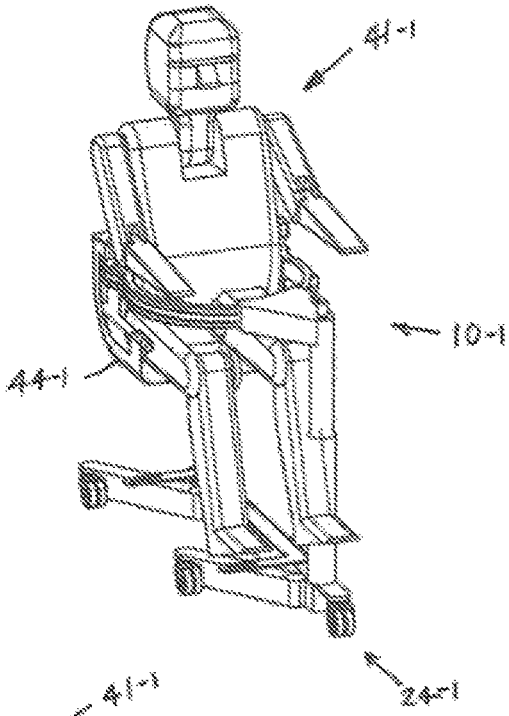
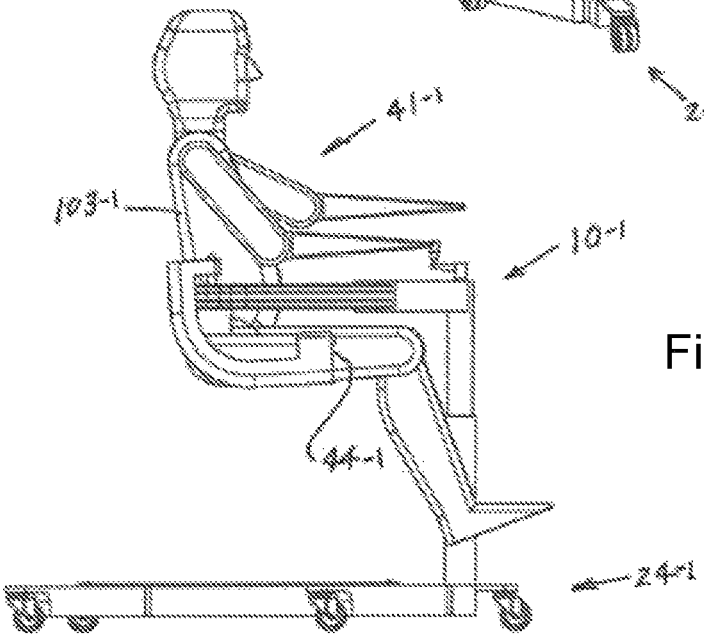
Fig. 103

WHEELCHAIR LIFT TRANSFER DEVICE

CROSS REFERENCE TO RELATED APPLICATIONS

This application is a continuation in part of PCT Application number PCT/US2011/041320, filed Jun. 22, 2011, which PCT application claims priority from provisional application Nos. 61/398,174, filed on Jun. 22, 2010 and 61/462,042, filed Jan. 27, 2011, and all of which are incorporated herein by reference.

FIELD OF THE INVENTION

This invention relates to an improved patient transfer-lift and rotation device that can be used as a patient controlled wheelchair. Another embodiment is especially suitable for patient transfers within passenger aircraft.

BACKGROUND OF THE INVENTION

In a first aspect of the invention, many patients desire mobility and independence. Conventional patient controlled powered wheelchairs are front entry in that the supporting structure is under and behind the seated user, and even though they provide great mobility, the conventional wheelchair is hampered by front entry when lifting and transfer capabilities are added. Conversely, wheeled patient transfer-lifts are usually rear entry in that the patient faces and is suspended from the lifting structure. Also, transfer-lifts are nearly exclusively operated by a caregiver even though the patient being lifted and transported may have significant capabilities. Rear entry transfer-lifts offer an advantage in transfer operations by the natural orientation of the patient that compliments transfer to other equipment or furnishings. It is easier to place a patient into a front entry conventional wheelchair or place a patient on a bed or toilet from a rear entry transfer-lift device. Wheeled transfer-lifts have rear wheel support arms that can be widened to improve stability when the lift is elevated.

There are numerous patient lift devices that have adequate lifting capability for certain situations; however those with lifting range sufficient to lift a patient from lying on the floor to standing height are not both compact and mobile. There are ceiling mounted lifts with great lifting range but these are confined to a ceiling track or large frame structure. There are boom arm lifts with fairly high lifting range but to increase lifting range these lifts have long boom arms and long support structures to achieve the greater lift range. There are jack-screw driven and hydraulic driven vertically guided lifts that have high lift ranges but these lifts have very tall guide support structures that increase their height and reduce their mobility.

Wheeled lifts are often used to aide in transferring to a conventional wheelchair and therefore have support structures that straddle the wheelchair during this transfer operation. Moving to and from the wheelchair, such wheeled lifts must often pass through common width doorways so the width of the support structure must have a means to be reduced. Therefore, most wheeled lifts have provisions to move some portion of the support structure from wide to narrow width as needed. Many wheeled lifts have outwardly pivoting wheel support arms that can be swung outward to widen the structure for transfers to and from a wheelchair. The required wide angle of the wheel support arms results in a width between the ends of the pair of extended arms that is much wider than the wheelchair. A few lift types have sidewardly sliding sections that provides a wider opening for straddling a wheelchair.

Commonly, wheeled lifts have a single central column at one end from which the boom arm extends or the lifting section telescopes. This structure simplifies the lift mechanism but the structure resulting from this central location interferes with the patient's knees and also makes it difficult to locate the lifting point of the lift close enough to a patient that is lying on the floor.

U.S. Pat. No. 6,430,761 describes a Compact Portable Patient Lift that is intended to be portable but it has inadequate lifting range to lift a patient from lying on the floor to standing, it has an interfering central lifting support column and does not provide the capability for self-lifting or patient driving. U.S. Pat. No. 4,719,655 describes a patient lift with two telescoping vertical guide columns but also has an interfering central lift mechanism and no means to adjust the width of the wheel support arms. U.S. Pat. No. 6,161,232 describes an Invalid Lifting Device having two vertical lifting columns, each having front and rear wheels wherein the columns can be adjusted to the desired width from the other. However, this device has very tall columns to achieve the high lift range and has no provision for patient operation of the lift. U.S. Pat. No. 5,466,111 describes a method wherein the seat lift of a wheelchair is used to raise a wheelchair and patient occupant into a vehicle by attaching the upper portion of the wheelchair to the vehicle door and then swinging the door shut to move the wheelchair and occupant into the vehicle. However, this method requires a vertically hinged door to carry the raised wheelchair and most vehicle floors are too high for the illustrated seat lift to achieve an adequate height to clear the vehicle floor to allow entry and this method will not work when the vehicle door has a horizontal hinge axis like a van rear door.

U.S. Pat. No. 6,092,247 for a Powered Patient Lift Vehicle, describes an earlier attempt by the present inventor to provide a patient operated lift that could also be driven as a wheelchair. However, this device achieves some of the capabilities of the present invention, but it has the long boom arm affect, the outwardly swinging wheel arm supports, and is too large for easy portability in a vehicle. It also does not assist in raising the device itself to higher levels. U.S. Pat. No. 5,255,934 is another earlier attempt by the present inventor to provide a power driven wheelchair with a lifting capability. However, this is a front entry wheelchair with the lift motor, battery and cross shaft below the patient which eliminates the ability to move over a patient lying on the floor. There is no provision to move the rear wheel support arms outward to improve stability when elevated. Also, this device has only a single jack screw in each lift column and the lift column height increases directly proportional to the lift stroke which makes the higher lift version too tall when retracted. There is no provision or lift range for using the lift mechanism for self lifting the entire unit from one level to a higher level.

There is a need for a patient-operated rear entry lifting, rotation, transfer and transporting device that can also serve as a wheelchair that is compact enough to fit inside a vehicle and easily transported for use at another location.

The ideal wheelchair lift-transfer device of the invention provides capabilities for a patient to independently control the wheelchair and lift functions to elevate and move about safely so that he or she can communicate eye to eye with others and retrieve items that are normally too high to reach. Such independence would be demonstrated by the patient when they grasp a handheld wireless remote control and summon their wheelchair lift-transfer device from across the room, to their bedside, then independently transfer into the device and then drive it about in their home, raising and lowering their body as needed. Later they can drive to their bed, lower their self onto the bed, release from the lift and then with the handheld wireless remote control, drive the wheelchair lift-transfer device clear of their sleeping area. For certain performance requirements, the patient may need to transfer to their conventional power drive wheelchair. The independent patient can drive the wheelchair lift-transfer device over to their conventional wheelchair, adjust the rear wheel support arm width as needed, reverse the direction of the wheelchair lift-transfer device and lower themselves onto their conventional wheelchair and then complete the transfer by driving the wheelchair lift-transfer device away from the user, now in the conventional wheelchair, into a parking position by use of the handheld wireless remote control.

When a caregiver is present and can assist in the operation, this ideal wheelchair lift-transfer device of the invention will provide even more capabilities such as by raising the patient off of the floor and placing them in a seated position on a chair or bed or, standing them up on the floor. In this case, the wheelchair lift-transfer device of the invention will also be configured to utilize the integral lifting capability to not only lift the patient but also to lift a conventional wheelchair or other equipment into a vehicle and subsequently lift the wheelchair lift-transfer device its self into a vehicle or lift it from a lower level floor, upward, for use on a higher level floor or platform. The inventive wheelchair lift-transfer device includes integral sensors and control logic that will minimize unsafe use.

In a second aspect of the invention, frequently patients must be transferred from their conventional wheelchair, transported through narrow isle ways and then transferred to a stationary seat, such as an aircraft passenger seat. When a patient's conventional wheelchair will be transported as aircraft baggage a patient may be transferred to a conventional push chair at the gate and then transferred again to an "Isle Chair" just inside the aircraft cabin. An isle chair is narrow and a supported patient is moved down the aisle to their seat location where they must be lifted from the aisle chair into a passenger seat. This procedure can cause injury to both a patient and attendants.

U.S. Pat. Nos. 4,639,012, 4,639,012 and 6,929,275 are examples of Aisle Chairs. They are basically narrow chairs that fit the narrow aircraft aisle ways with no features provided for elevating the patient to aide in transfer from a conventional wheelchair or to an aircraft seat. U.S. Patent Application Publication US 2010/0251481 discloses a lifting device apparently intended to accomplish many of the same objectives of this invention; however the device, having an overhead lifting frame, is too large and too tall for practical use and storage within the aircraft. U.S. Patent Application Publication US 2009/0144895 discloses a lifting device having overhead patient lifting and rotation features that is also too large and too tall for practical use within an aircraft.

There is a need for an improved wheeled patient lift-transfer device that will lift a patient from a conventional wheelchair, transport him or her through narrow passage ways, rotate him or her to face in a desired direction and lower him or her on to a stationary seat that may be confined on all sides by other seats or structures. The lift-transfer device can be propelled by the attendants or could be provided with electric motor drives for both transport and lifting energy.

Therefore, the objects of the present invention are to provide:

1. A compact patient lift-transfer device with increased lifting range, including lifting a patient from lying on the floor to standing position yet have a retracted column height that will pass under a normal height table top.

2. A compact wheelchair lift-transfer device that improves transfer to and from conventional wheelchairs by providing a pair of independently adjustable rear wheel support arms that remain substantially parallel when they are adjusted, including a range of adjustment that allows a narrow position for passage of the pair of support arms under and between the wheels of a conventional wheelchair and a wide position that allows space for a chair to sit between the wheel support arms and/or provide improved stability for driving the wheelchair lift-transfer device with the lift elevated.

3. A compact rear entry wheelchair lift-transfer device that improves transfer to and from a bed including a semi-rigid seat plate that can be easily placed under a patient who is on a bed and be quickly attached to the lift.

4. A compact patient controlled power drive wheelchair lift-transfer device that can serve as a rear entry lift transfer that can carry the patient around the house, place them on a toilet, sit them close up to a table or lift them up to reach high objects such as in a kitchen cupboard.

5. A compact patient wheelchair lift-transfer device that provides patient independence by providing a battery powered wheelchair lift-transfer device that can be remotely controlled by the patient to bring the device to the patient who is in a bed or in a conventional wheelchair and then allow the patient to control the lift to cause it to lift the patient from the bed or wheelchair and then drive the lift transfer device to another location with patient carried along and under control of the patient.

6. A compact patient wheelchair lift-transfer device that is easily transportable and self lifting for transfer into a vehicle that can be used to lift and transfer a patient from a conventional wheelchair into a vehicle seat, then be used to lift the conventional wheelchair into the vehicle and finally provide a self lifting means to lift the wheelchair lift-transfer device into the vehicle to be taken along to lift all the above out of the vehicle again, later.

7. An optional compact patient wheelchair lift-transfer device having a U-shaped patient lifting frame that includes rotation, lifting and driving means.

8. A compact lift-transfer device that improves transfer to and from conventional wheelchairs by providing a U-shaped rotatable lift frame that positions and supports the patient substantially within the U-shaped frame thereby keeping the patient's center of gravity within the U-shape (as viewed from above), the patients backside facing outward through the open side of the U-shape and the height of the lift structure reduced.

9. A U-shaped lifting frame that forms a rotation track that is supported on a series of rollers or bearing surfaces that allows the U-shaped frame to be rotated as the track moves through the series of supporting rollers, thereby rotating the lifting frame and patient about a vertical axis.

10. An optional compact lift-transfer device having a wheeled base with at least 3 supporting wheel locations whereby the frame of the base can be adjusted so at least one wheel is moved to a position closer to the other wheels so that the base width becomes substantially narrowed to allow the lift-transfer device to pass through a narrow passage way.

11. An optional compact patient lift-transfer device wherein the patient U-shaped lifting frame may be moved to position the patient over the wheeled base into the most favorable position for stability of the patient and transfer device when considering the width of the wheeled base.

12. An optional compact patent lift-transfer device having at least one offset substantially vertical lifting column, the upper end of which a U-Shaped lifting frame is cantileveringly attached so that the U-shape of the lifting frame is oriented substantially horizontal and located generally above the wheeled base.

13. An optional compact patient lift-transfer device wherein the wheeled base has at least one wheel support arm that is pivotally mounted to allow base width adjustment.

14. An optional compact lift-transfer device wherein the patient can be rotated 90 degrees about a vertical axis when the base wheel locations have been adjusted to provide increased stability.

15. An optional compact lift-transfer device that can be assembled to serve as either a Right Hand or Left Hand device, that being a Right Hand Device when the patient is transferred into a seat on the right side of an isle way as the patient faces forward or Left hand device when the patient is placed on the left side of the isle way when facing forward.

Other objects and purposes of the invention, and variations thereof, will be apparent upon reading the following specification and inspecting the accompanying drawings.

BRIEF DESCRIPTION OF THE DRAWINGS

FIG. 8 is a perspective view of the assembled internal double telescoping jack-screw assembly.

FIG. 9 is a perspective end view of the spline tube.

FIG. 10 is a perspective view of the hexagon-bore spline tube driver.

FIG. 11 is a fragmentary perspective view of the spline engaging upper end portion of the outer jack screw.

FIG. 12 is a fragmentary perspective view of the lower portions of the telescoping outer and inner jack screw assembly.

FIG. 19 is a fragmentary cut-away perspective view of the powered lift lever and power link disengaged from the lift gearmotor for hand crank operation.

FIG. 20 is a fragmentary cut-away perspective view of the powered lift lever and power link engaged with the lift gearmotor for power lift operation.

FIG. 23 is a similar cut-away view of the RH column gear block.

FIG. 24 is a similar view with the RH gear block removed to reveal the RH configuration of the bevel gears and supporting radial bearings.

FIG. 28 is a fragmentary upwardly facing perspective view showing the LH pivot arm linkage with position sensing switch not contacted, indicating that a rear wheel arm is not in the full-wide width position.

FIG. 29 is an expanded view of above showing the rear wheel support arm linkage with the rear wheel support arm retracted to a narrow width position.

FIG. 30 is a similar view of above showing the rear wheel support arm linkage with the rear wheel support arm extended to the full-wide width position and the position indicating switch is contacted.

FIG. 34 is a perspective view representing a patient lying on the floor; the lift seat board has been placed under the patient.

FIG. 35 is a perspective view showing the wheelchair lift-transfer device maneuvered to straddle the patient; the lift belts have been extended and connected to the seat board.

FIG. 36 is a perspective view showing the wheelchair lift-transfer device and patient; the patient has been moved to a sitting position and held by back support belt.

FIG. 41 is a perspective view showing the wheelchair lift-transfer device and the patient maneuvered to transfer the patient into a conventional wheelchair.

FIG. 42 is a perspective view showing the wheelchair lift-transfer device and the patient engaged in transfer with a conventional wheelchair.

FIG. 43 is a perspective view showing the patient after transfer into a conventional wheelchair and the wheelchair lift-transfer device removed.

FIG. 46 is a perspective view showing the wheelchair lift-transfer device and patient engaged in transfer with a conventional bed.

FIG. 47 is a perspective view showing the wheelchair lift-transfer device configured as a rear entry power drive wheelchair that is being wirelessly remotely controlled by the patient from a conventional bed.

FIG. 57 is a perspective view of another embodiment of the patient lift-transfer device configured for placement of a patient facing forward on the Right Hand side of an aircraft isle way and the U-shaped frame opened rearward.

FIG. 58 is a plan view of the same embodiment with the u-shaped frame rotated 90-degrees and the wheeled base extended to maximum width.

FIG. 59 is a plan view of the same embodiment with the wheel support arms pivoted to produce a narrow width wheeled base and with the U-shaped support frame located to be more nearly centered over the narrowed base.

FIG. 60 is a perspective view of the same embodiment of the patient lift-transfer device as viewed from the lift column end.

FIG. 61 is a fragmentary cut-away perspective view of the U-shaped lifting frame as it serves as a curved track passing through the series of supporting rollers.

FIG. 62 is a perspective view of one of the U-frame support roller assemblies.

FIG. 63 is a hidden-line view of one of the U-frame support roller assemblies.

FIG. 64 is a fragmentary perspective view of the lifting column

FIG. 65 is a fragmentary perspective hidden-line view of the lifting column showing the positions of upper and lower support rollers within.

FIG. 66 is a fragmentary perspective view of the upper end of the stationary outer column and support rollers located therein.

FIG. 67 is a fragmentary perspective view of the lower end of the inner lifting column and support rollers located therein.

FIG. 68 is a similar fragmentary perspective hidden-line view of the lower end of the inner lifting column and support rollers located therein.

FIG. 81 is a fragmentary perspective view of the lower end of the lifting column assembly poised for insertion into the open socket of the wheeled base assembly.

FIG. 82 is a fragmentary perspective hidden-line view of the open socket area of the wheeled base assembly.

FIG. 84 is a perspective view of the underside of the lift transfer device with the wheel support arms extended to provide maximum base width.

FIG. 85 is a perspective view of the underside of the lift transfer device with the wheel support arms retracted to provide minimum base width.

FIG. 93 is the first of a series of (4) top views of the lift transfer device, this view showing the U-shaped lifting frame rotated to open to the rear of the lift-transfer device while centered over the base with the wheel arms extended.

FIG. 94 is a similar view showing the U-shaped lifting frame rotated to open to the rear of the lift-transfer device while shifted to the offset location over the base with the wheel arms extended.

FIG. 95 is a similar view showing the U-shaped lifting frame rotated 90-degrees to open to the side of the lift-transfer device while shifted to the offset location over the base with the wheel arms extended.

FIG. 96 is a top view showing the U-shaped lifting frame rotated to open to the rear of the lift-transfer device while shifted to the offset location to be centered over the base with the wheel arms retracted.

FIGS. 99-103 are a series of views showing the lift transfer device application and a patient.

FIG. 99 is a frontal view of the lift transfer device and a patient in position to remove the patient from a conventional wheelchair.

FIG. 100 is a perspective view of the lift transfer device and a patient in position to remove the patient from a conventional wheelchair.

FIG. 101 is a side view of the lift transfer device and a patient in position to remove the patient from a conventional wheelchair.

FIG. 102 is a frontal perspective view of the lift transfer device and a patient in position centered over the base set for narrow width.

FIG. 103 is a side view of the lift transfer device and a patient in position centered over the base set for narrow width.

Certain terminology will be used in the following description for the convenience in reference only, and will not be limited. For example, the word "front" will refer to the side of the wheelchair lift-transfer device that faces the pair of double telescoping lifting columns that is opposite the side from which the cantilevered horizontal seat support arms extend; this being the side facing the lower right of FIG. 1.

With respect to the wheelchair lift-transfer device, the abbreviation "RH" which means "right hand" and "LH" which means "left hand" as related to the patients right hand or left hand as he or she is supported in the wheelchair lift-transfer device while seated and facing in the same direction as the wheelchair lift-transfer device "front" faces. The words "inwardly" and "outwardly" will refer to directions toward and away from, respectively the geometric center of the wheelchair lift-transfer device and designated parts thereof. Said terminology will include the words specifically mentioned, derivatives thereof, and words of similar import.

DETAILED DESCRIPTION

Figure 1:
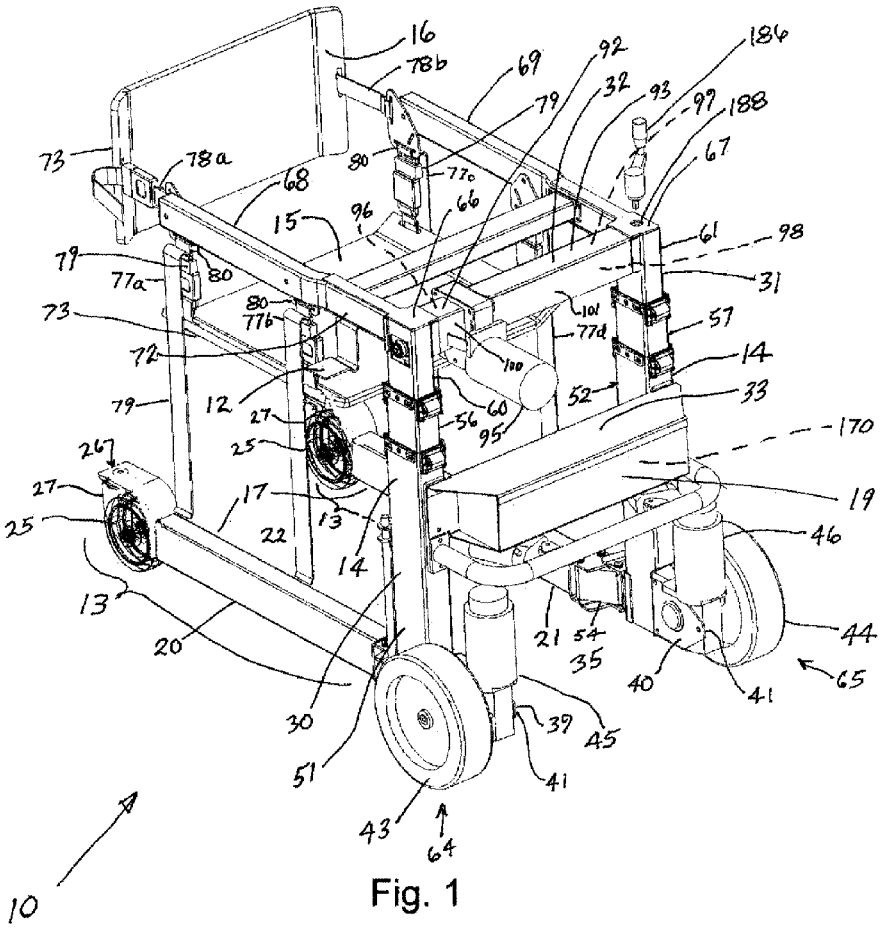
FIG. 1 is a perspective view of one embodiment of the patient wheelchair lift-transfer device configured as a rear entry power drive wheelchair.
Figure 2:
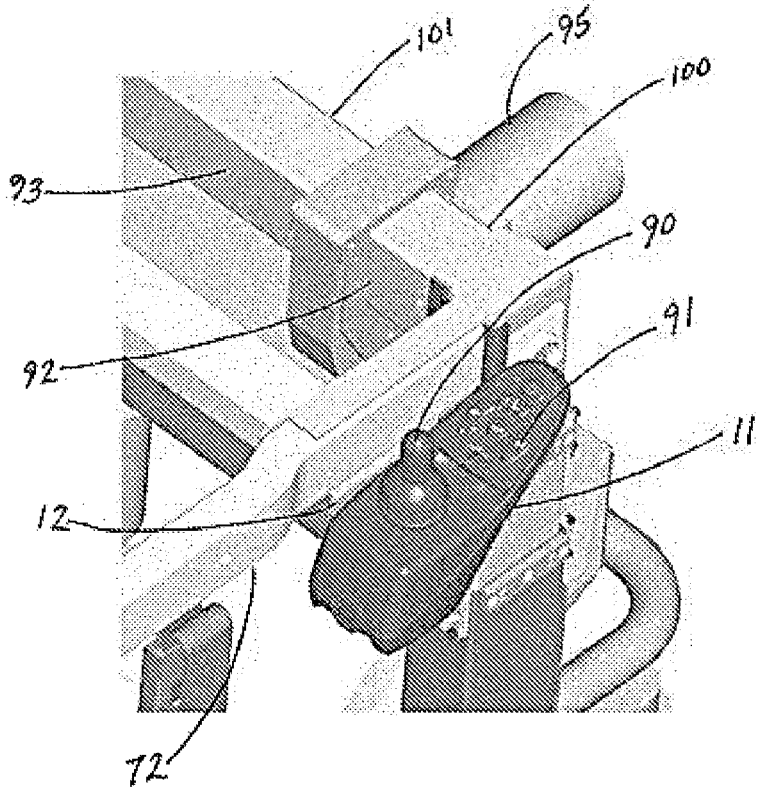
FIG. 2 is a fragmentary perspective view of the power drive wheelchair embodiment showing a mounted Joy-Stick Control module.
Figure 3:
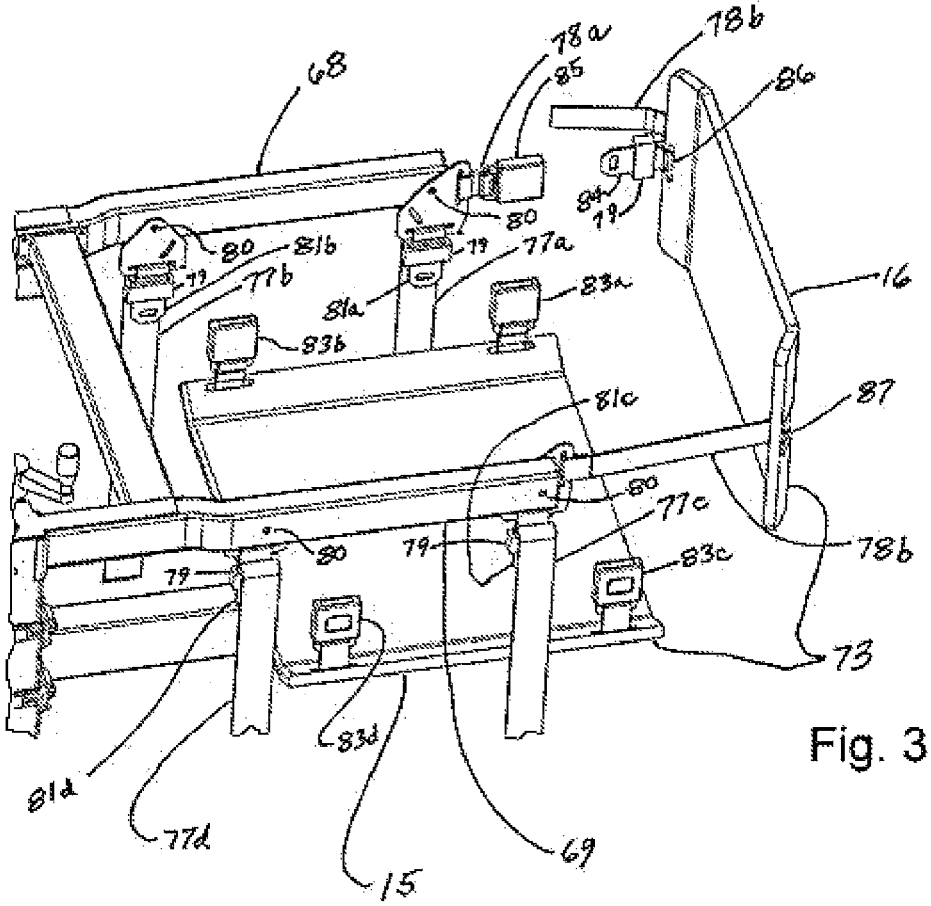
FIG. 3 is a fragmentary perspective view of the seat assembly (detached from the Transporter and moved lower and rearward).
Figure 4:
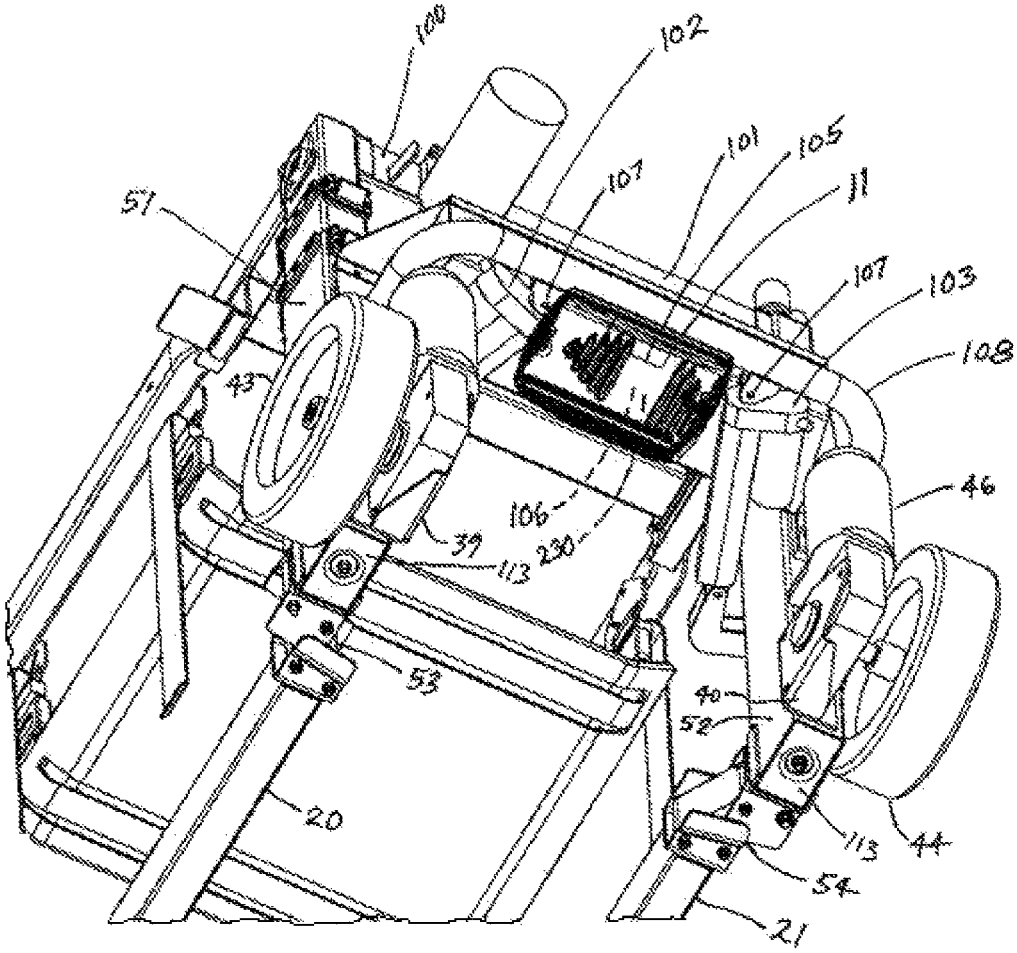
FIG. 4 is a fragmentary perspective bottom view of the front portion of the power drive wheelchair embodiment.
Figure 5:
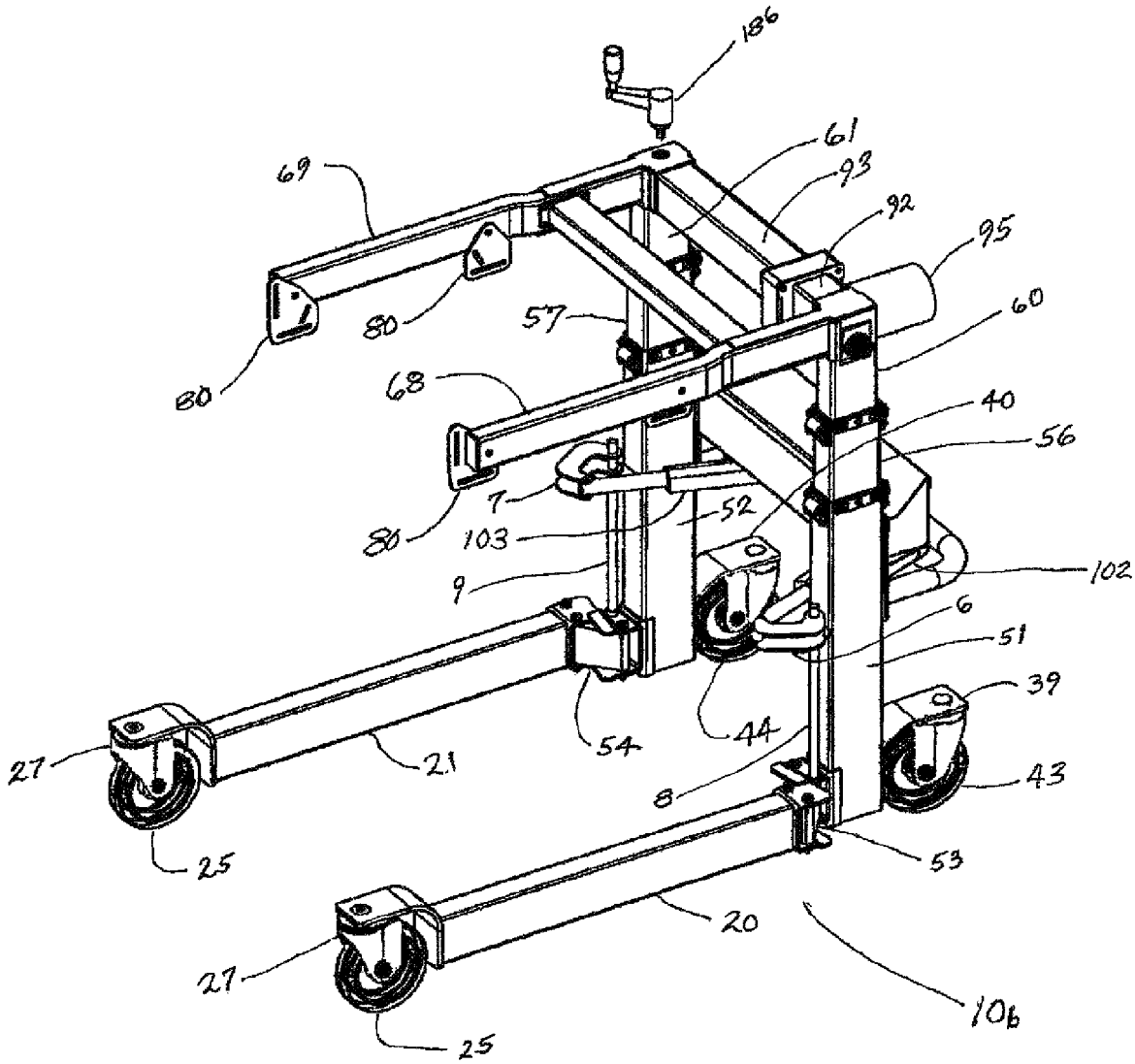
FIG. 5 is a perspective view of one embodiment of the patient wheelchair lift-transfer device configured as a rear entry wheelchair frame structure without seat, backrest, support straps, or power driving components.

Referring to FIGS. 1-4, there is illustrated one embodiment of the wheelchair lift-transfer device 10 (herein-after referred to as the "transporter" for convenience) configured as a rear entry power drive wheelchair. The joystick drive, lift and actuator control module 11 in FIG. 2 is mounted to bracket 12 in FIG. 1.

Figure 38:
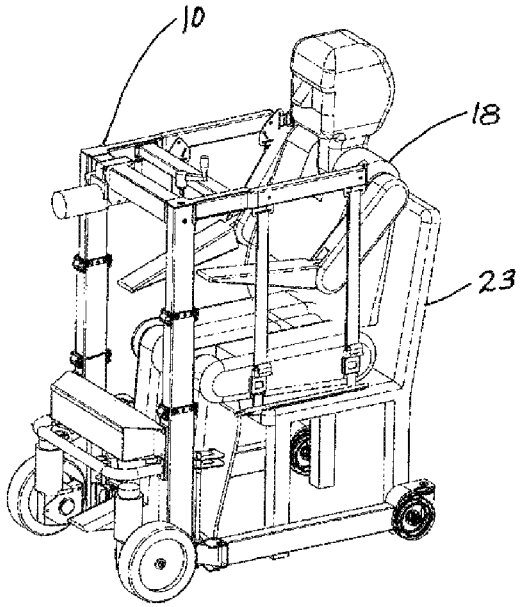
FIG. 38 is a perspective view showing the lifted patient lowered on to a support chair.
Figure 39:
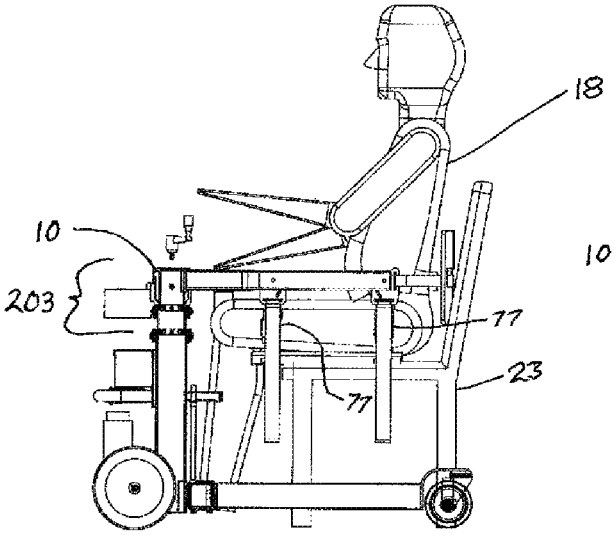
FIG. 39 is a perspective view showing the wheelchair lift-transfer device lift columns in a retracted position with the patient support belts adjusted to a shortened length.

The transporter 10 includes a wheeled base assembly 13 having an upright assembly 14 projecting therefrom. The upright assembly 14 in turn mounts thereon a removable seat 15 and back support 16, the latter being used for receiving an occupant/patient 18 (FIG. 34) for transporting by the transporter 10 and transfer to and from the transporter 10. The wheeled base assembly 13 includes a generally rigid and rearwardly-opening U-shaped horizontally extending wheeled base 17 is defined by the upright assembly 14 at the front 19 and a pair of generally parallel and rearwardly extending rear wheel support arms 20 and 21. These rear wheel support arms are sidewardly spaced apart and define a rearwardly opening space 22 that is optionally adjustable in width therebetween to permit the base 13 to provide an opening that is wide enough to straddle a chair 23 (FIG. 38) or a patient 18 lying on the floor (FIG. 34) and optionally defines an overall width that is narrow enough to pass through a doorway 271 (FIG. 54) or fit between opposite side-wheels of some conventional wheelchairs 24 (FIG. 42). Each rear wheel support arm 20 and 21 has a wheel 25 or roller mounted adjacent the rear free end 26 thereof. In the embodiment of FIG. 1, these rear wheels are conventional caster wheels 27.

Figure 31:
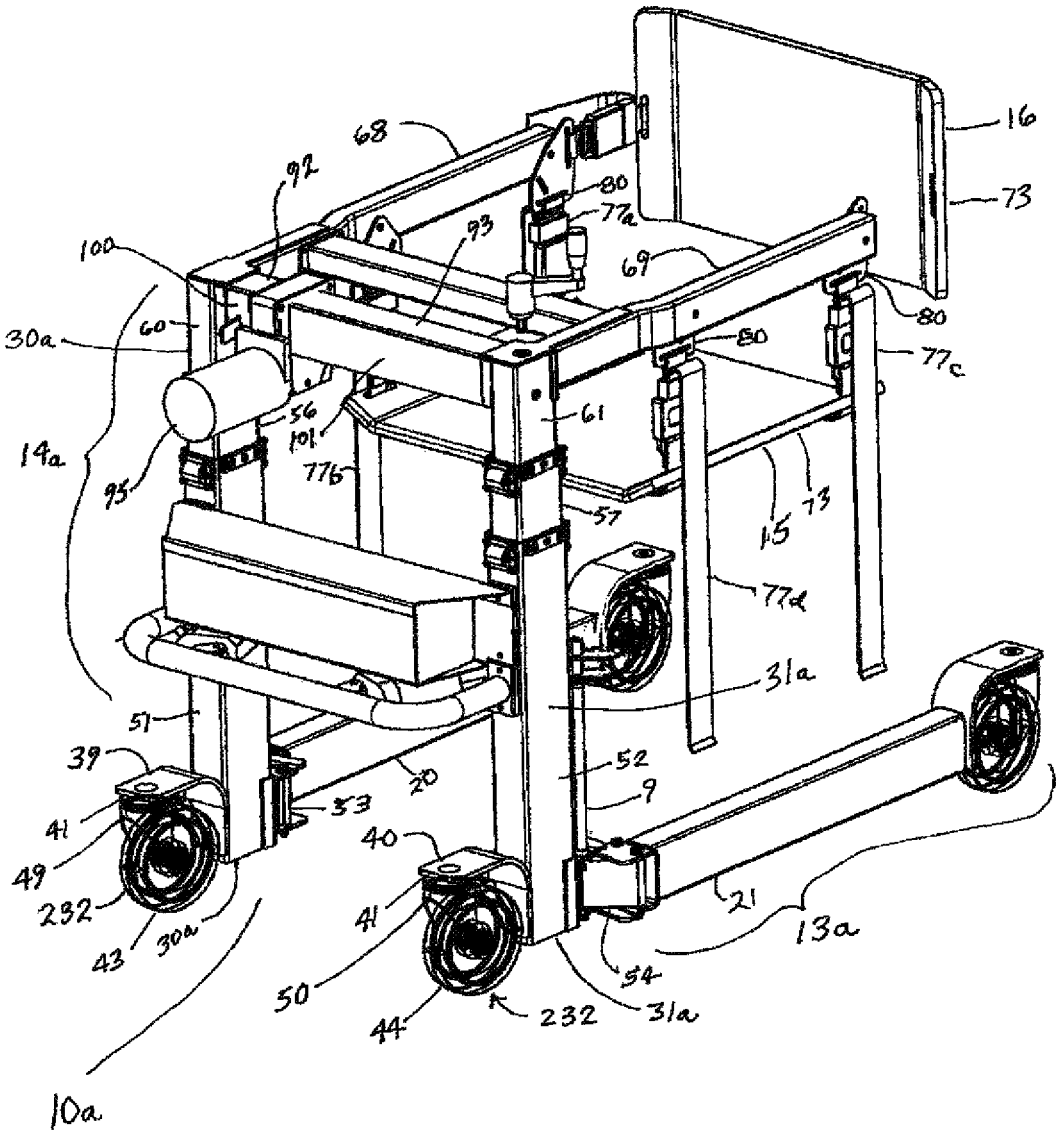
FIG. 31 is a perspective view of another embodiment of the patient wheelchair lift-transfer device configured as caregiver propelled on front and rear caster wheels.

The upright assembly 14 includes a pair of columns 30 and 31 connected to and spaced apart by cross beam structures 32 and 33 which extend horizontally transversely across the transporter 10 adjacent the front side thereof with the lower cross beam structure 33 being elevated enough to allow space 35 underneath for passage of the legs 37 of a patient 18 that is lying on the floor (FIG. 35). The upright assembly 14 also has a pair of front side support arms 39 and 40 or brackets which project forwardly a small extent in cantilevered relation to the pair of columns 30 and 31. These arms 39 and 40, adjacent the free ends thereof 41 mount thereon front support rollers 43 and 44. In the embodiment of FIG. 1, these rollers are wheels driven by electric drive-motors 45 and 46. In the embodiment of FIG. 31 the front support rollers are caster wheels 49 and 50.

The upright assembly 14 includes a pair of vertically elongate and telescopic support post assemblies 30 and 31, each including a vertically elongate lower post 51 and 52 to which a respective one of the rear wheel support arms 20 and 21 is attached via a respective four-bar horizontally pivoting linkage 53 and 54 (FIG. 4), the combination forming the U-shaped wheeled base 13 from which the upright assemblies 30 and 31 project upwardly in cantilevered relationship therewith. In this regard, the lower posts 51 and 52 are joined together in sidewardly or laterally spaced relation by the lower cross beam structure 33. Vertically elongate middle posts 56 and 57 are slidably telescopingly positioned within and project upwardly out of the lower posts 51 and 52. Vertically elongate upper posts 60 and 61 are slidably telescopingly positioned within and project upwardly out of the middle posts 56 and 57. A double-jackscrew drive 63 or lifting unit is disposed interiorly of each post assembly 30 and 31 (described later in reference to FIGS. 6-14) to selectively extend and retract the lower posts 51/52, middle posts 56/57 and upper posts 60/61.

The support post assemblies 30 and 31 are disposed adjacent opposite sides of the transporter 10 adjacent the front corners 64 and 65 thereof, and at the upper ends 66 and 67 thereof are respectively joined to horizontally elongate seat support arms 68 and 69. The pair of seat support arms 68 and 69 then project rearwardly in cantilevered relationship away from the support post assemblies 30 and 31 in generally parallel relationship adjacent opposite sides of the transporter. One of the seat support arms 68 has the joystick module mounting bracket 12 attached thereto for ready access by the patient's arm. The seat support arms 68 and 69 more particularly are supported on the upper posts 60/61 so as to move vertically therewith, and rigidly joined together in sidewardly spaced relation by the upper cross beam structure 32 and a secondary beam structure.

Considering now the seat support assembly 73 (FIG. 3), the same includes a seat portion 15 and a backrest portion 16, both of which are preferably connected to the seat support arms 68 and 69 by elongate flexible straps 77*a*, 77*b*, 77*c*, 77*d*, 78*a* and 78*b*. Two of the set of four straps supporting the seat are pivotally attached to each respective support arm at the strap upper end 80 thereof and have the length-adjuster portion 79 of a conventional vehicle-type seat belt buckle or clasps 81*a*, 81*b*, 81*c* and 81*d* attached at the strap lower end 82 thereof. The seat 15 has the four mating buckle portions 83*a*, 83*b*, 83*c*, and 83*d* of the seat belt buckles attached thereto adjacent the four corners thereof. Each support arm 68 and 69 has a backrest support strap 78*a* and 78*b* attached at the rearward end thereof, with one strap 78*b* having the adjuster portion 79 and buckle 84 attached at the free end thereof and the other strap 78*a* having the mating buckle 85 attached at the free end thereof. The straps 78*a* and 78*b*, when mated, pass through openings 86 and 87 in the backrest 16, adjustably securing the backrest to the support arms 68 and 69.

To power the transporter 10, the lower crossbeam structure 33 of the embodiment of FIG. 1 includes a compartment in which power supply batteries 170 are stored. The joystick driving control module 11 (FIG. 2) includes the operator controlled driving control joystick 90 and switches 91 for the lift up-down control and the rear wheel support arm in-out control.

The upper crossbeam structure 32 is supported at each end by the pair of upper posts 60 and 61 and comprises channel shaped housings 92 and 93 for supporting the lift motor 95, the lift motor release mechanism 96, and encloses the hexagon cross shaft 98 and the height sensing switch assembly 99 by included removable covers 100 and 101 (FIG. 2).

Looking upwardly at the front portion of the transporter 10 in view (FIG. 4), RH 102 and LH 103 linear actuators for moving the rear wheel support arms 20 and 21 and the motor control power module 105 that receives commands from the joystick control module 11, are revealed. The motor control power module 105 provides proportioned power to all of the transporter's 10 several motors as directed by patient 18/operator input to the joystick control module 11 and the power module's internal microprocessor 106. One end 107 of each linear actuator 102 and 103 is pivotally mounted to the U-shaped tube structure 108 that attaches to and spans between the pair of lower posts 51 and 52. Each of the rear wheel support arms 20 and 21 are respectively mounted to a 4-bar linkage module 53 and 54 that causes the rear wheel support arms 20 and 21 to be adjusted sidewardly in generally parallel relationship while maintaining cantilevered support of the upright assemblies 14.

Figure 6:
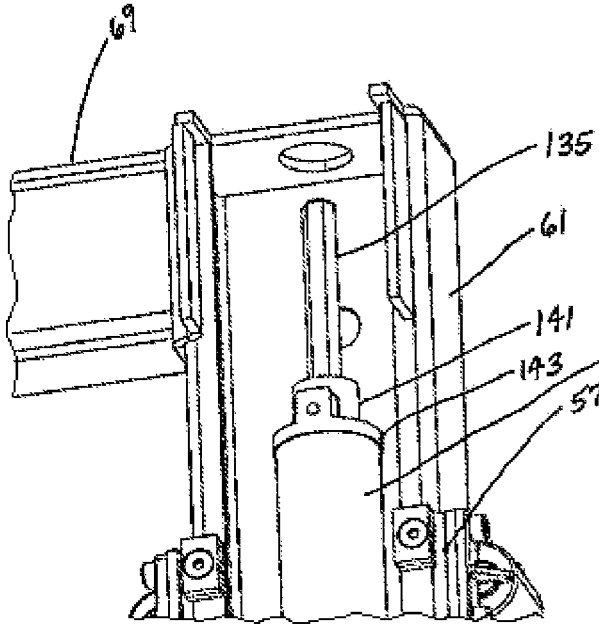
FIG. 6 is a fragmentary cut-away perspective view of the upper portion of the LH lift column with hexagon shaft mounted in the spline tube driver.
Figure 7:
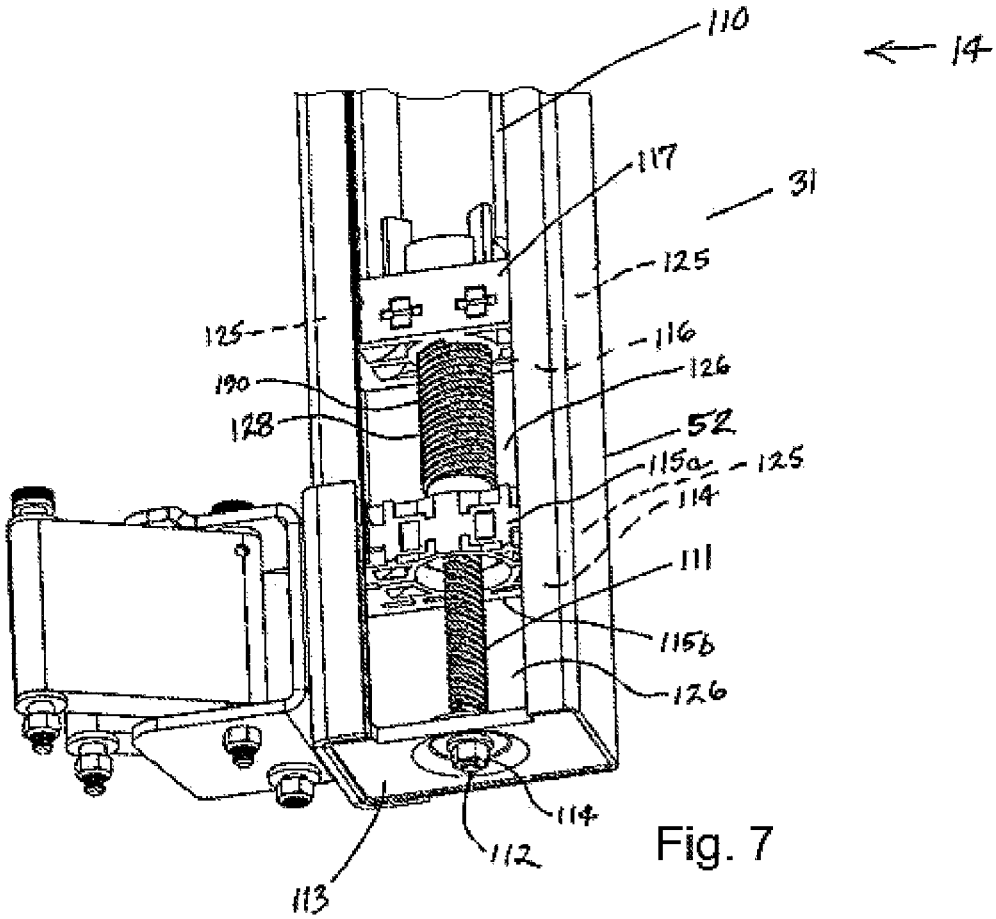
FIG. 7 is a fragmentary cut-away perspective view of the lower portion of the LH lift column showing the inner jack screw secured to the outer column bottom plate.
Figure 13:
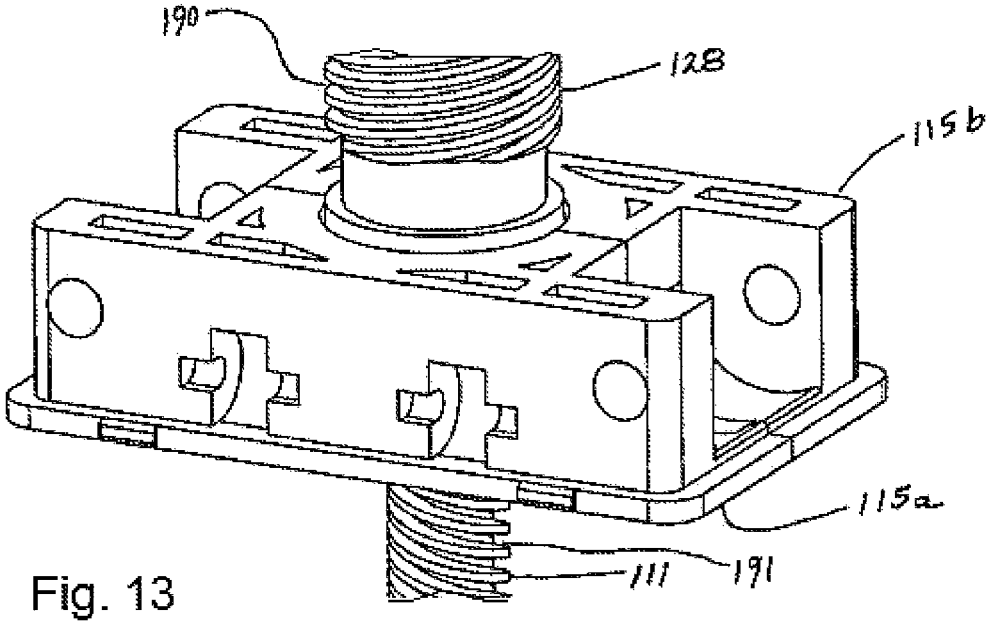
FIG. 13 is a fragmentary perspective view of the middle tube support assembly
Figure 14:
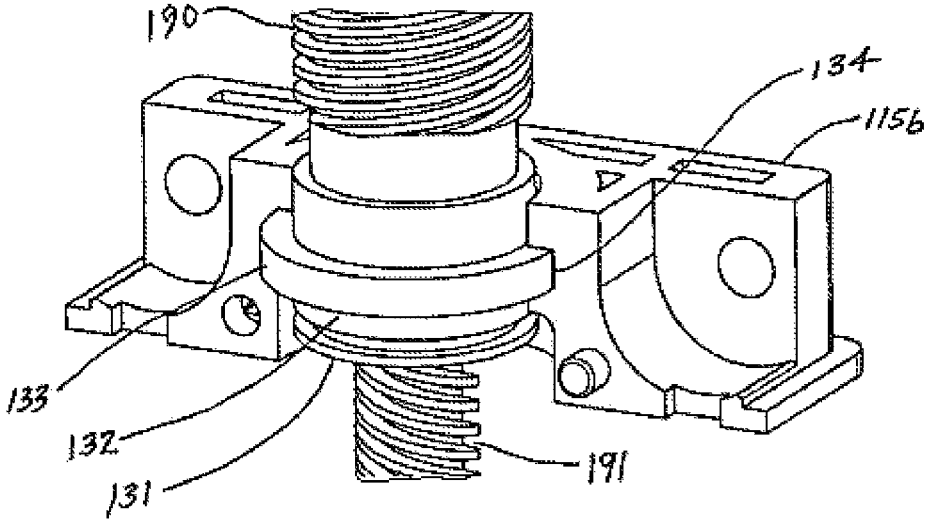
FIG. 14 is a fragmentary perspective view showing one of the middle tube support moldings removed to reveal the inner screw nut mounted to the lower end of the outer screw.

Now referring to FIGS. 5-14, transporter 10*b* (FIG. 5) shows the 4-bar pivoting linkages 53 and 54 are rotated respectively by shaft 8 and arm 6 assembly and shaft 9 and arm 7 assembly. The double telescoping upright assemblies 14 include lower posts 51 and 52, wherein slides the middle posts 56 and 57 and the upper posts 60 and 61 slides within the middle posts 56 and 57 respectively. A double jackscrew assembly 110 (FIG. 8), within each upright 30 and 31, has a small inner screw 111 having a smaller threaded end portion 112 that is non-rotatingly securely attached to the bottom horizontal wall 113 of the lower post 51 and 52 (FIGS. 7 and 12) by a nut 114 threadingly secured to the smaller threaded portion 112 of the inner screw 111, below the bottom wall 113. The middle post 56 and 57 has securely attached thereto at the lower end 114 thereof a pair of middle tube support moldings 115*a* and 115*b* and the upper post 60 and 61 has attached at the lower end 116 thereof an outer screw large nut molding 117. As seen in FIG. 12, the middle tube support moldings 115*a* and 115*b* and the outer screw large nut moldings 117 of the double jack screw assemblies 110 have therein assembled large support roller assemblies 120 and small support roller assemblies 121. The roller assemblies 120 comprise a roller 122, a bearing 123 and an axis pin 124. The large rollers 120 (FIG. 12), roll against the inner surface 125 of narrow sides of the lower 51 and 52 and middle 56 and 57 posts. The small rollers 121, roll against the inner surfaces 126 of the wide sides of the lower 51 and 52 and middle 56,57 posts (FIGS. 6 and 7).

Referring to FIGS. 7 and 9-11, secured to the upper end 127 of each outer large jack screw 128 is a molded spline bushing 129 that rotates with the large outer screw 128. The external spline configuration 130 on the molded spline bushing 129 is larger in diameter then the outer threads 132 of the large outer jack screw 128. Secured to the lower end 131 of each outer jack screw 128 is a jack screw small nut molding 132 that also rotates with the outer jack screw 128. The jack screw small nut molding 132 includes a flange ring 133 that is captured within a mating groove 134 in the pair of middle tube support moldings 115*a* and 115*b* and is fitted so as to allow free rotation therein. Each jack screw assembly 110 includes a spline tube 136 having an internal spline configuration 137 that matingly matches the external spline configuration 130 on molded spline bushing 129 portion of the large outer screw 128 and is fitted so that the outer screw 128 can move up and down within the spline tube 136 while continually transmitting rotational torque between the spline tube 136 and the large outer screw 128 so that they rotate equally. The lower end 139 of the spline tube 136 slidingly rests on the outer screw large nut molding 117 while the upper end 140 of the spline tube 136 has inserted therein a hexagon-bore 159 spline tube driver 141. The spline tube driver 141 includes an external spline configuration 142 that matingly matches the internal spline 137 of the spline tube 136. The spline tube driver 141 includes a flange 202 that supports spline tube driver 141 on the upper end 143 of the spline tube 136. Each spline tube driver 141 has a short vertical hexagon shaft 135 matingly inserted within the hexagon bore thereof.

Figure 15:
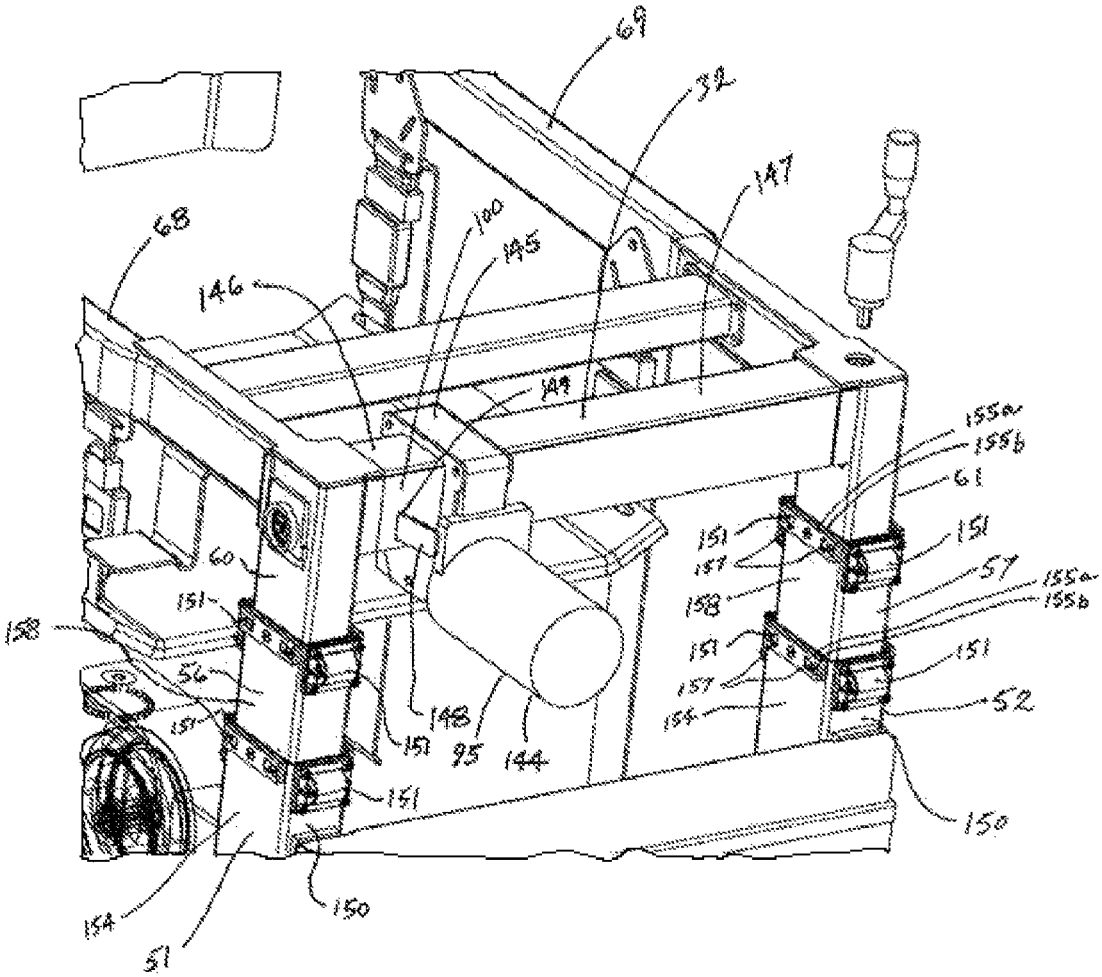
FIG. 15 is a fragmentary front view of the upper portion of the lift columns and lift gearmotor configuration.
Figure 16:
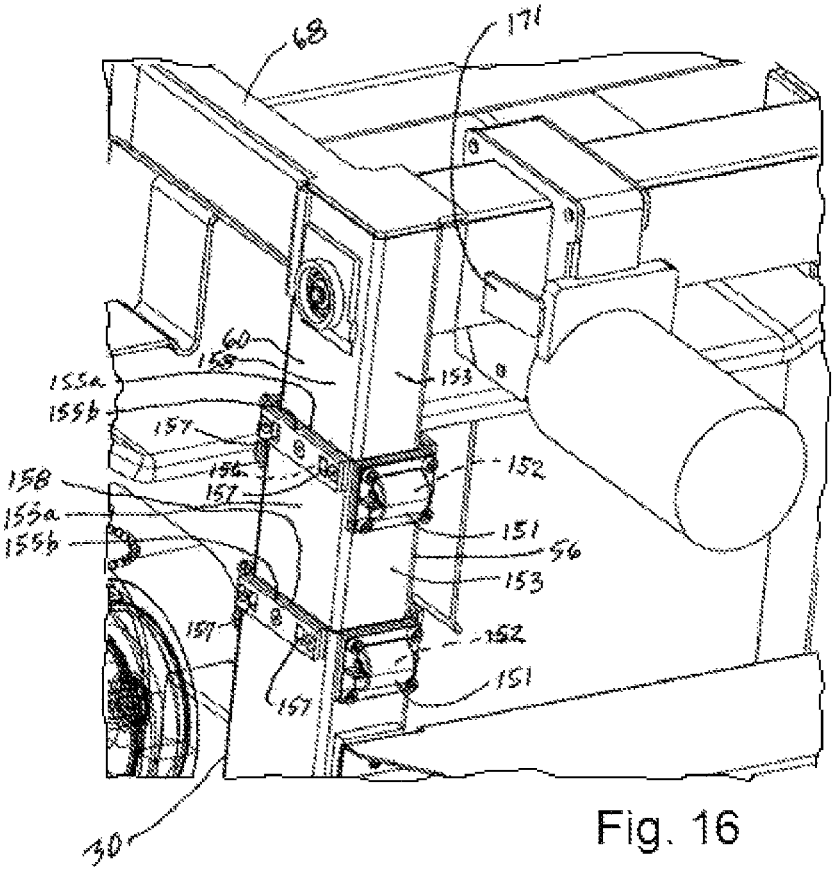
FIG. 16 is a fragmentary view of the upper right front showing the projecting powered lift release lever.
Figure 17:
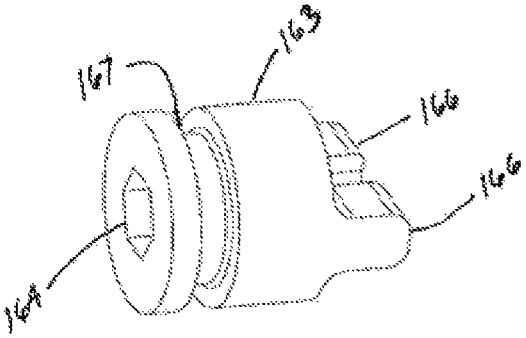
FIG. 17 is a perspective view of the hexagon-bore cross-shaft to gearmotor power link.
Figure 18:
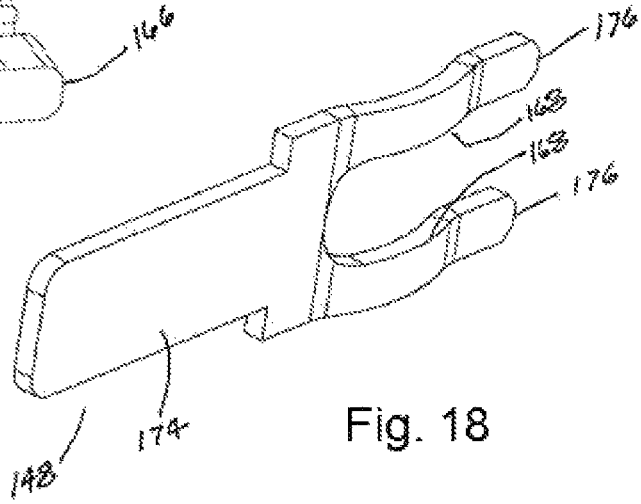
FIG. 18 is a perspective view of the powered lift release lever.
Figure 21:
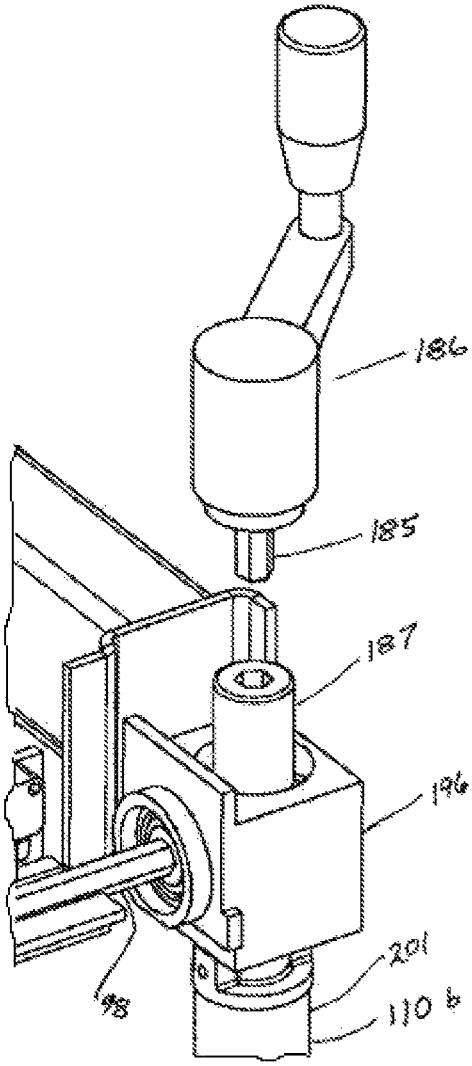
FIG. 21 is a fragmentary cut-away perspective view of the upper LH column gear block with hexagon bore crank handle attachment coupler.
Figure 22:
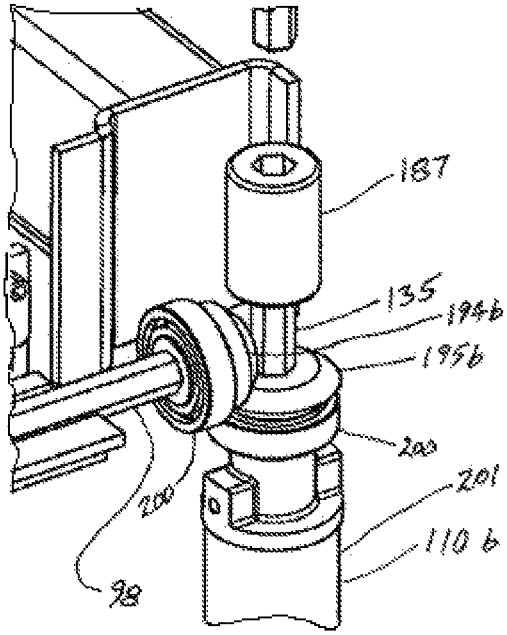
FIG. 22 is a similar view of this area with gear block removed to reveal the LH configuration of the bevel gears and supporting radial bearings.
Figure 25:
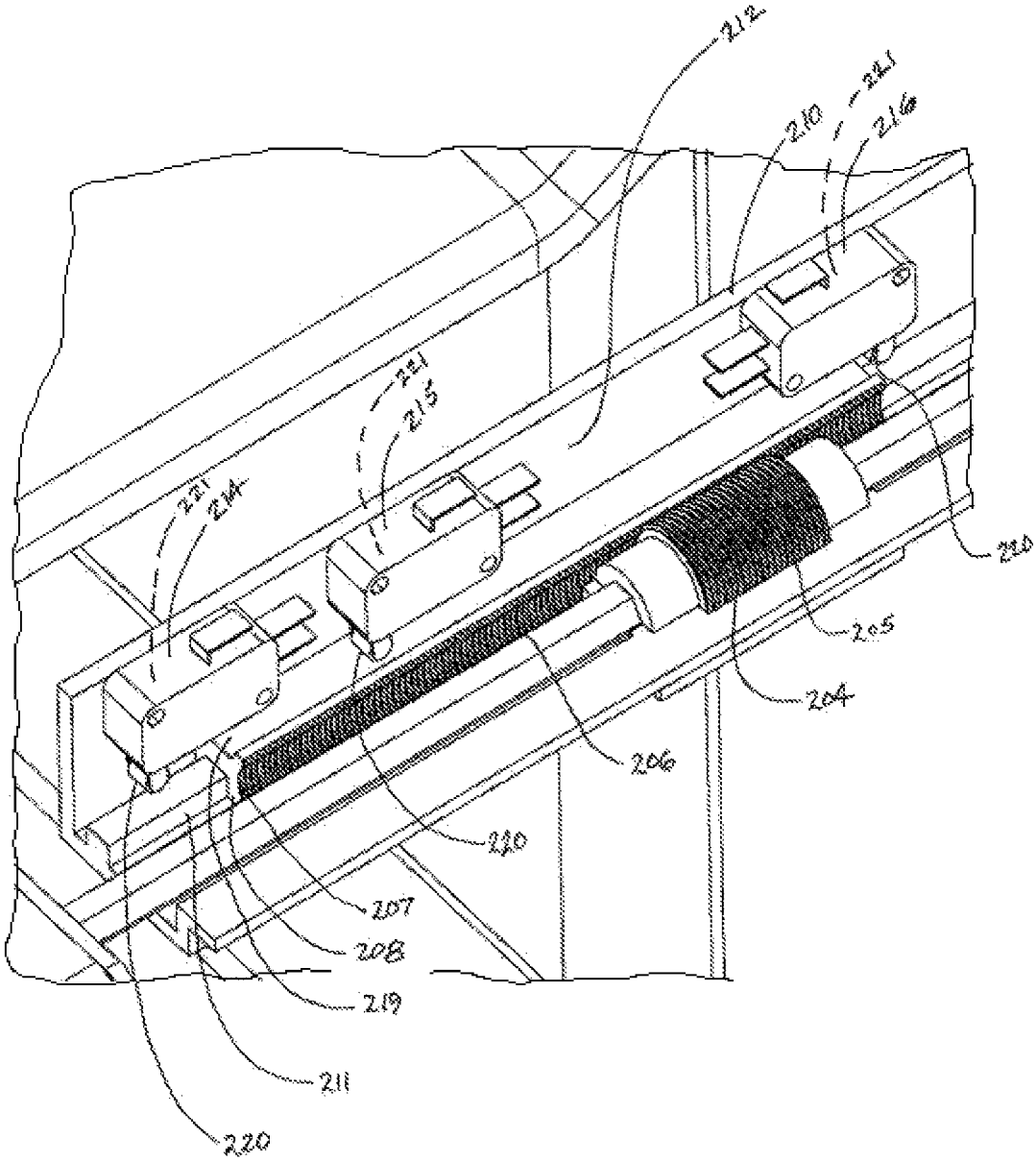
FIG. 25 is a fragmentary cut-away perspective view of the hexagon cross shaft, worm gear, moving gear-rack and mounted switches provided for lift-height position sensing (electric wire connections omitted).
Figure 26:
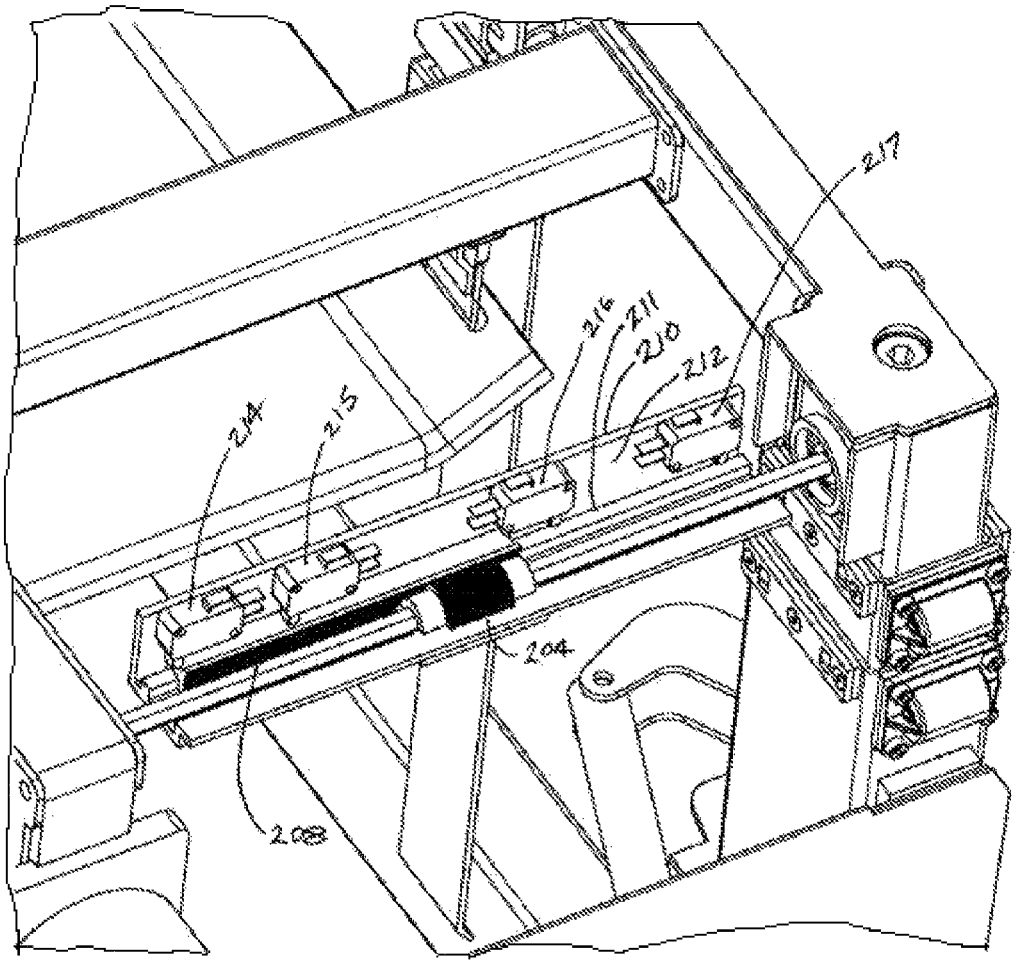
FIG. 26 is an expanded view of above showing the gear-rack indicating the lift is in a fully retracted position.
Figure 27:
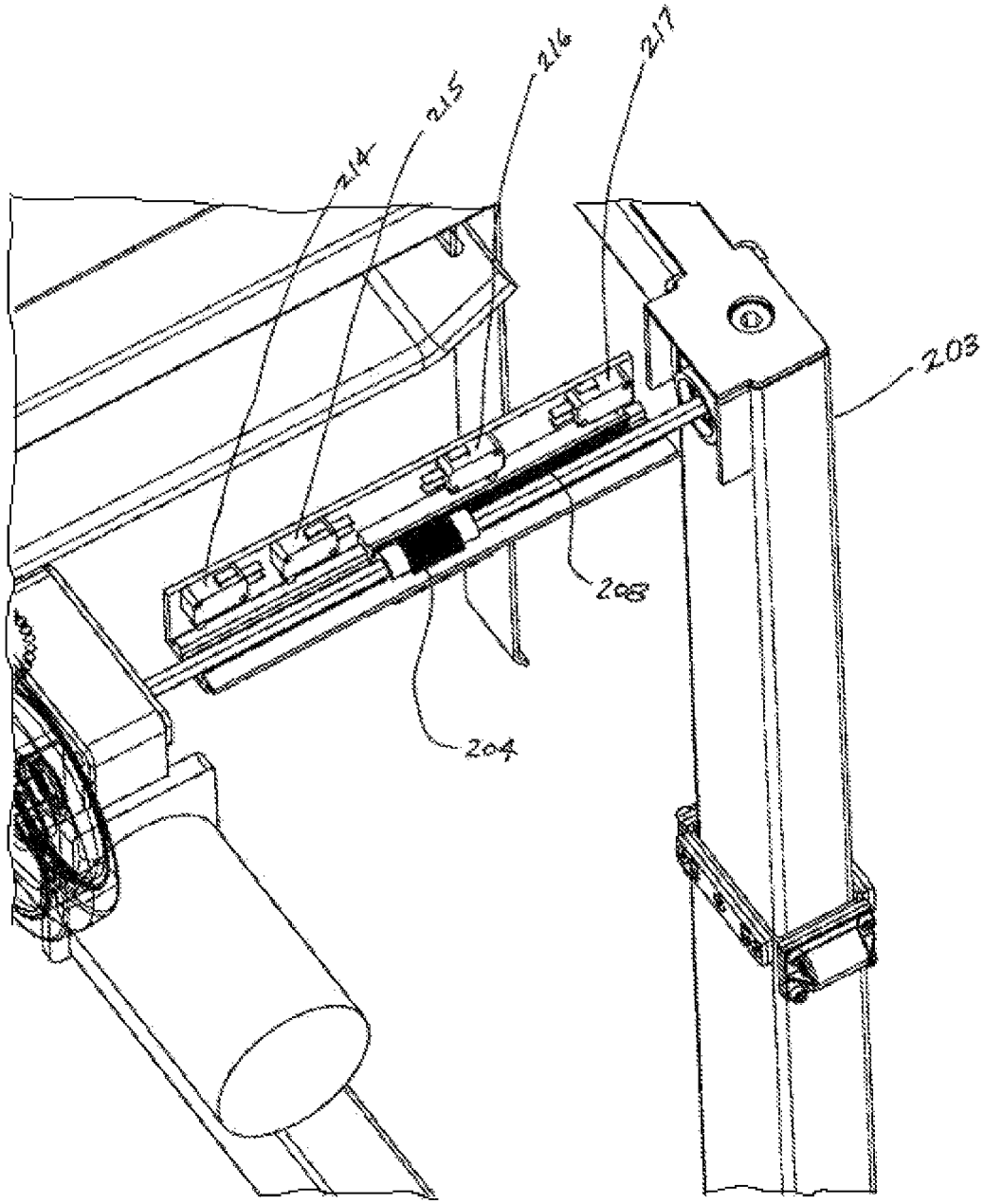
FIG. 27 is a similar expanded view as above showing the gear-rack indicating the lift is in a fully extended position.

Referring to FIGS. 15 and 16, the lift motor 95 is a combined motor 144 and gear reducer 145 that is mounted between sections of the upper crossbeam structure 146 and 147. To the right of the lift motor the exposed (handle) portion powered lift release lever 148 projects forwardly through an opening 149 in the small cover 100 section of the upper cross beam structure 32. The narrow sides 150 of the lower posts 51 and 52 and the middle posts 56 and 57 have adjacent the upper ends thereof, mounted thereon, roller support housings 151 each having mounted within large support rollers 152 for rollingly supporting the forces from the outer surface 153 of the middle 56 and 57 and upper posts 60 and 61 that are a result of the substantial cantilevered loads carried by the pair of seat support arms 68 and 69. The wide sides 154 of the upper ends of the lower 51 and 52 and middle posts 56 and 57 include plates 155*a* and 155*b* that capture the axles 156 of smaller side support rollers 157 that rollingly support and guide the wide sides 158 of the middle 56 and 57 and upper 60 and 61 posts.

Referring to FIGS. 17-20, rotation of the hexagon shaped cross-shaft 98 extends lifting power from the lift motor 95 to turn each of the outer jack screws 128*a* and 128*b* of the double jack screw assemblies 110*a* and 110*b* that are disposed within each of the pair of support columns 30 and 31. The center output shaft 160 of the lift motor gear reducer 145 is hollow which allows the hexagon shaped cross shaft 98 to pass through without interference. The RH side of the lift motor 95 hollow output shaft 160 has an extended portion 161 wherein a portion of the extension 161 is notched away to form a driving cross-slot 162. The power link 163 having a hexagon shaped bore 164 slidingly mounts on the hexagon cross shaft 98 and is fitted so that the power link 163 can move rightwardly 164 and leftwardly 165 on the hexagon cross shaft 98 while continually transmitting rotational torque between the power link 163 and the hexagon cross shaft 98 so that they rotate equally. The power link 163 includes projections 166 on one end that fittingly match the shape of the driving cross slot 162 of the lift motor output shaft 160. The opposite end of the power link 163 has a radial slot 167 that receives the sides of the forked ends 168 of the lift power release lever 148. A compression spring 168 mounted between the power link 163 and the adjacent upper post 60, forces the power link 163 to slide leftwardly 165 towards the lift gearmotor 95 so that the projections 166 of the power link will engage the driving cross slot 162 in the lift gearmotor output shaft 160 thereby turning the power link 163 and cross shaft 98 when the lift motor 95 turns while the power link 163 and gear motor output shaft 160 are engaged for normal power lift operation.

If the lift motor 95 should fail or the battery 170 be discharged the lift can be operated manually by disengaging the power link 163 from the lift motor shaft 160. To disengage, the exposed end 171 of the lift power release lever 148 must be rotated leftwardly 165 about a vertical axis 172 established by the vertical edge 173 of the opening 149 in the removable cover 100 through which the handle portion 174 of the lift power release lever 148 passes, so that the release lever forks 168 slide the power link rightwardly 164 on the hexagon cross shaft 98 and thereby compressing the spring 168. The operator then pushes rearwardly on the outer end 175 of the release lever 148 so that the ends 176 of the release lever forks 168 penetrate the two openings 177 and 178 in rearward side of the cross beam channel 179. When the operator releases the lever 148 the compression spring 168 forces the power link 163 leftwardly thereby applying force to the release lever 148 so that it is held against the leftward edges 180 and 181 of the two openings 177 and 178 in the channel wall 182 and the opening 149 on the cover wall 183. The fork arms 168 captured in the power link radial slot 167 thereby holds the power link 163 in the rightward disengaged position 184. The operator then inserts hexagon shaft 185 of the manual lift crank handle 186 into the hexagon shaft coupler 187 through an opening in the top surface 188 of the left hand upper post 61.

Lift Operation: When either the hand crank 186 or operating the power lift motor 95 is engaged with the hexagon shaft 98 the rotation of the hexagon shafts 98 and 135 cause the spline tubes to turn, which causes the large outer jackscrews 128 to turn, causing the lift 203 to raise or descend. When the large outer jack screws 128 turn the small nut portion 132 secured to the lower end of the outer jack screw 128 likewise turns. When the small nut 132 turns on the stationary (non-rotating) small jack screw 111, it causes the small nut 132 to move upwardly by following the helical track 191 of the thread of the small jack screw 111. The climbing small nut 132, in-turn lifts both the large outer jack screws 128 and the pairs of middle tube support moldings 115. The middle tube support moldings 115 in-turn lifts the middle posts 56 and 57. The outer jackscrew 128 being lifted by the small nut, while rotating within the middle tube support moldings 115 causes the outer screw large nut molding 117 to move upwardly by following the helical track 190 of the thread of the outer screw large nut molding 117. The outer screw large nut molding 117, respectively supporting the spline tubes 136 and being attached to the respective upper posts 60 and 61, lifts the spline tubes 136 and the upper posts 60 and 61. The lifting pair of upper posts 60 and 61, having seat support arms 68 and 69 attached at the upper ends thereof causes the patient/operator seat 73 to move upwardly. Reversing the direction of rotation of the rotating lift parts will cause the patient/operator seat 73 to move downwardly.

Now referring to FIGS. 21-24, the horizontal hexagon shaped cross shaft 98 and the vertical hexagon shafts 135 are rotationally linked by a matching pair of bevel gears 194*a, b* and 195*a,b* at each end of the horizontal cross shaft 98. The bevel gear 194*b* mounted on the LH end of the horizontal hexagon shaft 98 mates with the vertical shaft 135 bevel gear 195*b* on the inward side of the LH gear block 196 and the bevel gear 194*a* mounted on the RH end of the horizontal hexagon shaft 98 mates with the vertical shaft 135 bevel gear 195*a* on the outward side of the RH gear block 197, thereby causing both outer jack screws 128 to rotate in the same direction about their respective vertical axis 198. The bevel gears 194 and 195 are supported within radial bearings 200 which are in-turn supported by being mounted in respective gear blocks 196 and 197. Each gear block 196 and 197 is securely mounted within the respective right hand 60 or left hand 61 upper posts. The vertical hexagon shaft 135 of the left hand jack screw assembly 201 matingly supports a hexagon coupler 187. The hexagon coupler 187 is made available for optional connection of the hand crank assembly 186 when needed. The hexagon shaft 185 portion of the hand crank assembly 186 can be matingly inserted into the hexagon coupler 185. Turning the inserted hand crank 186 will cause the vertical 135 and horizontal shafts 98 to turn, if the lift motor 95 has been disengaged.

Now referring to FIGS. 25-30, the left hand portion of the upper crossbeam 32 through which a portion of the horizontal hexagon cross shaft 98 passes, the hexagon cross shaft 98 has a worm gear 204 matingly attached thereon so that as the shaft 98 turns the worm gear 204 turns with it. The worm gear 204 has screw-like helical gear teeth 205 that are engaged into matching helical gear teeth 206 formed along the length of the forward side 207 of a slidable rack 208 so that when the worm gear 204 turns the engaged helical gear teeth 205 and 206 cause the rack 208 to slide either leftward or rightward. The cross beam channel 93 has attached thereto a bracket 210 having a guide track 211 along its full length from left to right. The slidable rack 208 is also engaged with the track 211 so that the rack's 208 left-right motion is guided thereby keeping the rack's spiral teeth 206 engaged with the spiral teeth 205 of the worm gear as the worm gear 204 turns and the rack 208 moves along the track 211. The bracket 210 has a rearward vertical wall 212 whereon electrical switches 214, 215, 216 and 217 are mounted. Actuation of these switches provides signals to the motor power and logic control module 105 through which information is used by the control logic for safe and complete operations. The rack 208 has a raised rearward portion 219 that interferes with the switch rollers 220 so that when the raised portion 219 is located under a given switch the switch roller 220 is thereby lifted, actuating the internal contacts 221 of that switch. The worm gear 204 turns and the rack 208 moves in direct proportion to the lift motion distance (upwardly or downwardly). When the rack 208 has moved fully rightward on the track 211, the far right switch 214 is activated by contact with a raised portion 219 of the rack 208 whereby the actuation of the far right switch 214 sends a signal to the motor power and logic control module 105 indicating that the transporter's lift structure 203 is (downwardly) fully retracted. When the rack 208 has moved fully leftward on the track 211, the far left switch 217 is activated by contact with a raised portion 219 of the rack 208 whereby the actuation of the far left switch 217 sends a signal to the motor power and logic control module 105 indicating that the transporter's lift structure 203 is (upwardly) fully extended.

There are two other switches 215 and 216 located between the far right and far left switches. These switches are located to sense the location of the lift 203 height relative to certain lift height zones. The second switch 215 from the right, when actuated while the third switch 216 from the right and the far left 217 switches are not actuated, will indicate that the lift height is in a low height zone, wherein the controller is programmed to allow the operator patient 18 to drive the transporter 10 at up to full speed. The second 215 and third 216 switches from the right, when actuated while the far right 214 and far left 217 switches are not actuated, will indicate that the lift height is in a medium height zone, wherein the controller 105 is programmed to allow the operator patient 18 to drive the transporter 10 at up to a preset reduced speed limit. When the lift 203 is in the low and medium height zones, the switches 220 associated with the rear wheel arm actuators 221 and 222 must also be actuated so that both rear wheel support arms 20 and 21 are confirmed to be in the full-wide position as indicated by the respective wheel arm switches being actuated. If these arm location indicating switches 220 are not actuated the stability of the transporter is suspect and the motor power and logic control module 105 is programmed to limit the patient 18 driving speed to very slow. If the rear wheel support arms 20 and 21 position sensing switches 220 are not both actuated and the lift 203 is in the upper most height zone (wherein only the far left 217 and third from right 216 switches are actuated) the motor power and logic control module logic 105 is programmed to NOT allow the operator patient 18 to drive the transporter 10. The operator 18 must move both rear wheel support arms 20 and 21 to the full-wide position or reduce the height of the lift 203 into a lower zone before the transporter 10 can be driven. The transporter control system 105 also includes an inclinometer 230 that senses the angular deviation of the wheeled base assembly 13 of the transporter 10 from horizontal orientation. When the wheeled base assembly's 13 angular orientation with respect to horizontal exceeds preset angular deviation limits various operations will be limited, such as the lift 203 will not be allowed to extend or the transporter 10 driving speed will be reduced or driving is not allowed until the lift 203 height is reduced.

Figure 32:
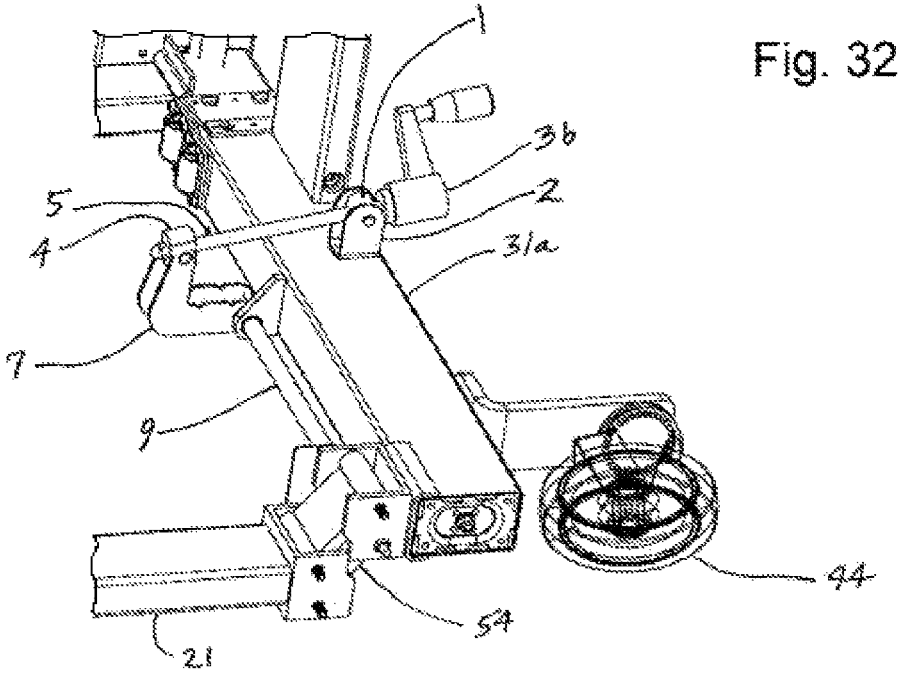
FIG. 32 is a fragmentary upwardly facing perspective view of another embodiment of the patient wheelchair lift-transfer device showing the LH rear wheel support arm linkage with the rear wheel support arm extended to a wide width position by a hand-crank driven screw-actuator.
Figure 33:
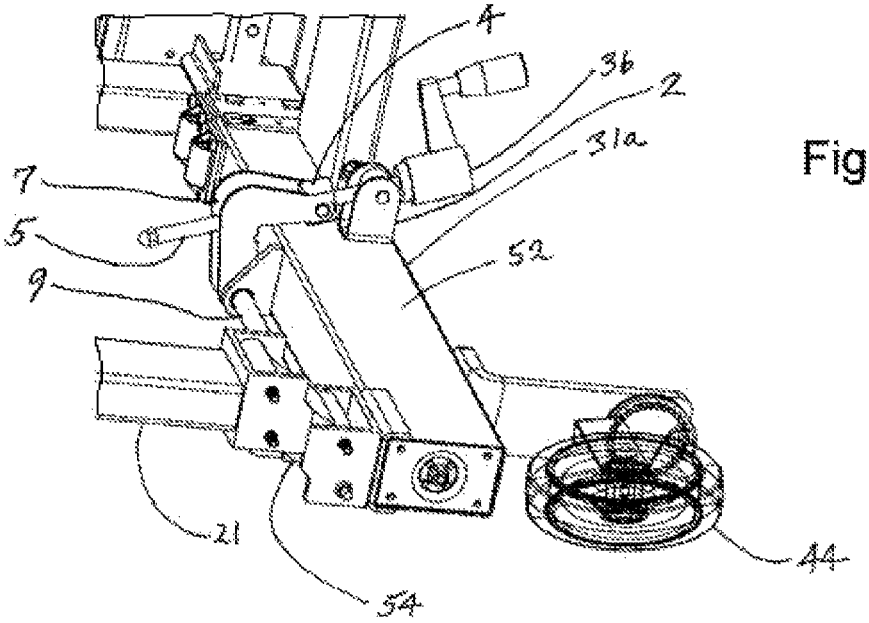
FIG. 33 is a similar view showing the LH rear wheel support arm linkage with the rear wheel support arm retracted to a narrow width position by a hand-crank driven screw-actuator.
Figure 37:
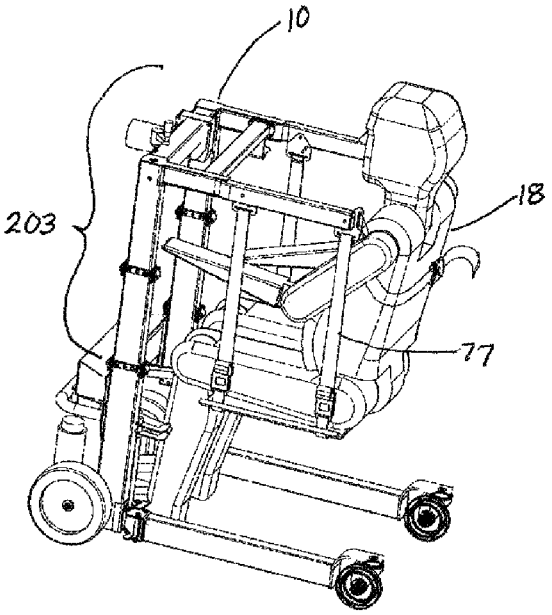
FIG. 37 is a perspective view showing the wheelchair lift-transfer device lift columns in an extended position, lifting the seated patient off the floor.

A version of the transporter 10*a* without power driving capability is illustrated in FIG. 31, comprising the same horizontal base 13*a* and upright assembly 14*a* with double telescoping lifting posts 30*a* and 31*a* except the components required for power driving have been omitted and front caster wheels 232 are mounted to the upright assembly 14*a*. This version is operated primarily by a caregiver who will push or pull the transporter 10*a* to move it horizontally on the support surface or floor. Optionally, the non-power drive transporter 10*a* has manually operated rear wheel support arm 21 width adjustment as seen in FIGS. 32 and 33. Shaft 9 rotates 4-bar pivoting linkage 54 by pivoting arm assembly 7 which is secured at the upper end thereto. Within arm 7 assembly a nut 4 is pivotally secured. A bracket 2 is secured to post 52 having a bushing 1 pivotally secured therein. Hand-crank 3*b* turns threaded shaft 5 within bushing 1 and nut 4 thereby pushing or pulling nut 4 along threaded shaft 5. Movement of nut 4 in turn moves arm 7 which rotates shaft 9 and the pivoting 4-bar linkage which in turn moves the rear wheel support arm 21 inward or outward.

Figure 40:
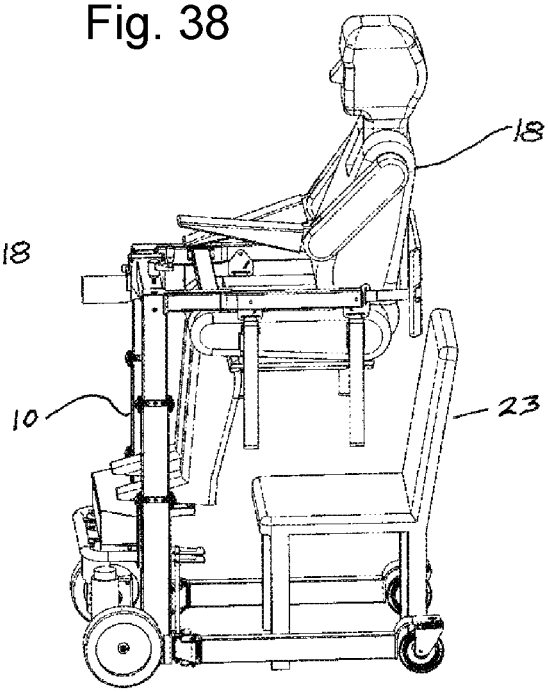
FIG. 40 is a perspective view showing the wheelchair lift-transfer device lift columns extended with the patient support belts adjusted to shortened length.

Now referring to FIGS. 34-43: When a patient has fallen to the floor, the transporter can be used to raise the patient. The caregiver moves the patient into a face up orientation with body positioned straight (as if standing), then places the seat board 15 under the patient 18 (FIG. 34). The transporter 10 is then moved to straddle the patient 18 (FIG. 35) so that the patient's hips 235 are located substantially between the rear wheels 236 and lower legs 37 pass under the lower cross beam structure 33. The elongate flexible straps 77 supported by the seat support arms 68 and 69 are attached to the seat 15 by attaching the length adjuster portions 79 to the buckle portions 83 of the seat board 15 and the back support belt assembly 78 is placed under the patients back 237. The caregiver then assists the patient to raise their head and torso to a seated position (FIG. 36) by tightening the back support belt 78. With the patient held in a seated orientation, the caregiver raises the lift 203 (FIG. 37) by operation of the lift motor 95 or hand crank 186. Since the elongate flexible straps 77 are likely fully extended, the caregiver may lower the patient on to a temporary support structure 23 (FIG. 38) and then lower the lift 203 additionally (FIG. 39) to allow the straps 77 to be adjusted to a shorter length. Then the patient 18 can be lifted off the temporary support structure 23 with the seat board 15 (and patient) now able to reach a much higher elevation (FIG. 40). The transporter 10 can then be moved into position (FIG. 41) to transfer the patient to be supported by another surface such as a conventional wheelchair 24 (FIG. 42) or bed (FIG. 46). Then the transporter can be moved away leaving the patient supported by another device (FIG. 43, 47).

Figure 44:
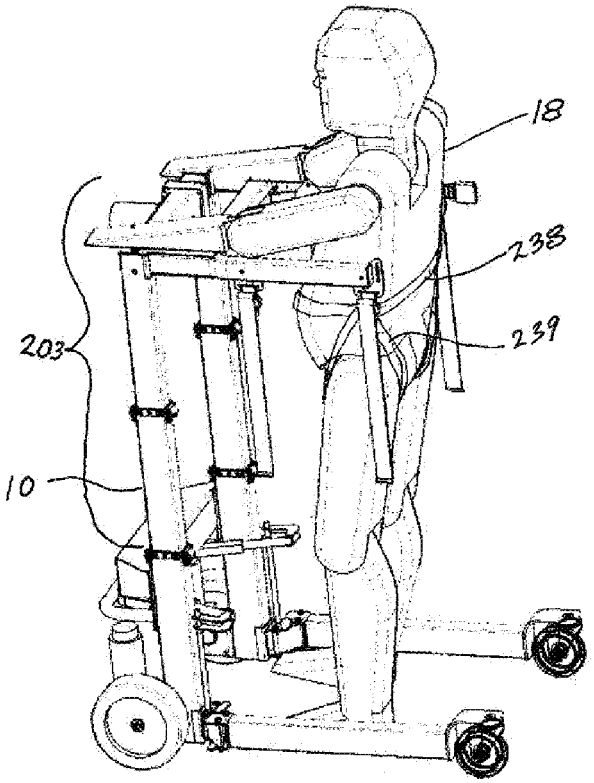
FIG. 44 is a perspective view showing the wheelchair lift-transfer device with double telescoping columns fully extended with the patient supported in a standing position.
Figure 45:
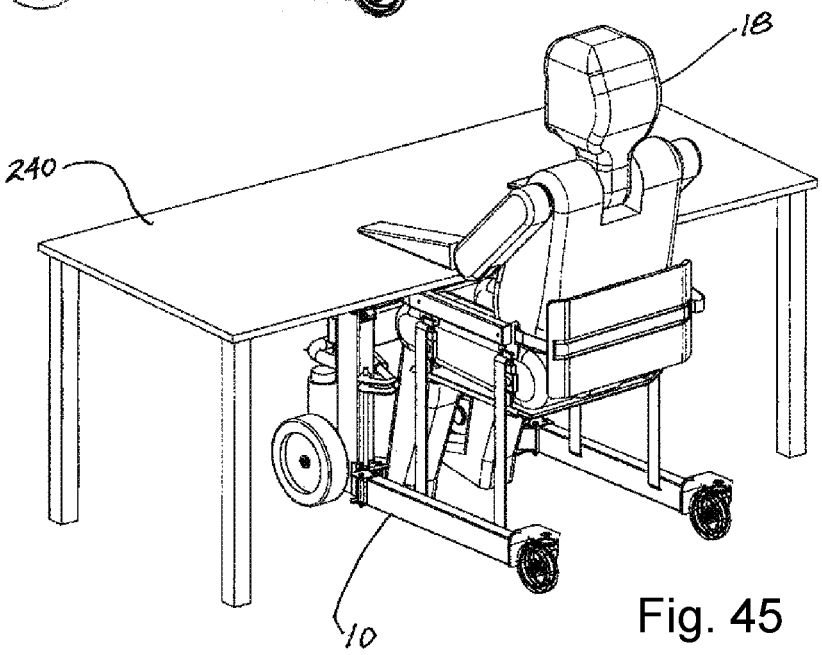
FIG. 45 is a perspective view showing the wheelchair lift-transfer device with double telescoping columns fully retracted allowing the seated patient to sit at a normal height table.

FIG. 44 illustrates the extreme lifting range potential of the double telescoping lifting columns 30 and 31 wherein the lift 203 can be raised high enough to bring a patient 18 to a standing position when elongate straps 238 are configured as a sling 239 suitable for lifting by supporting the patient's waist, buttocks and upper legs. FIG. 45 illustrates the contrasting lower limit of the range wherein the lift 203 can be lowered enough to position the lift columns under a standard height table 240.

FIG. 46 illustrates a patient positioned on a bed 242 by maneuvering the transporter 10 patient/seat support arms 68 and 69 over the bed 242. The patient 18, when released from the seat support straps 77 thereby being separated from the transporter 10, can use the handheld wireless controller 243 to drive the transporter 10 away from the bed 242 (FIG. 47) for storage in another location.

Figure 48:
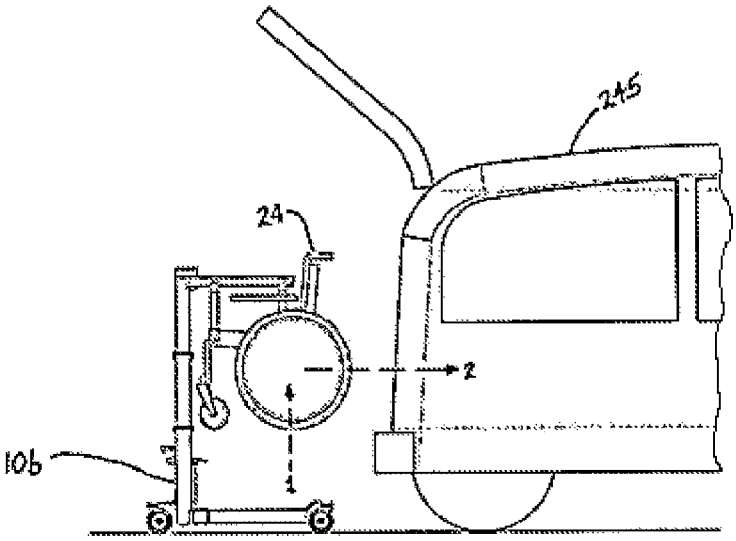
FIG. 48 is an elevation view showing an embodiment of the wheelchair lift-transfer device lifting a conventional wheelchair for insertion of the wheelchair into a vehicle.
Figure 49:
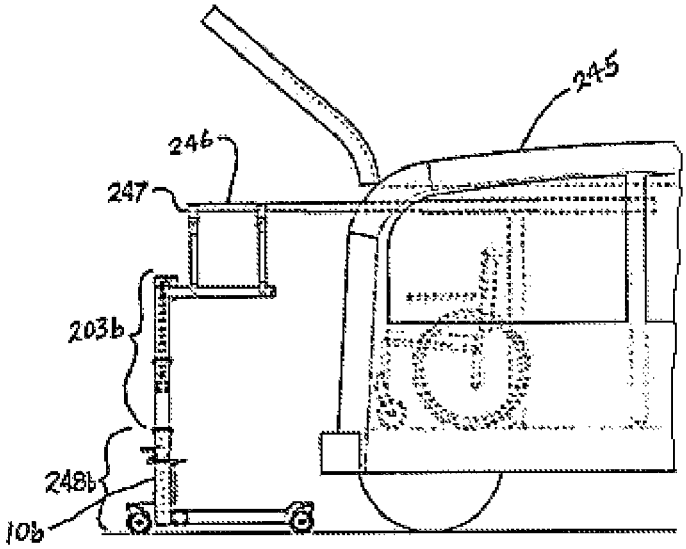
FIG. 49 is a similar view showing the wheelchair lift-transfer device with lower base portion supporting the wheels and with the extended upper lift portion attached to a vehicle mounted sliding carriage which is extended.
Figure 50:
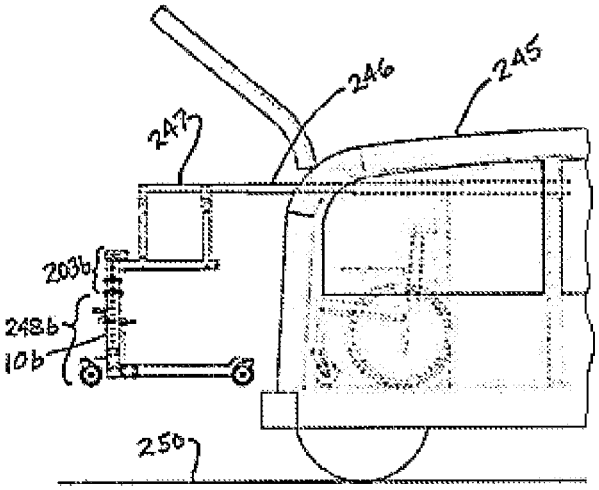
FIG. 50 is a similar view showing the wheelchair lift-transfer device with wheeled lower base portion lifted by retracted columns with the wheelchair lift-transfer device attached to and supported by the vehicle mounted sliding carriage when extended.
Figure 51:
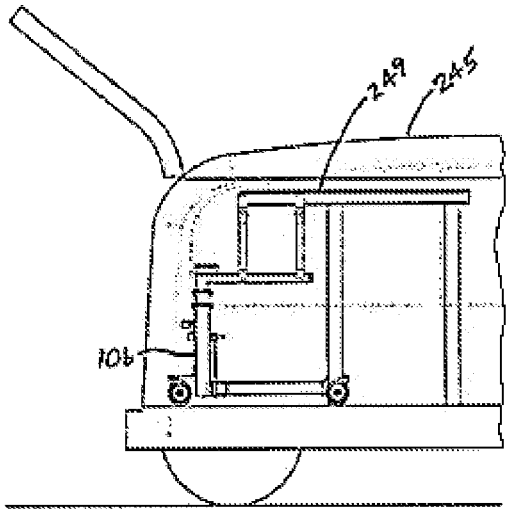
FIG. 51 is a similar view showing the wheelchair lift-transfer device with the vehicle mounted sliding carriage retracted so the wheelchair lift-transfer device has moved inside the vehicle.
Figure 52:
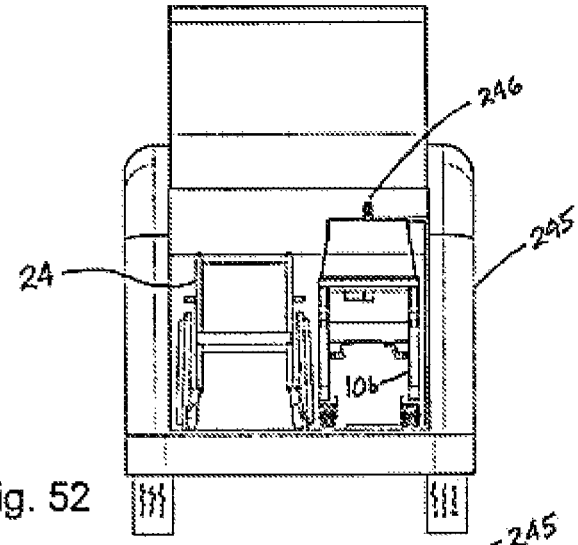
FIG. 52 is a rear elevation view of the vehicle showing both a conventional wheelchair and an embodiment of the wheelchair lift-transfer device stored within the vehicle.
Figure 53:
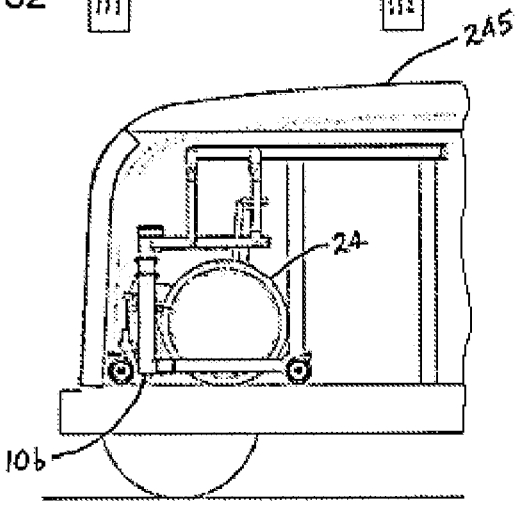
FIG. 53 is a fragmented cut-away side elevation view of the vehicle showing both a conventional wheelchair and an embodiment of the wheelchair lift-transfer device stored within the vehicle.

FIG. 48 illustrates a version of the transporter 10*b* attached to a conventional wheelchair 24, having lifted the wheelchair 24 to a height sufficient to move the wheelchair 24 into a vehicle 245 by rolling the transporter 10*b* towards the vehicle 245. FIG. 49 illustrates the transporter 10*b* lift 203*b* extended upwardly and attached to an horizontally extendable carriage arm 246, which can be a roller slide mechanism or a powered linear actuator that is supported by the vehicle 245 and is either manually or power extended outwardly 247 to engage with the raised transporter lift arms 68 and 69. FIG. 50 illustrates the lift 203*b* having been retracted and since the lift arms 68 and 69 are attached to the carriage arm 246, the base assembly 248*b* of the transporter 10*b* lifts off the previously supporting surface 250 to a height sufficient to move the transporter 10*b* into the vehicle 245. FIG. 51 illustrates the vehicle carriage arm having been either manually or power retracted 249 thereby moving the transporter 10*b* into the vehicle 245. FIGS. 52-53 illustrate both the conventional wheelchair 24 and transporter 10*b* stored side by side within the vehicle 245 with the transporter 10*b* located under the vehicle carriage arm 246. Of course this procedure can be reversed to move the transporter 10*b* and wheelchair 24 from the vehicle 245 to the lower level surface 250 outside the vehicle.

Figure 54:
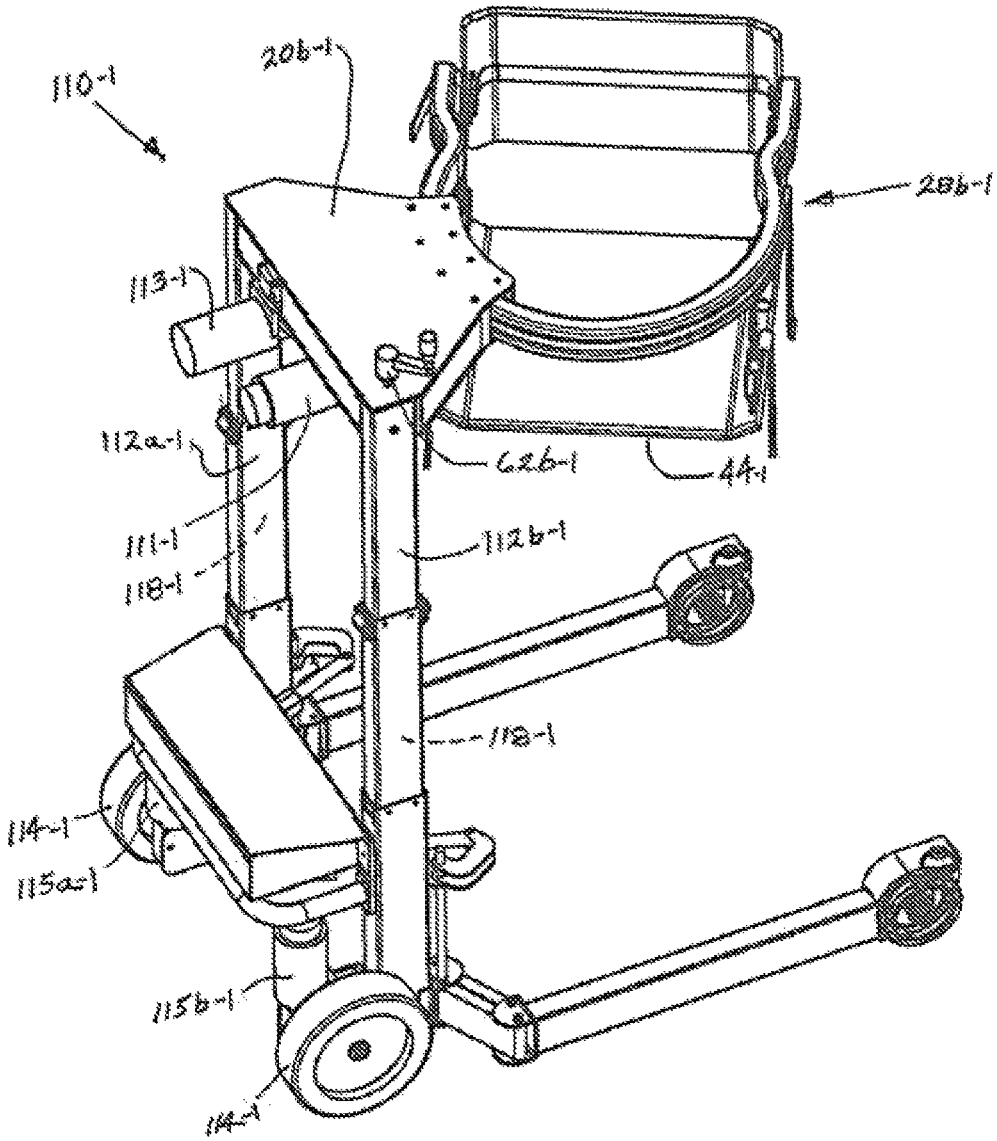
FIG. 54 is a perspective view of an embodiment of the wheelchair lift-transfer device incorporating the U-shaped lifting frame.
Figures 55, 56:
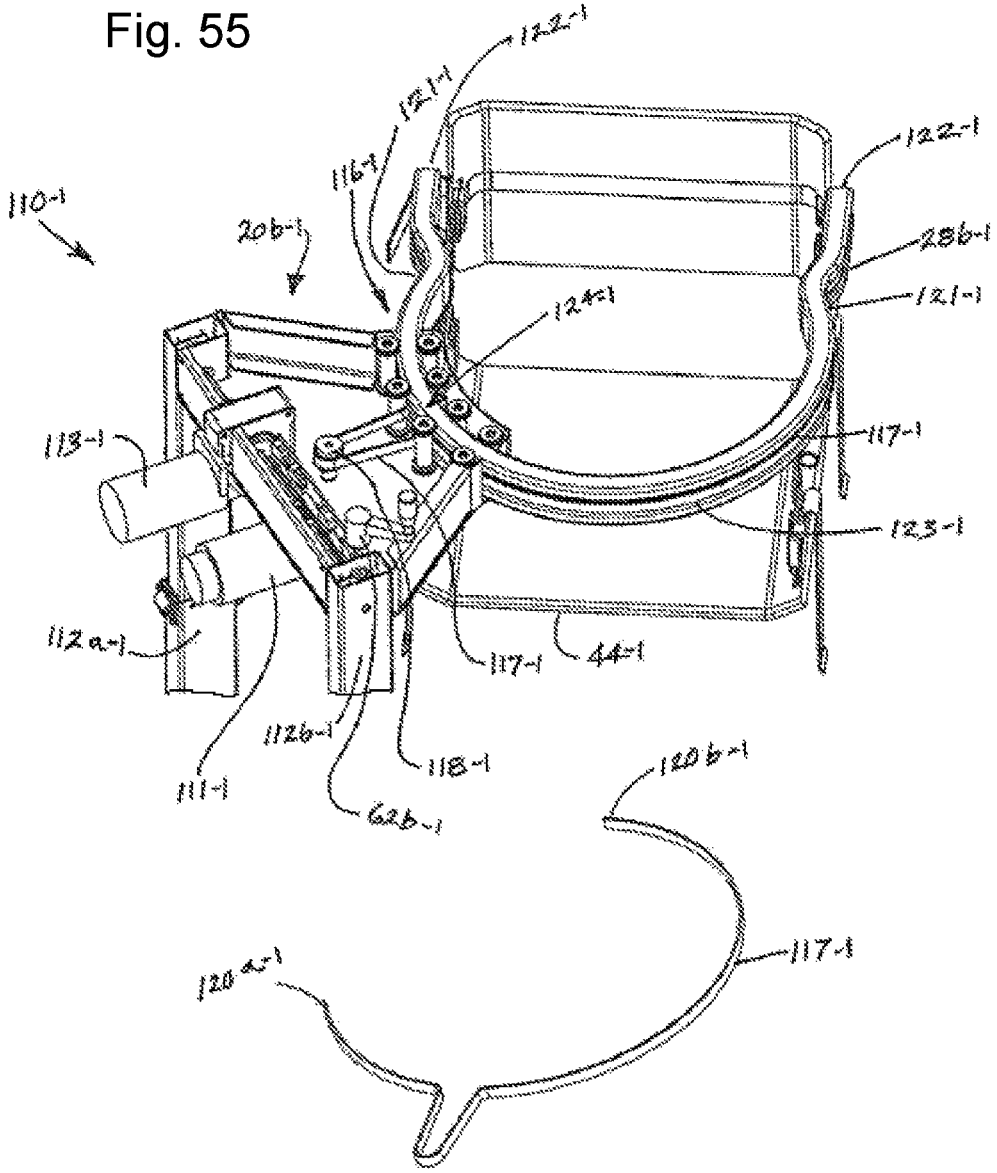
FIG. 55 is a fragmentary perspective view of the same embodiment of the wheelchair lift-transfer device showing the exposed U-shaped lifting frame, supporting rollers, rotation drive belt, rotation drive motor, and rotation drive pulley.
FIG. 56 is a perspective view of the rotation drive belt in the shape required to wrap around the U-shaped lifting frame and the rotation drive pulley.
Figure 69:
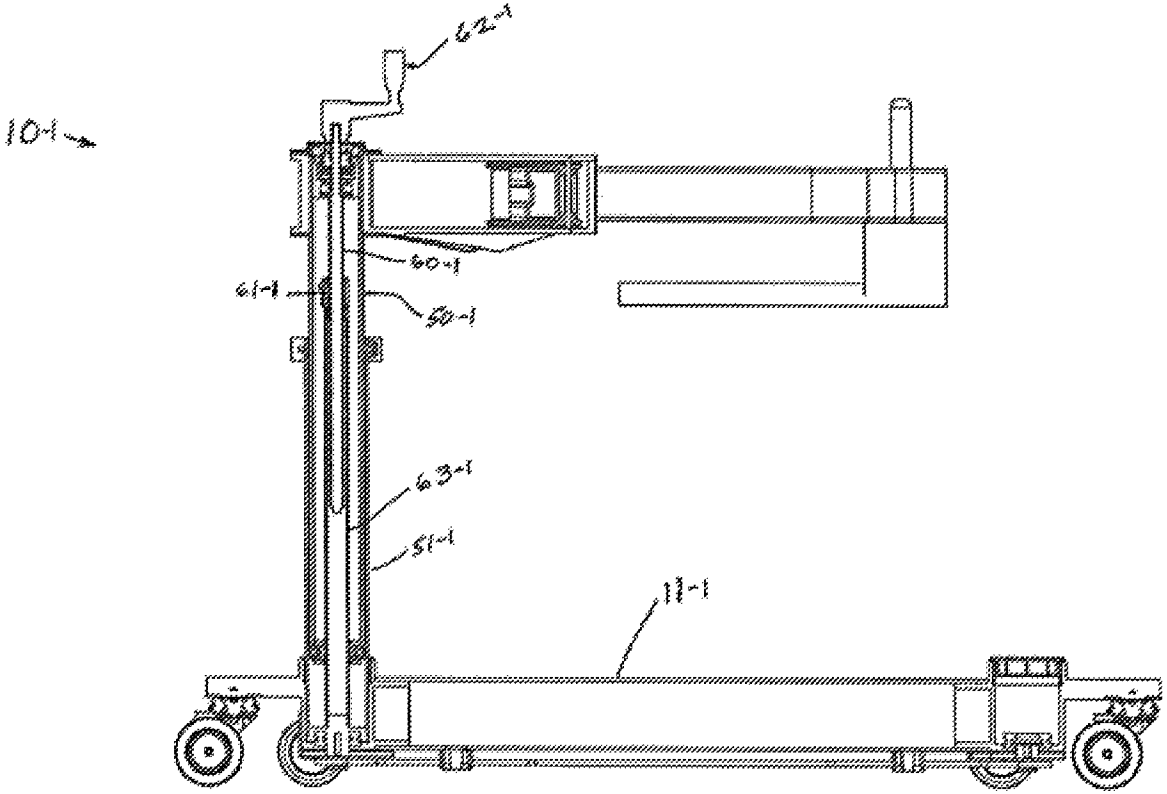
FIG. 69 is a cut away side view of the Lift transfer device.
Figure 70:
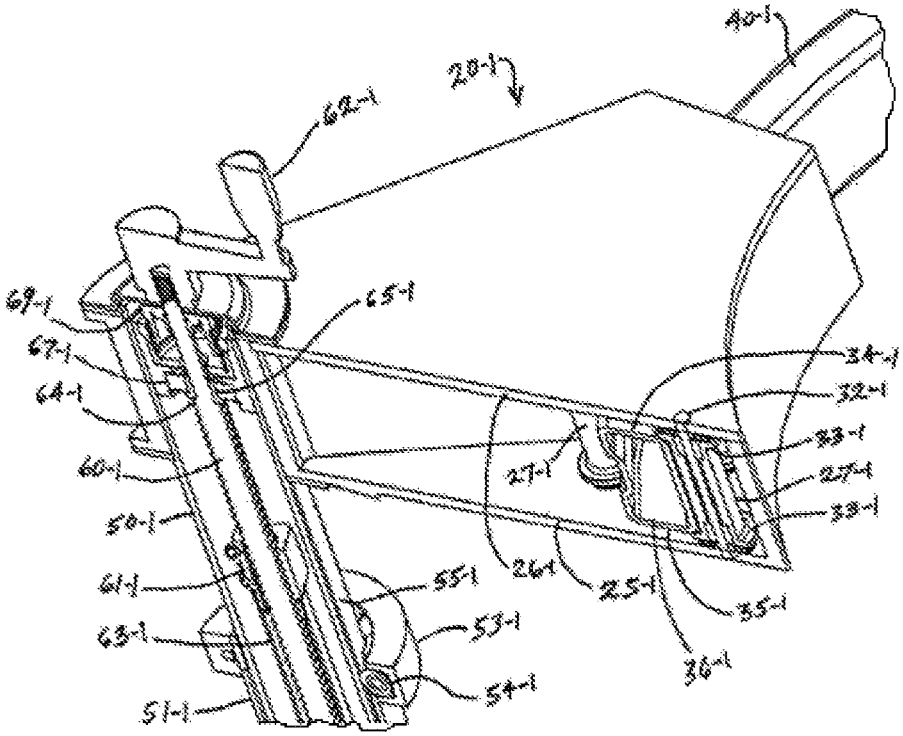
FIG. 70 is a fragmentary perspective cut away view of the upper lifting column assembly.
Figure 71:
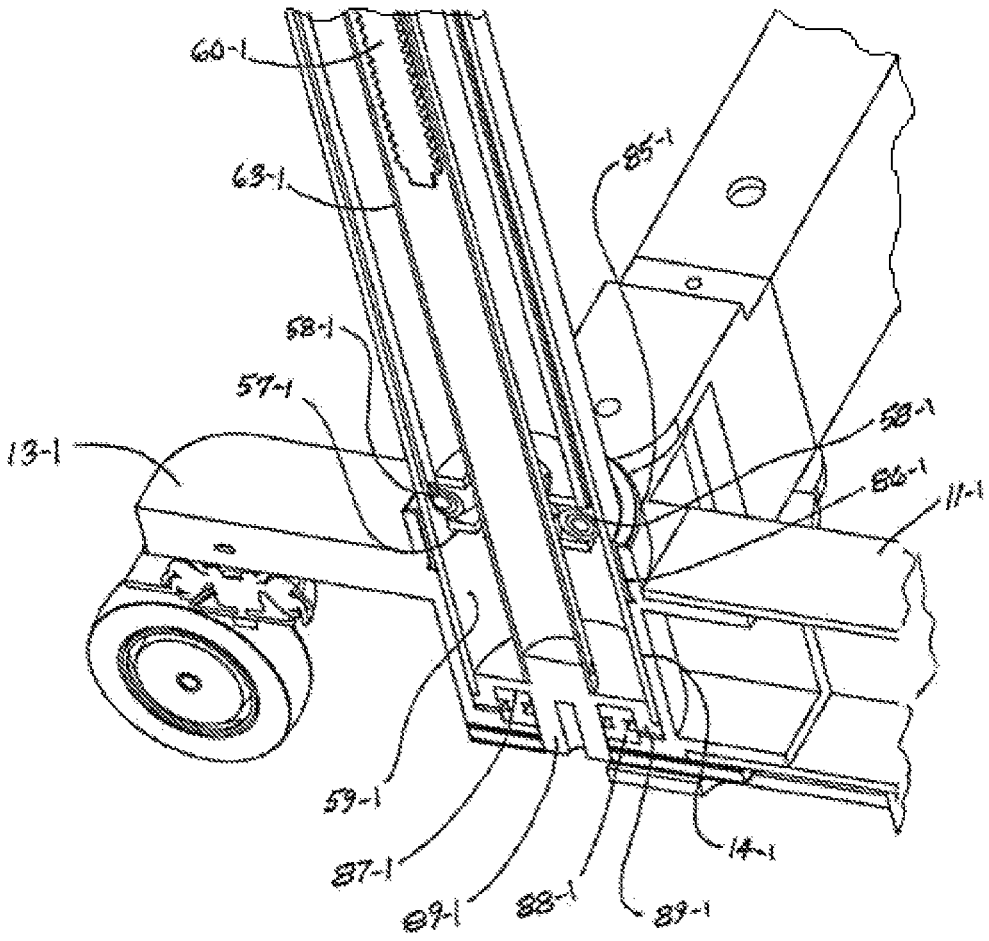
FIG. 71 is a fragmentary perspective cut away view of the lower lifting column assembly mounted in the support bracket.
Figure 72:
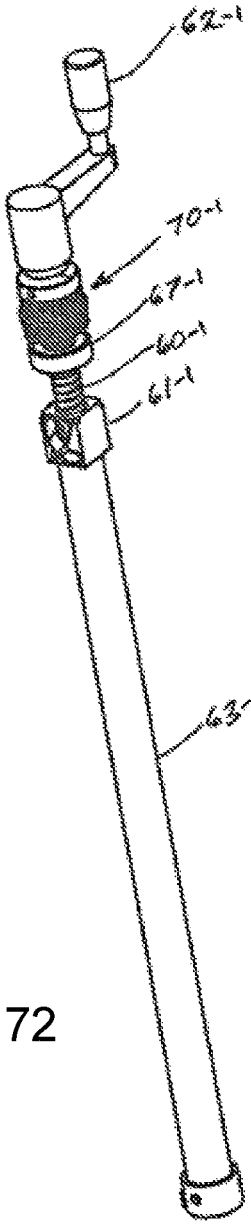
FIG. 72 is a perspective view of the ball-screw assembly with support tube, back-drive brake and crank assemblies.
Figure 73:
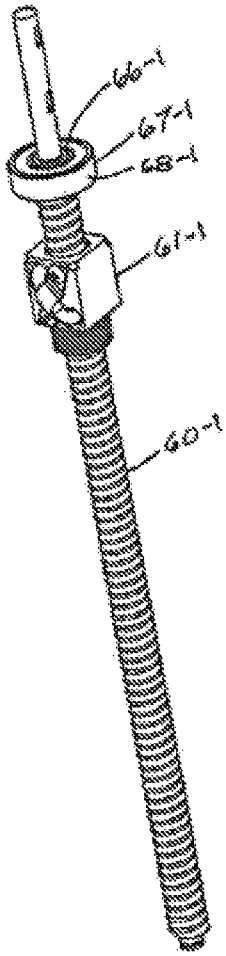
FIG. 73 is a perspective view of the ball-screw with ball-nut and ball bearing assemblies.
Figure 74:
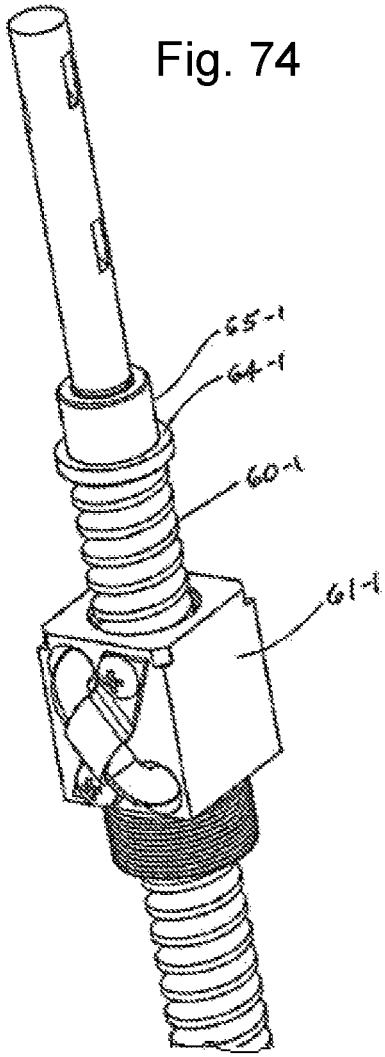
FIG. 74 is a fragmentary perspective enlarged view of the ball-screw, the bearing support collar and the ball-nut assembly.
Figure 75:
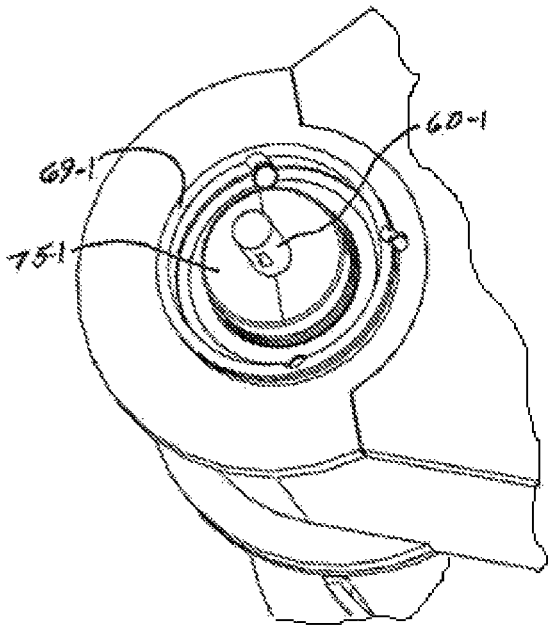
FIG. 75 is a fragmentary perspective enlarged view of the U-frame support housing with protruding ball-screw shaft and core portion of the back drive brake.
Figure 76:
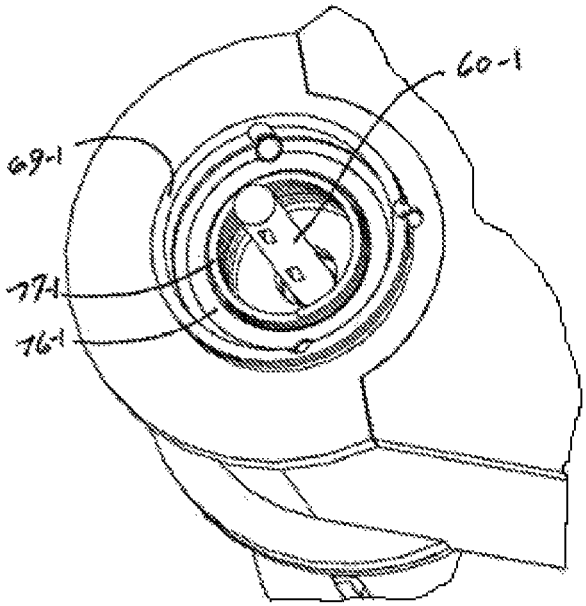
FIG. 76 is a similar fragmentary perspective enlarged view of the U-frame support housing with protruding ball-screw shaft, the core portion removed and the spring of the back-drive brake exposed.
Figure 77:
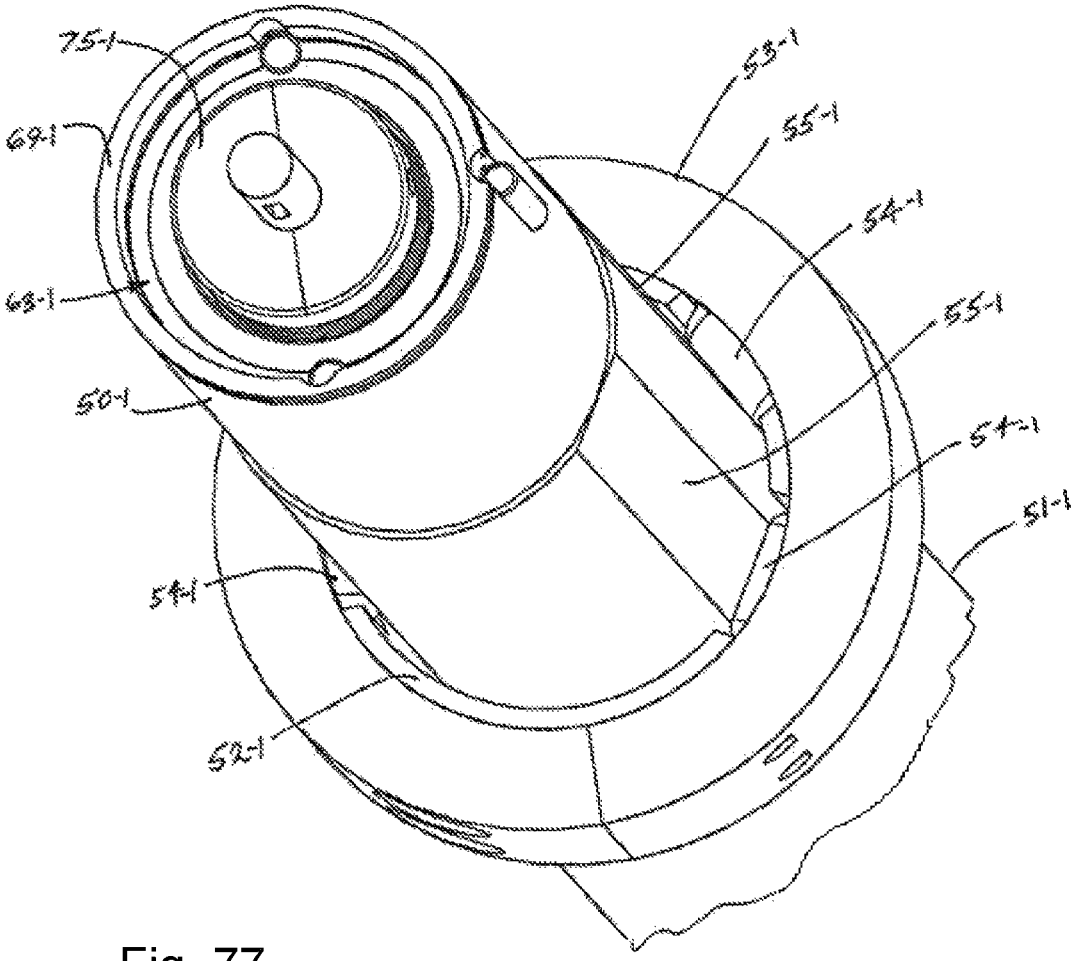
FIG. 77 is a fragmentary cut-away perspective view of the upper end of the lifting column, showing the flat side roller tracks of the inner column.
Figure 78:
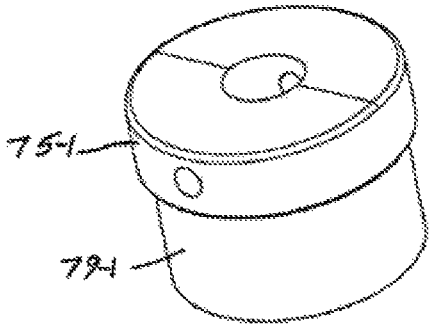
FIG. 78 is a perspective view of the back-drive brake core.
Figure 79:
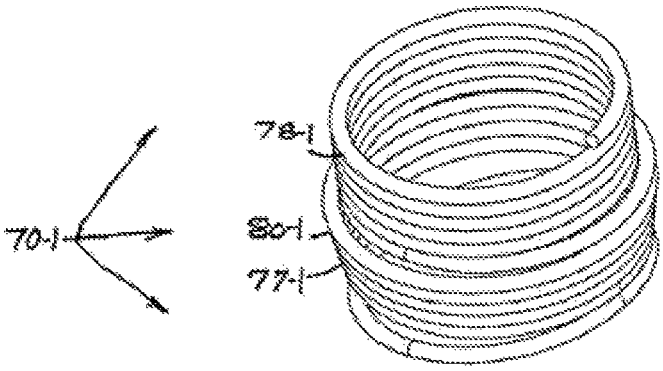
FIG. 79 is a perspective view of the back-drive brake spring.
Figure 80:
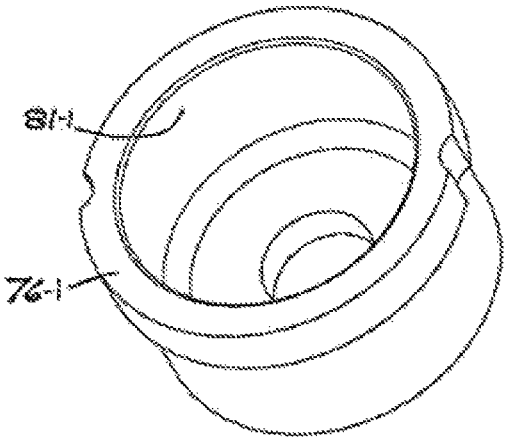
FIG. 80 is a perspective view of the back-drive brake drum.
Figure 83:
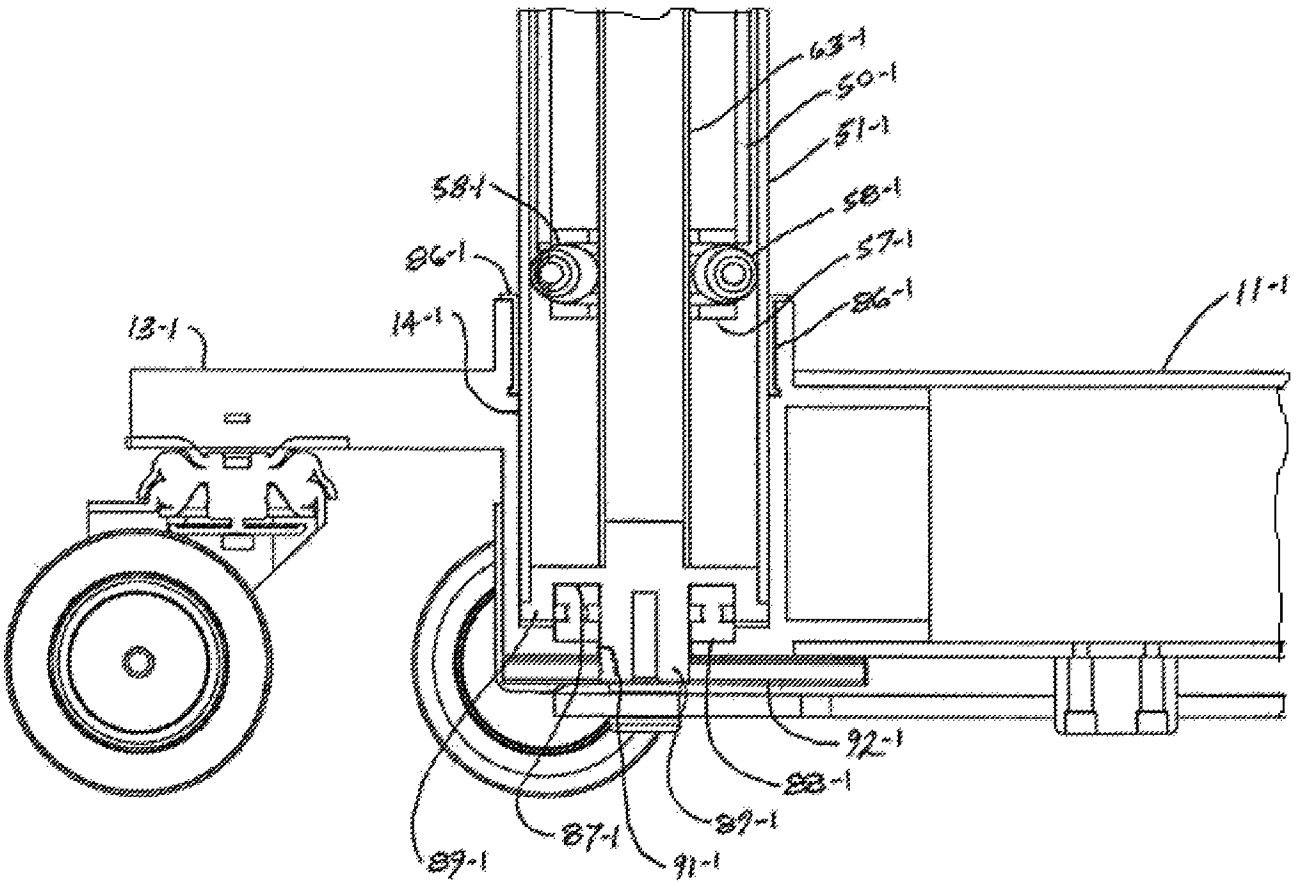
FIG. 83 is a cut away side view of the lifting column installed in the support bracket and revealing portions of the inner parts.
Figure 86:
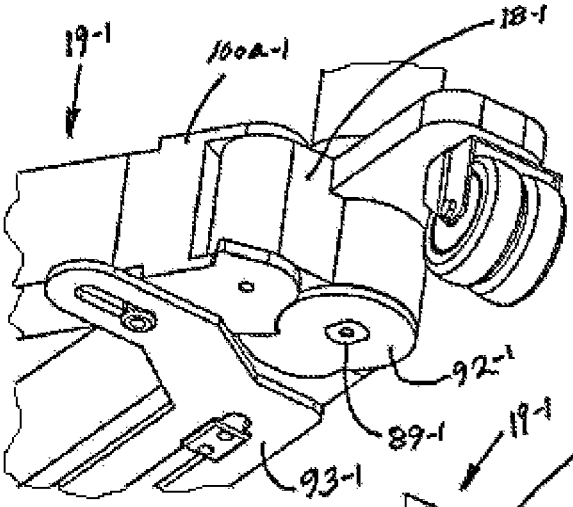
FIG. 86 is a fragmentary perspective enlarged underside view of the front wheel arm junction (under the lift column end of the wheeled base) showing the rotation control plate in the non-restricted position and the wheel support arm retracted to the narrow width.
Figure 87:
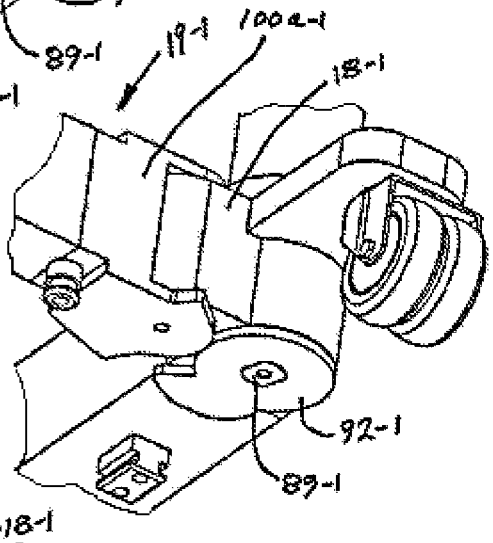
FIG. 87 is a fragmentary perspective enlarged underside view of front wheel arm junction (under the lift column end of the wheeled base) showing the rotation control plate in the non-restricted position and the wheel support arm extended to the wide width (the wheel arm synchronizing link plate omitted).
Figure 88:
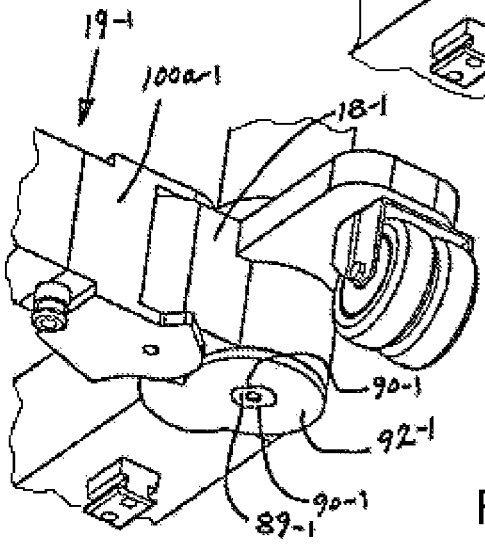
FIG. 88 is a fragmentary perspective enlarged underside view of the front wheel arm junction (under the lift column end of the wheeled base) showing the rotation control plate in the restricted position and the wheel support arm extended to the wide width (the wheel arm synchronizing link plate omitted).

Now considering FIGS. 54-56. These Figures illustrate another patient wheelchair-lift embodiment 110-1 that is similar to the wheelchair lift-transfer device 10. Wheelchair-lift embodiment 110-1 utilizes a roller housing assembly 20*b*-1 and U-shaped lifting frame 28*b*-1 instead of arms 68, 69 as in wheelchair lift-transfer 10. In embodiment 110-1 the rotation of U-shaped lifting frame 28*b*-1 is powered by electric drive motor 111-1. Roller housing assembly 20*b*-1 is supported by two lifting columns 112*a*-1 and 112*b*-1 wherein lifting columns 112-1 are raised by power from drive motor 113-1 and front wheels 114-1 are driven by a pair of drive motors 115*a*-1 and 115*b*-1. In this case patient 18 has control of all the motors 111-1, 113-1 and 115-1 which provides greatly increased independence for patient 18.

FIG. 55 illustrates in more detail roller assembly arrangement 116-1, driving belt 117-1 and belt driving pulley 118-1. Belt 117-1 is attached to U-shaped lifting frame 28*b*-1 at each belt end 120*a*-1 and 120*b*-1 at attachment points 121-1 near the open ends 122-1 of U-shaped frame 28*b*-1. Belt 117-1 is tensioned to lay tightly in a groove 123-1 in U-shaped lifting frame 28*b*-1 so it will pass through roller array 116-1 as frame 28*b*-1 moves there through. At central point 124-1 of roller housing assembly 20*b*-1, belt 117-1 curves away from U-shaped frame 28*b*-1, wraps around driving pulley 118-1, and then curves back 124-1 into contact with U-shaped frame 28*b*-1. As driving pulley 118-1 turns it moves belt 117-1, the belt end 120-1 under tension (120*a*-1 or 120*b*-1) pulls U-shaped lifting frame 28*b*-1 through roller array 116-1, thereby rotating U-shaped frame 28*b*-1 about a substantially vertical axis. Hand crank 62*b*-1 is used to optionally drive lifting screws 118-1 for lifting patient 18, after disengaging electric lift driving motor 113-1.

Referring to FIGS. 57-103, there is illustrated another embodiment of lift-transfer device 10-1 (herein-after referred to as the "air-lift" for convenience) configured as a patient lift and transfer device especially suitable for use on a commercial passenger aircraft 128-1. The air-lift 10-1 includes wheeled base 11-1 having horizontal elongated frame member 12-1 with support bracket 13-1 attached at each end. Support bracket 13*a*-1 of one end is basically a mirror configuration of support bracket 13*b*-1 of the opposite end.

Each support bracket 13-1 has socket 14-1 for optionally receiving and supporting lifting column assembly 15-1 in substantially vertical orientation, horizontal projecting structure 16-1 for mounting caster wheel 17-1 and side hinge structure 18-1 for mounting wheel support arm 19-1. Lifting column assembly 15-1 includes roller housing assembly 20-1 at the upper end 21-1 thereof.

The wheeled base 11-1 has wheel support arm 19-1 pivotally connected to hinge structure 18-1 of each support bracket 13-1. Wheel support arms 19-1 each have caster wheel 17-1 mounted at 22-1 opposite the hinge end.

When wheel support arms 19-1 are extended perpendicularly from support brackets 13-1 (FIGS. 57 and 58) this results in the widest base configuration 23-1. When wheel support arms 19-1 are angled rearwardly from the elongated frame member 12-1 (FIGS. 59 and 60), base 11-1 configuration width is reduced 24-1.

FIG. 61 illustrates roller housing assembly 20-1 located at the upper end 21-1 of lifting column 15-1, which includes: roller housing 25-1, housing cover 26-1, and internal guide roller assemblies 27-1 configured to support and guide rotatable U-shaped lifting frame 28-1. Roller housing assembly 20-1 is attached to the lifting column 15-1 so that it cannot rotate independent of the lifting column 15-1.

Guide roller assembly 27-1 (FIGS. 62, 63) includes support roller 29-1, two radial needle bearings 30-1, upper and lower needle thrust bearings 31-1 and axle pin 32-1. Support rollers 29-1 have flanges 33-1 that capture the upper 34-1 and lower 35-1 edges of U-shaped lifting frame 28-1 cross section 36-1. Axle pin 32-1 is supported with axis substantially vertical in roller housing 25-1 and housing cover 26-1. Needle bearings 31-1 at each end of guide roller assembly 27-1 reduce rolling friction as rollers 29-1 turn about their respective axle pin 32-1. Needle thrust bearings 31-1 reduce the friction from forces vertically induced from supporting U-shaped lifting frame 28-1.

The curved portion 37-1 of U-shaped lifting frame 28-1 can be moved through guide roller arrangement 38-1 within roller housing assembly 20-1 thereby causing U-shaped lifting frame 28-1 to rotate about a substantially vertical axis which changes the angular orientation to which open portion 39-1 of the "U" 40-1 faces with respect to the orientation of wheeled base 11-1.

U-Shaped lifting frame 28-1 includes suspended support structures 42-1 that provide attachment points 43-1 for patient support accessories such as sling 44-1 (FIGS. 107-117). Support structures 42-1 pass under roller housing 25-1 as adjacent curved portion 45-1 of U-shape 37-1 passes through housing 25-1, directly above.

Lifting column assembly 15-1 may be rotated approximately 20-degrees about its vertical axis within socket 14-1 of support bracket 13-1 into which it is assembled if wheel support arms 19-1 are extended perpendicularly from the elongated frame member 12-1. This rotation of lifting column assembly 15-1 allows for repositioning of the center axis of U-shaped lifting frame 28-1 for improved stability when wheeled base 11-1 has been widened 23-1. This feature will be better described later regarding FIGS. 93-96.

Now considering the basic structure of lifting column assembly 15-1 (FIG. 64-68), which includes inner column tube 50-1 and outer column tube 51-1 telescopingly assembled together about a common vertical axis. The upper end 52-1 of outer column 51-1 has attached roller support assembly 53-1 wherein support rollers 54-1 guide the vertical motion of inner column 50-1 within outer column 51-1 by rolling against outer surface 55-1 of inner column 50-1. The lower end 56-1 of inner column 50-1 includes roller support assembly 57-1 wherein rollers 58-1 guide the vertical motion of inner column 50-1 within outer column 51-1 by rolling against the inner surface 59-1 of outer column 51-1.

Referring to FIGS. 69-80, internal to inner 50-1 and outer 51-1 tubes of lifting column assembly 15-1 is ball-screw 60-1 and ball-nut assembly 61-1 for expanding and retracting the height column 15-1. The lifting force is applied by turning crank handle 62-1 mounted on ball-screw 60-1.

Ball-screw 60-1 turns within ball-nut 61-1 which is non-rotatingly supported on support tube 63-1 which is in turn supported on lift transfer device 10-1 base assembly 11-1. At the top of thread portion 64-1 of ball-screw 60-1 is mounted bearing support bushing 65-1. Inner race 66-1 of radial/thrust bearing 67-1 mounts on bushing 65-1. The outer race 68-1 of radial/thrust bearing 67-1 supports the upper end 69-1 of inner column 50-1. As ball-screw 60-1 turns it lifts bearing 67-1 which in turn lifts inner column 50-1. Reversing the rotation of crank 62-1 and ball-screw 60-1, lowers inner column 50-1.

Near the top of ball-screw 60-1, just under crank handle 62-1, back-drive brake assembly 70-1 is located. Back-drive brake assembly 70-1 provides increased rotational friction in only one direction of rotation. Because ball-screw 60-1/ball-nut 61-1 assemblies are inherently low-friction assemblies, the effort required to lift the patient 41-1 is reduced. The reduced friction can also allow the weight of the patient 41-1 to cause ball-screw 60 to reverse rotation (back-drive) and lower the lift 15-1. The back-drive brake 70-1 adds enough friction to overcome the back-driving force, thereby maintaining the selected lift height.

Mounted on ball-screw 60-1 is core 75-1 of brake assembly 70-1 and mounted to the upper end 69-1 of inner column 60-1 is brake drum 76-1. Mounted between core 75-1 and drum 76-1 is coiled wire spring 77-1 having two sections. The smaller wound section 78-1 fits slidingly close to core 75-1 outer surface 79-1 and the larger wound section 80-1 interferingly fits within drum 76-1 inner surface 81-1 with larger spring coils 80-1 forced to conform against inner drum surface 81-1. When ball-screw 60-1 is rotated to lift inner column 50-1 smaller section 78-1 of spring 77-1 slides freely on core 75-1. When ball-screw 60-1 is rotated oppositely to lower inner column 50-1, smaller section 78-1 of spring 77-1 instantly grips tightly to core 79-1 which causes the entire spring 77-1 to rotate and larger section 80-1 of spring 77-1 to rub against inner surface 81-1 of drum 76-1 in which the resulting friction resists the back-driving rotation.

Referring to FIGS. 81-93, lifting column assembly 15-1 can be optionally assembled into socket 14-1 of support bracket 13-1 at either end of base assembly 11-1 (the end to which the lifting column is installed serves as the "front" end).

Outer column tube 51-1 is supported in the upper end 85-1 of socket 14-1 by bearing liner 86-1 and rests at the bottom end 87-1 on thrust bearing 88-1. The bottom portion 87-1 of lifting column 15-1 has shaft extension 89-1 with flat sides 90-1. A portion of shaft extension 89-1 projects through hole 91-1 in the bottom of bracket 13-1.

Rotation control plate 92-1 is attached to shaft extension 89-1 from the underside of base assembly 11-1 by engaging flats 90-1 so that rotation control plate 92-1 must rotate with lifting column assembly 15-1 if it is rotated within socket 14-1.

Now referring to FIGS. 84-88. It is advantages to shift sidewardly lifting column assembly 15-1 (by rotation about the column vertical axis) to improve stability of air-lift 10-1 when wheel support arms 19-1 are extended 23-1. However, when wheel support arms 19-1 are retracted 24-1 to narrow the base width 24-1, lift column assembly 15-1 must be restricted from being shifted (rotated). Rotation control plate 92-1, attached to bottom 87-1 of lifting column assembly 15-1, provides this restriction by blocking lifting column assembly 15-1 from rotating when wheel support arms 19-1 are retracted 24-1. If wheel support arms 19-1 are extended 23-1, plate 92-1 configuration allows lifting column assembly 15-1 to be rotated through the full extent of its pivotal range. In FIGS. 95 and 96 wheel arm synchronizing link plate 93-1 has been omitted for clarity.

Now referring to FIGS. 89-92. It is also advantages for wheel support arms 19-1 to retract 24-1 in the rearward direction from the lift column 15-1 end. Therefore rearward end 94-1 of air-lift 10-1 has stop plate 95-1 that restricts wheel support arms 19-1 from retracting forwardly.

Figure 89:
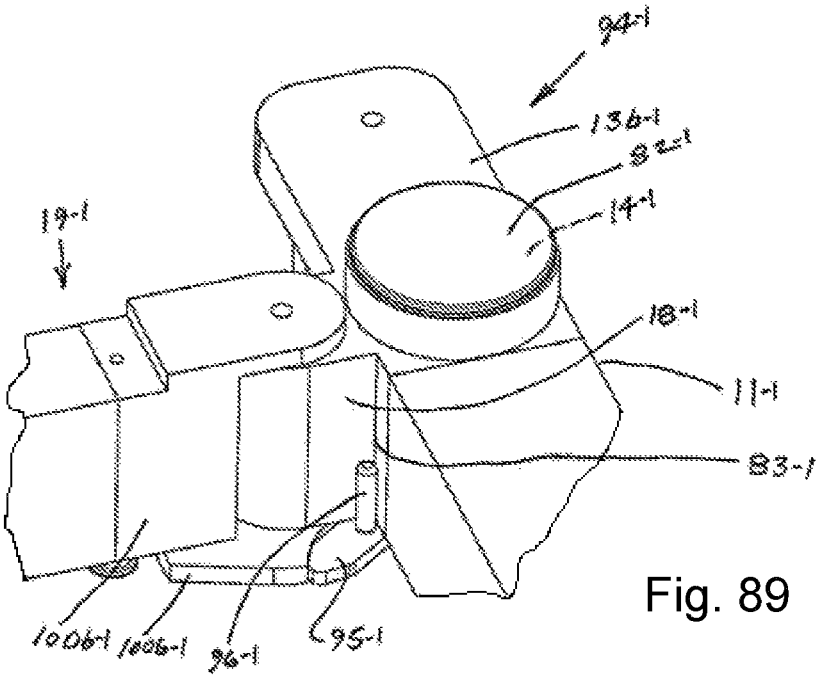
FIG. 89 is a fragmentary perspective enlarged topside view of the wheeled base showing the rearward junction of the wheel support arm, the closed (capped) socket and a portion of the stop arm.

FIG. 89 illustrates the top side of support bracket **13*b*-1 wherein socket cap 82-1 is installed and wheel support arm 19-1 extends there from. In this junction a portion of stop plate 95-1 is exposed and blocking wheel support arm 19-1 from pivoting in one direction. At junction corner 83-1, stop plate 95-1 has upwardly projecting pin 96-1 to block stop plate 95-1** from pivoting.

Figure 90:
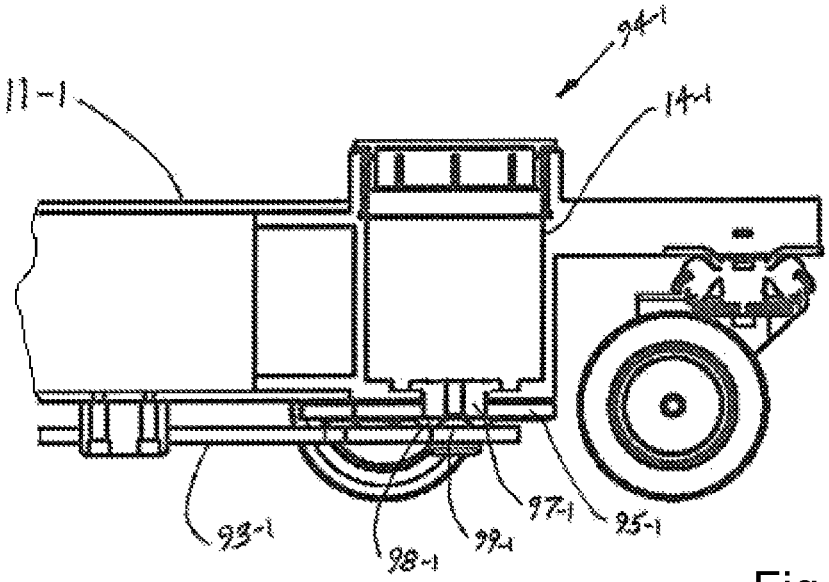
FIG. 90 is a side cut away view through the rearward end of the base, showing portions of the capped socket and the stop arm.

FIG. 90 illustrates the cut away view of socket 14-1 showing short mounting shaft 97-1 to which stop plate 95-1 is attached. Stop plate 95-1 is retained on shaft 97-1 by retaining cap 98-1 and screw 99-1.

Figure 91:
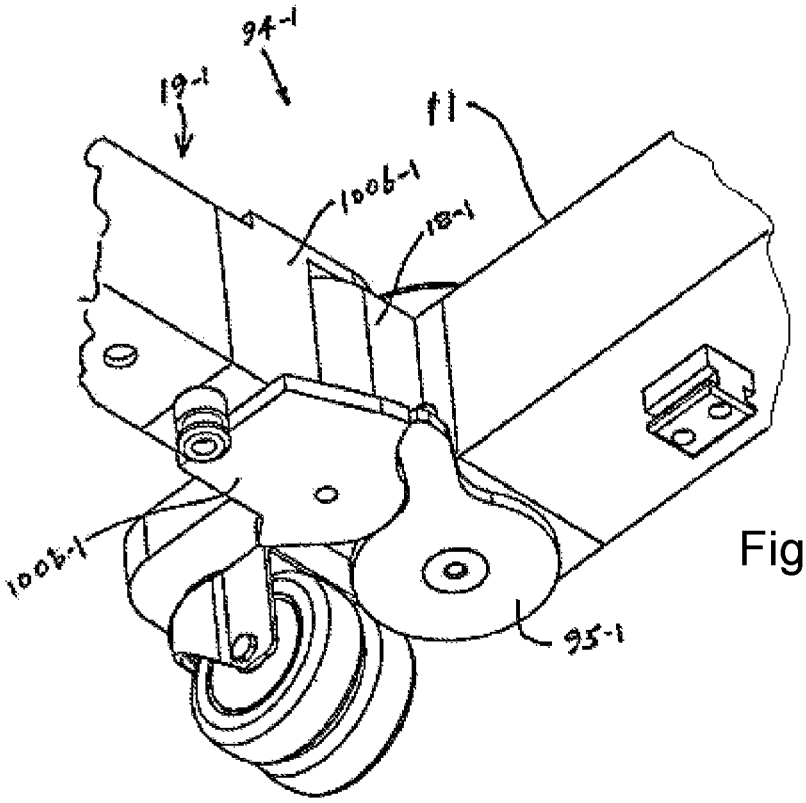
FIG. 91 is a fragmentary perspective enlarged underside view of the wheeled base (the wheel arm synchronizing link plate omitted) showing the rearward junction of the wheel support arm with stop arm and the wheel support arm extended for maximum base width position.

FIG. 91 illustrates stop plate 95-1 located adjacent wheel arm hinge end bracket **100*b*-1. This view shows wheel arm 19-1 is blocked from pivoting forwardly (wheel arm synchronizing link plate 93-1 and retaining cap 98-1** have been omitted for clarity).

Figure 92:
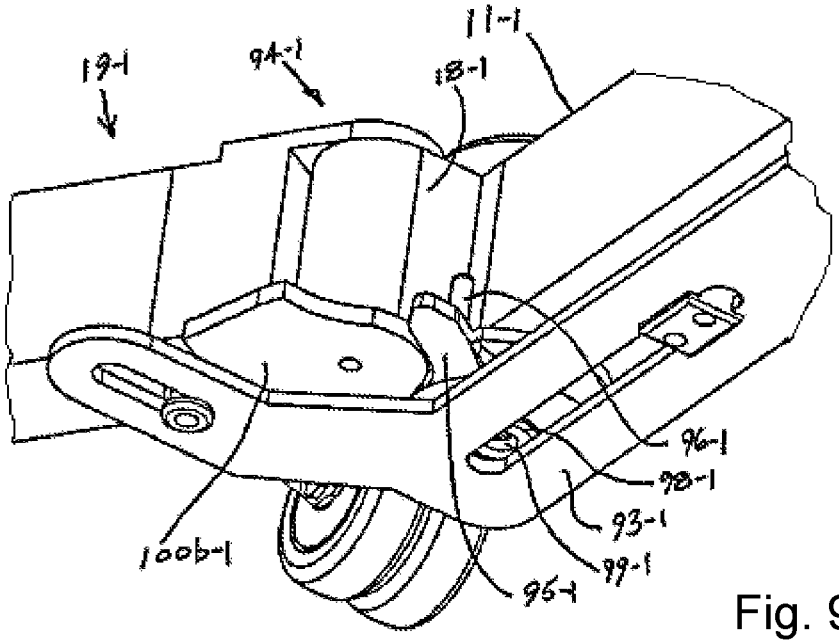
FIG. 92 is a fragmentary perspective enlarged underside view of the wheeled base showing the rearward junction of the wheel support arm and a portion of the wheel arm synchronizing link plate.
Figure 97:
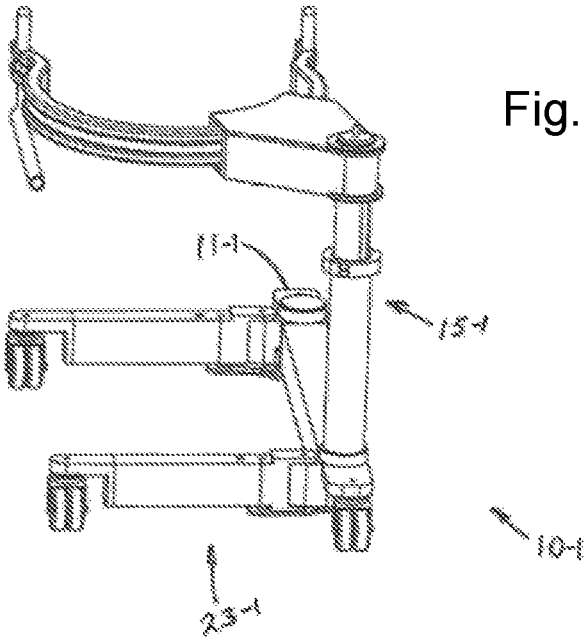
FIG. 97 is a perspective frontal view of the configuration of shown in FIG. 93.

FIG. 92 illustrates stop plate 95-1 adjacent wheel arm hinge end bracket **100*b*-1. This view shows wheel arm 19-1** is allowed to pivot only rearwardly.

Now referring to FIGS. 93-98, FIGS. 93 and 97 illustrate wheel arms 19-1 extended 23-1, lifting support column 15-1 has been shifted (by rotation) sidewardly 101-1 so the center of U-shaped lifting frame 28-1 is offset to become more centrally located over base 11-1 widened 23-1 to improve stability of air-lift 10-1 and U-shaped lifting frame 28-1 is oriented to open 39-1 rearwardly.

FIG. 94 is a similar view showing lifting column assembly 15-1 has been shifted oppositely 102-1 of that shown in FIG. 93 so that U-shaped frame 28-1 is located more centrally over base 11-1 elongated frame member 12-1. In this position wheel arms 19-1 could be retracted as shown in FIG. 96 (if desired). U-shaped lifting frame 28-1 remains rotated to open 39-1 rearwardly, as in FIG. 96.

FIG. 95 is a similar to FIG. 94 except U-shaped lifting frame 28-1 is rotated 90-degrees to open 39-1 to the side of air-lift 10-1 while shifted 102-1 to the offset location over base 11-1 with wheel arms 19-1 extended 23-1. Since patient's 41-1 back would be facing outward of U-shaped frame 28-1 opening 39-1, having lifting column assembly 15-1 shifted 102-1 more centrally over base 11-1 elongated frame member 12-1 provides greater stability when patient 41-1 would be rotated 90-degrees as shown in this view.

Figure 98:
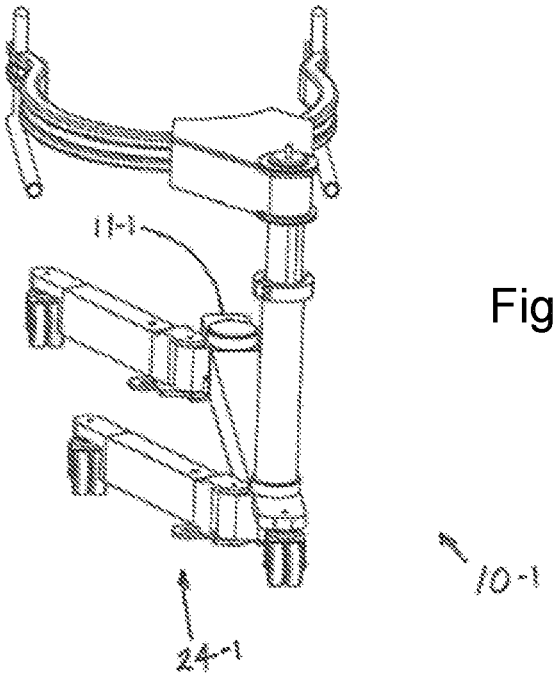
FIG. 98 is a perspective frontal view of the configuration of shown in FIG. 96.

In FIGS. 96 and 98 the configuration is similar to the view of FIG. 94 showing lifting column assembly 15 has been shifted 102 oppositely of that shown in FIG. 93 so that U-shaped frame 28-1 is located more centrally over base 11-1 elongated frame member 12-1. However, in this position wheel arms 19-1 are shown retracted 24-1 so that base 11-1 is set at the narrow width 24-1 and U-shaped lifting frame 28-1 remains rotated to open 39-1 rearwardly. This configuration is suitable for transporting a patient 41-1 along narrow isle ways.

In FIGS. 99-103 illustrate patient 41-1 supported by air-lift 10-1.

Figure 99:
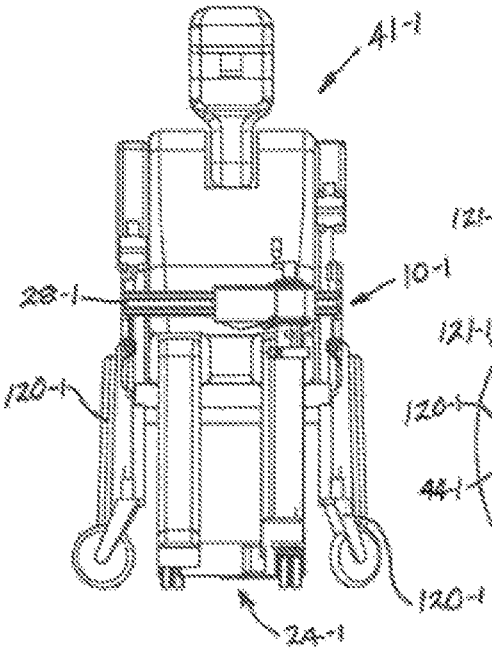
Figure 100:
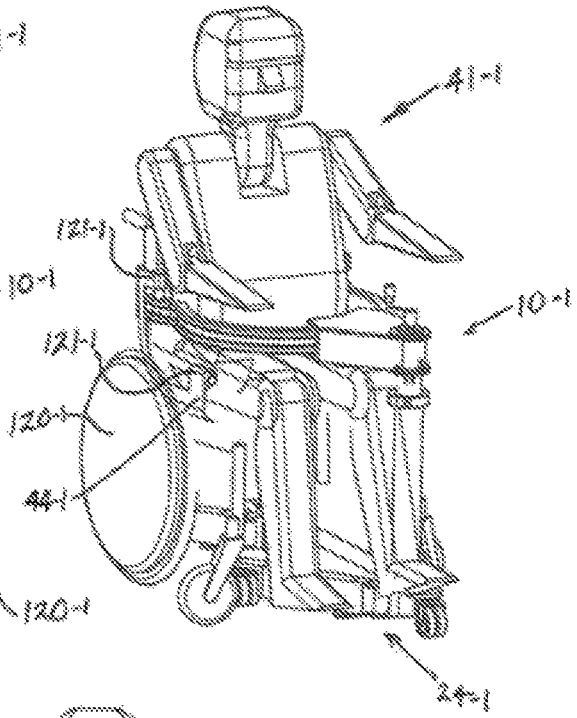
Figure 101:
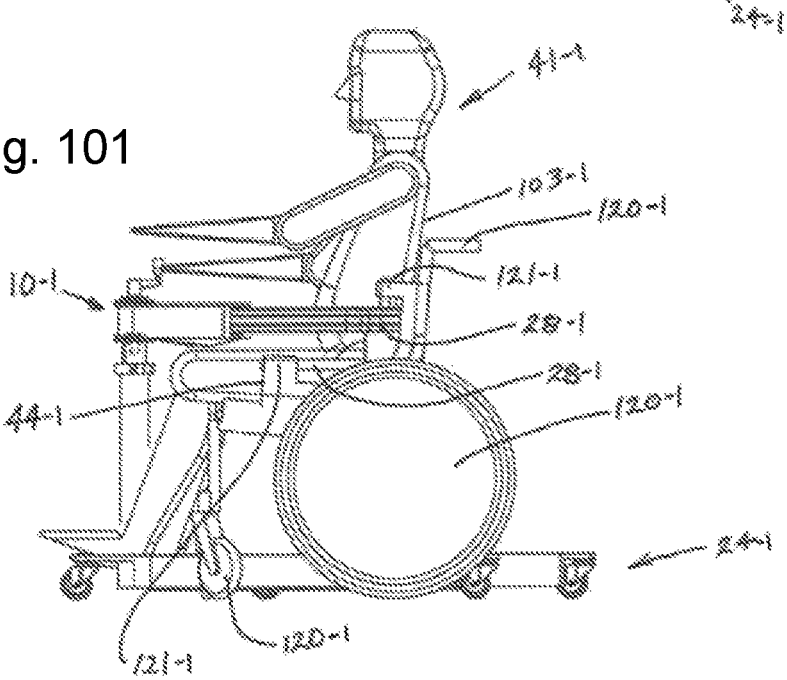

FIGS. 99-101 are various perspective views of air-lift 10-1 engaged with a conventional wheelchair 120-1 wherein patient 41-1 is being transferred from one device to the other. In this operation wheel support arms 19-1 have been retracted 24-1 to make air-lift 10-1 base 11-1 narrow 24-1 which allows the rearward portion of base 11-1 to pass under conventional wheelchair 120-1.

Patient 41-1 is seated on lifting sling 44-1 or a thin seat plate while in conventional wheelchair 120-1. Sling 44-1 has flexible webbing loops 121-1 that attach to U-shaped lifting frame 28-1. This makes air-lift 10-1 ready to begin supporting and lifting patient 41-1 so conventional wheelchair 120-1 can be removed from under patient 41-1.

FIGS. 102 and 103 show patient 41-1 has been transferred to air-lift 10-1 and base 11-1 width has been set to narrow width 24-1. Patient 41-1 and lifting portion of air-lift 10-1 are now ready to be lifted to an appropriate height to pass through a narrow aisle way.

Figure 104:
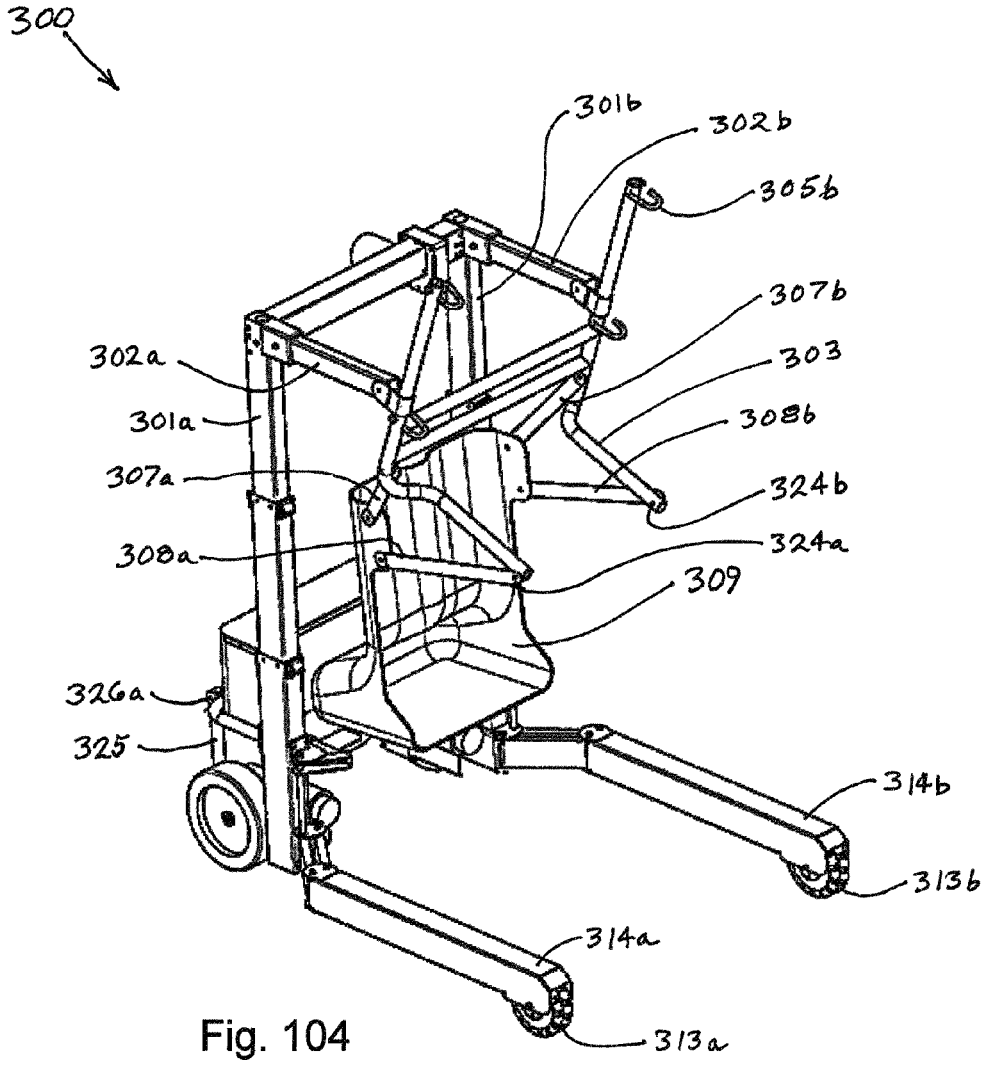
FIG. 104 is a left-rear perspective view of one embodiment of the patient wheelchair lift-transfer device configured as a rear entry power drive wheelchair, having an articulating patient support frame and knee/foot support housing.

Now referring to FIGS. 104-107, there is illustrated one embodiment of transporter 300 configured as a rear entry power drive wheelchair. FIG. 104 shows transporter 300 with lift columns 301*a* and 301*b* extended. Mounted to support arms 302*a* and 302*b* is an articulating patient support frame 303 lockably-pivotally attached at pins 304*a* and 304*b*. Support frame 303 has hooks 305*a* and 305*b* for attachment of back support sling 306. The forward end of support frame 303 has links 307*a*, 307*b* pivotally attached at points 323*a* and 323*b* and links 308*a* and 308*b* pivotally attached at points 324*a* and 324*b*. The other end of links 307*a* and 307*b* are pivotally and releasably attached to the upper end 310 of knee/foot support housing 309 at points 311*a* and 311*b*. The other end of links 308*a* and 308*b* are pivotally attached to the knee/foot support housing 309 at points 312*a* and 312*b*. Transporter 300 illustrates optional use of multi-directional rear wheels 313*a* and 313*b* attached to rear wheel support arms 314*a* and 314*b* to improve stability compared to castering multi-directional wheels 236 (FIG. 36) shown in previously described transport embodiments.

Figure 105:
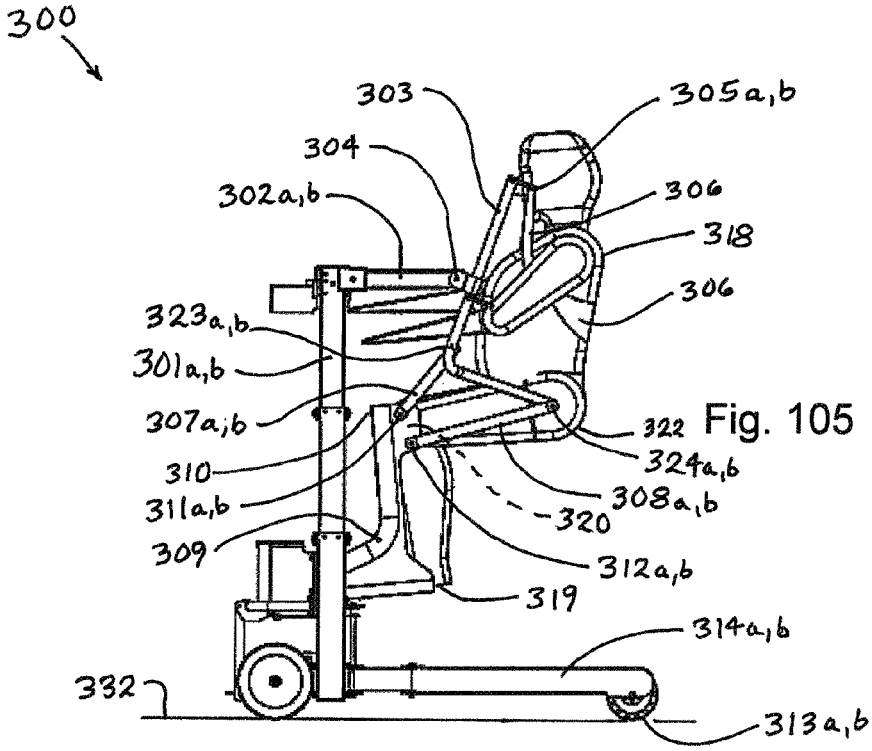
FIG. 105 is a left side view of the lift transfer device of FIG. 104 with patient supported by knee/foot housing and a sling attached to articulating patient support frame.

FIG. 105 shows the transporter of FIG. 104 having a patient 318 being transported. Feet 319 and knees 320 of patient 318 are supported on knee/foot support housing 309 with articulating support frame 303 locked from pivoting at pivots 304. The upper body of patient 318 is supported by sling 306. This patient support configuration leaves the buttocks 322 of patent 318 exposed for possible bathroom use. To lift patient 318 while keeping feet 319 resting on the floor 332 (similar to FIG. 44) links 307*a* and 307*b* can be released from knee/foot support housing 309 at points 311*a* and 311*b*. This will allow link 308*a* and 308*b* to pivot at points 312 and 324 when patient 318 is lifted, thereby leaving knee/foot support housing 309 and feet 319 resting on floor 332.

Figure 106:
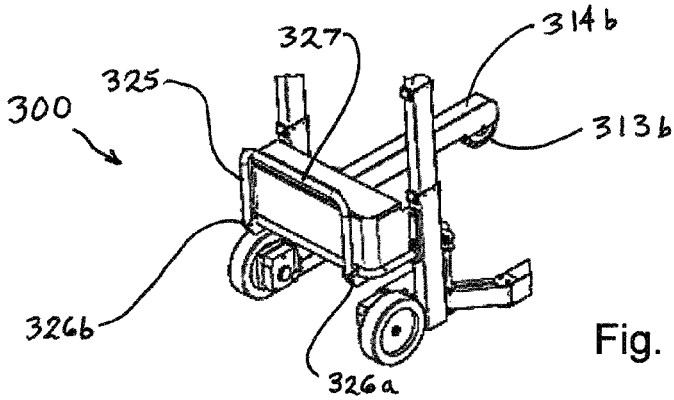
FIG. 106 is a fragmentary front left perspective view a patient lift transfer device having a caregiver support bar which is stored in upper position.
Figure 107:
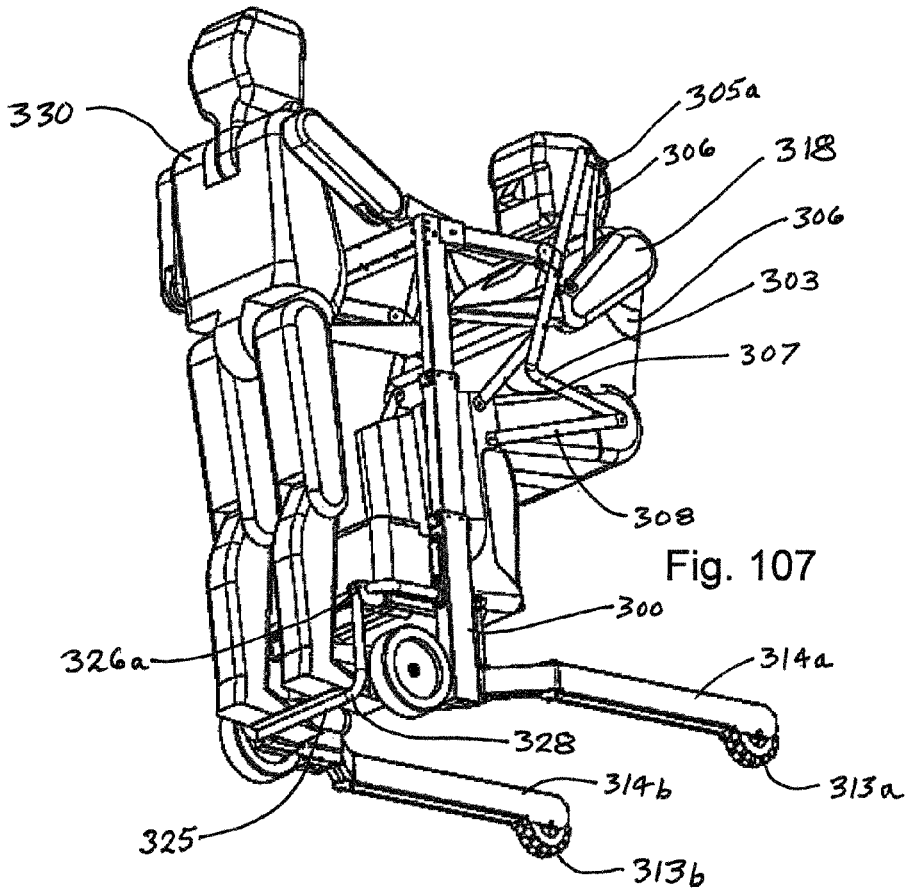
FIG. 107 is a left front perspective view showing the lift transfer device transporting both a patient and a caregiver.

FIG. 106 shows transporter 300 having a caregiver support bar 325 pivotally mounted at points 326*a* and 326*b* so that support bar 325 can be rotated 180 degrees to upright position 327 or downward position 328 (FIG. 107). With support bar 325 in downward position 328, both a patient 318 and a caregiver 330 can be transported.

The lift transfer devices of this invention can be either manually propelled, or the wheels can be power driven through a suitable drive mechanism, examples of which are disclosed in the above applications and patent.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A patient transport device comprising:

a horizontally disposed wheeled base comprising a pair of horizontally disposed wheel support arms each having a wheel mounted near a rear arm end thereof and wherein the other front arm end of each one of said wheel support arms is attached to a lifting structure comprising a pair of substantially vertical lifting columns and a frame structure including upper and lower portions disposed therebetween wherein said frame structure sidewardly spaces apart said lifting columns and one each of said pair of wheel support arms, wherein said frame structure holds said lifting columns in substantially vertical orientation, thereby forming a lifting structure and wherein said lifting structure has at least one wheel attached thereto, whereby said patient transport device is rollingly supported by said wheels to permit rolling across a supporting surface and wherein each of said lifting columns comprise double telescoping tubular structures each including a non-extendable lower guide tube, wherein said non-extendible guide tubes are rigidly connected together by said lower portion of said frame structure proximate a front end of said base, an upwardly extendable middle guide tube telescoping from the non-extendible guide tube, and an upwardly extendable upper guide tube telescoping from the middle guide tube and wherein each one of said upper guide tubes are connected together near the upper end thereof by said upper portion of said frame structure and wherein each said upper guide tube includes a patient lifting arm attached near the upper end thereof, wherein each one of said patient lifting arms extends substantially parallel to the other one of said patient lifting arms in a rearward direction and substantially above one of said wheel support arms and wherein said patient lifting arms define a rearward-opening space for receiving and supporting the patient in a forward facing orientation, and said upper guide tubes are lifted by a double telescoping jack screw arrangement disposed within each of said telescoping columns.

2. A patient transport device as in claim 1 wherein the space between said wheels of said pair of wheel support arms is adjustable independently of the space between said pair of lifting columns.

3. A patient transport device as in claim 1 wherein said patient lifting arms support an articulating patient support frame; said support frame including attachments for supporting a torso of a patient and attachments for supporting the patient's lower legs and feet.

4. A patient transport device as in claim 1 wherein the open width between said pair of lifting columns including respective wheel support arms and wheels and the open height between said supporting surface and said lower portion of said frame structure is adequate for clear passage of a small adult patient's two legs when said patient is positioned with legs substantially parallel to said supporting surface and said wheel support arms.

5. A patient transport device of claim 1 wherein said wheels allow forward, rearward and sideward motion of said transport device on said supporting surface.

6. A patient transport device comprising:

a horizontally disposed wheeled base comprising a pair of horizontally disposed wheel support arms each having a wheel mounted near a front arm end thereof wherein each said wheel allows forward, rearward and sideward motion of said wheeled base and wherein the other rear arm end of each one of said wheel support arms is attached to a lifting structure comprising a pair of substantially vertical lifting columns and a frame structure including upper and lower portions disposed therebetween wherein said frame structure sidewardly spaces apart said lifting columns and one each of said pair of wheel support arms, wherein said frame structure holds said lifting columns in substantially vertical orientation, thereby forming a lifting structure and wherein said lifting structure has a pair of electric power driven wheels attached, whereby said patient transport device is rollingly supported by said wheels to permit rolling across a supporting surface and wherein the speed of each said electric power driven wheel is controlled by an electronic controller while supporting a patient and wherein each of said lifting columns comprise double telescoping tubular structures including a non-extendable lower guide tube, wherein said non-extendible guide tubes are rigidly connected together proximate a front of said base by said lower portion of said frame structure, an upwardly extendable middle guide tube telescoping from the non-extendible guide tube, and an upwardly extendable upper guide tube telescoping from the middle guide tube and wherein each one of said upper guide tubes are connected together near the upper end thereof by said upper portion of said frame structure and wherein each one of said upper guide tubes includes a patient lifting arm attached near the upper end thereof and extending rearwardly to define a rearwardly-opening space for receiving and supporting a patient in a forward facing orientation, wherein each one of said patient lifting arms extends substantially parallel to the other one of said patient lifting arms and substantially above one of said wheel support arms and wherein said upper guide tubes are lifted by a double telescoping jack screw arrangement disposed within each of said telescoping columns.

7. A patient transport device as in claim 6 wherein the space between said pair of wheel support arms is adjustable independently of the space between said pair of lifting columns.

8. A patient transport device as in claim 7 wherein at least one of said wheel support arms is connected to said lifting structure by a 4-bar linkage arrangement to allow said space adjustment.

9. A patient transport device as in claim 6 wherein the direction and speed that said patient transport device rolls across a supporting surface is remotely controllable by an electronic wireless transmitting controller.

10. A patient transport device as in claim 6 wherein said frame structure includes a caregiver support surface that allows a caregiver to be transported on said patient transport device while transporting said patient.

11. A patient lift transport device comprising:

a horizontally disposed wheeled base, said wheeled base supporting a lifting structure for substantially vertical lifting and lowering of a patient; said lifting structure including support bearing surfaces and a substantially horizontally oriented U-shaped lifting frame near the upper end thereof which has a U-shape for supporting the patient and wherein said bearing surfaces support and guide a curved portion of said U-shaped lifting frame in a substantially horizontal arcing motion about a substantially stationary vertical axis such that said lifting frame is movable horizontally between first and second orientations and wherein said patient is supported by and moves with said U-shaped lifting frame, said vertical axis being stationary relative to said wheeled base and said lifting frame having an open side defined by said U-shape which opens rearwardly in said first orientation and sidewardly in said second orientation while said patient faces forwardly in said first orientation and sidewardly in said second orientation.

12. A patient lift transport device as in claim 11 wherein said horizontally disposed wheeled base includes at least three wheels, and wherein said lifting structure comprising at least one lifting column and wherein said wheeled base holds said lifting column in substantially vertical orientation and wherein said lifting column comprises a telescoping tubular structure including a non-extendable lower guide tube and at least one upwardly extendable upper guide tube.

13. A patient lift transport device as in claim 11 wherein said U-shaped lifting frame is rotated about said substantially vertical axis by force from an electric drive motor.

14. A patient transport device comprising:

a horizontally disposed wheeled base comprising a pair of horizontally disposed wheel support arms each having a wheel mounted near one end thereof and wherein the other end of each one of said wheel support arms is attached to a lifting structure comprising a pair of substantially vertical lifting columns and a frame structure including upper and lower portions disposed therebetween wherein said frame structure sidewardly spaces apart said lifting columns and one each of said pair of wheel support arms, wherein said frame structure holds said lifting columns in substantially vertical orientation, thereby forming a lifting structure and wherein said lifting structure has at least one wheel attached thereto, whereby said patient transport device is rollingly supported by said wheels to permit rolling across a supporting surface and wherein each of said lifting columns comprise double telescoping tubular structures each including a non-extendable lower guide tube, wherein said non-extendible guide tubes are rigidly connected together by said lower portion of said frame structure, an upwardly extendable middle guide tube and an upwardly extendable upper guide tube and wherein each one of said upper guide tubes are connected together near the upper end thereof by said upper portion of said frame structure and wherein each said upper guide tube includes a patient lifting arm attached near the upper end thereof, wherein each one of said patient lifting arms extends substantially parallel to the other one of said patient lifting arms and substantially above one of said wheel support arms and wherein said upper guide tubes are lifted by a double telescoping jack screw arrangement disposed within each of said telescoping columns, wherein a first space between said wheels of said pair of wheel support arms is adjustable independently of a second space between said pair of lifting columns, wherein at least one of said wheel support arms is connected to said lifting structure by a 4-bar linkage arrangement to allow said space adjustment of said first space.

* * * * *